US010631618B2

(12) United States Patent
Wasylko

(10) Patent No.: US 10,631,618 B2
(45) Date of Patent: Apr. 28, 2020

(54) CONVERTIBLE BAG SYSTEM

(71) Applicant: Kristina D. Wasylko, Sagle, ID (US)

(72) Inventor: Kristina D. Wasylko, Sagle, ID (US)

( * ) Notice: Subject to any disclaimer, the term of this patent is extended or adjusted under 35 U.S.C. 154(b) by 0 days.

(21) Appl. No.: 16/257,023

(22) Filed: Jan. 24, 2019

(65) Prior Publication Data

US 2019/0223580 A1 Jul. 25, 2019

Related U.S. Application Data

(60) Provisional application No. 62/621,277, filed on Jan. 24, 2018, provisional application No. 62/780,912, filed on Dec. 17, 2018.

(51) Int. Cl.

| | |
|---|---|
| ***A45F 5/02*** | (2006.01) |
| ***F41C 33/00*** | (2006.01) |
| ***A45F 3/14*** | (2006.01) |
| ***A45C 11/20*** | (2006.01) |
| ***A45C 11/36*** | (2006.01) |
| ***A45C 11/34*** | (2006.01) |
| *A45F 3/00* | (2006.01) |
| *A45F 3/02* | (2006.01) |
| *A45C 7/00* | (2006.01) |
| *A45F 5/00* | (2006.01) |
| *A45C 11/00* | (2006.01) |
| *F41C 33/02* | (2006.01) |
| *A45C 13/30* | (2006.01) |

(52) U.S. Cl.

CPC ..... *A45F 3/14* (2013.01); *A45C 11/20* (2013.01); *A45C 11/34* (2013.01); *A45C 11/36* (2013.01); *A45F 5/021* (2013.01); *A45C 7/0036* (2013.01); *A45C 2011/002* (2013.01); *A45C 2011/007* (2013.01); *A45C 2013/306* (2013.01); *A45F 3/005* (2013.01); *A45F 3/02* (2013.01); *A45F 2003/006* (2013.01); *A45F 2003/142* (2013.01); *A45F 2003/144* (2013.01); *A45F 2003/148* (2013.01); *A45F 2005/008* (2013.01); *A45F 2200/0575* (2013.01); *A45F 2200/0591* (2013.01); *F41C 33/0227* (2013.01)

(58) Field of Classification Search

CPC ..... A45F 2003/142; A45F 5/021; A45F 2005/008; F41C 33/041; F41C 33/043

USPC ..... 224/578, 579, 674, 192, 911

See application file for complete search history.

(56) References Cited

U.S. PATENT DOCUMENTS

| | | | | | |
|---|---|---|---|---|---|
| 906,596 | A * | 12/1908 | Wilson | A45F 3/04 | 224/637 |
| 2,819,830 | A * | 1/1958 | Murray | A45F 5/00 | 224/578 |
| 2,960,137 | A * | 11/1960 | Lipsitz | A45C 11/38 | 206/316.2 |
| 3,019,952 | A * | 2/1962 | Brewster | A45F 3/04 | 294/142 |
| 3,627,182 | A * | 12/1971 | Calkins | B43K 23/001 | 224/584 |
| 3,731,858 | A * | 5/1973 | Baker | F41C 33/0227 | 224/192 |

(Continued)

*Primary Examiner* — Justin M Larson

(74) *Attorney, Agent, or Firm* — Seed Intellectual Property Law Group LLP

(57) ABSTRACT

The present disclosure is generally directed to a bag that includes intersecting securing elements coupled to the exterior. A positioning strap may be inserted under a first securing element, a second securing element, or both.

13 Claims, 74 Drawing Sheets

(56) References Cited

U.S. PATENT DOCUMENTS 3,802,613 A * 4/1974 Droeger ..... A45F 3/04 224/153
4,515,300 A * 5/1985 Cohen ..... A45C 1/04 224/153
4,718,585 A * 1/1988 Atkins, Sr. ..... F41C 33/0227 224/238
4,759,483 A * 7/1988 Willoughby ..... A45F 5/14 224/232
4,764,962 A * 8/1988 Ekman ..... H04R 1/02 224/259
4,998,653 A * 3/1991 LaBelle ..... A45C 1/04 224/240
D335,221 S * 5/1993 Nichols ..... D3/222
5,570,824 A * 11/1996 Lyon ..... A45F 3/00 224/148.5
5,577,652 A * 11/1996 Cooper ..... A45F 3/02 224/153
6,163,450 A * 12/2000 Kim ..... G06F 1/1616 361/679.27
6,220,493 B1 * 4/2001 Iijima ..... A45F 3/00 224/153
6,390,345 B1 * 5/2002 Brown ..... A45C 3/00 190/110
6,662,986 B2 * 12/2003 Lehtonen ..... A45F 5/02 224/222
6,926,182 B2 * 8/2005 Cragg ..... A45F 5/021 224/236
7,469,809 B2 * 12/2008 Rodarte ..... A45F 5/00 224/218
8,668,122 B2 * 3/2014 Case ..... A45F 3/02 224/218
8,746,523 B1 * 6/2014 Woolley ..... A45C 13/30 224/578
9,402,459 B2 * 8/2016 Seuk ..... A45F 5/021
9,439,501 B2 * 9/2016 Demskey ..... A45F 3/14
9,456,066 B2 * 9/2016 Singhal ..... G06F 1/1626
9,664,481 B2 * 5/2017 Alcantra ..... A41C 1/12
2004/0084494 A1 * 5/2004 Gilliam ..... A45F 3/14 224/583
2006/0266782 A1 * 11/2006 Godshaw ..... A45F 5/02 224/674
2007/0290017 A1 * 12/2007 Godshaw ..... A45F 5/02 224/674
2012/0104059 A1 * 5/2012 Yen ..... A45C 11/00 224/218
2017/0356719 A1 * 12/2017 Martin ..... F41C 33/046
2019/0223580 A1 * 7/2019 Wasylko ..... F41C 33/048

* cited by examiner

515

1330

CONVERTIBLE BAG SYSTEM

BACKGROUND

A wide variety of bags are produced that are designed to be carried in a specific manner (e.g., over a shoulder, across the body, around the waist, etc.). Some bags are designed such that the user can select how to carry the bag. For example, some bags have a short set of handles and a shoulder strap allowing the bag to be carried by the handles or the shoulder strap, as desired.

However, the currently available bag and strap systems do not allow the user flexibility to choose the bag, the strap, and the arrangement of the strap with respect to the bag. Thus, a need exists for an improved bag and strap system.

BRIEF SUMMARY

The present disclosure generally relates to a system including at least one of a variety of bags (e.g., cases, pouches, and the like) that includes at least two securing elements that form an "X" pattern on the outside of the bag. Depending on the size of the bag, additional securing elements may be present. The system further includes at least one strap of a variety of straps positioned under at least two of the securing elements. The arrangement of the strap determines the manner by which the bag is to be carried by the user.

BRIEF DESCRIPTION OF THE SEVERAL VIEWS OF THE DRAWINGS

The detailed description is described with reference to the accompanying figures. In the figures, the left-most digit(s) of a reference number identifies the figure in which the reference number appears. The same right-most digits of a reference number in different figures indicates similar or identical components or features.

The sizes and relative positions of elements in the figures are not necessarily shown to scale. For example, the shapes of various elements and angles are not shown to scale and some of these elements are enlarged and positioned to improve figure legibility. Further, the particular shapes of the elements as shown, are not intended to convey any information regarding the actual shape of the particular elements, and have been solely selected for ease of recognition in the figures.

DETAILED DESCRIPTION

The present disclosure generally relates to a system that includes at least one of a variety of bags (e.g., cases, pouches and the like) and at least one strap of a variety of straps. As described in more detail below, such systems provide a user with versatility in the bags and strap combination to be used, as well as in the manner by which a bag is to be carried. For example, the systems of the present disclosure allow a bag to be worn in various positions on a user's body (e.g., over a shoulder, across the user's body, as a backpack, or around a user's ankle, thigh, waist, etc.), or to be stored in a variety of secure manners off of a user's body.

In order to describe particular embodiments of the devices and methods of the disclosure, reference is made to the appended figures. This discussion should not be construed as limiting, as the particular details of the embodiments described herein are by way of example and are for purposes of illustrative discussion of embodiments of the present disclosure.

Figure 1A:
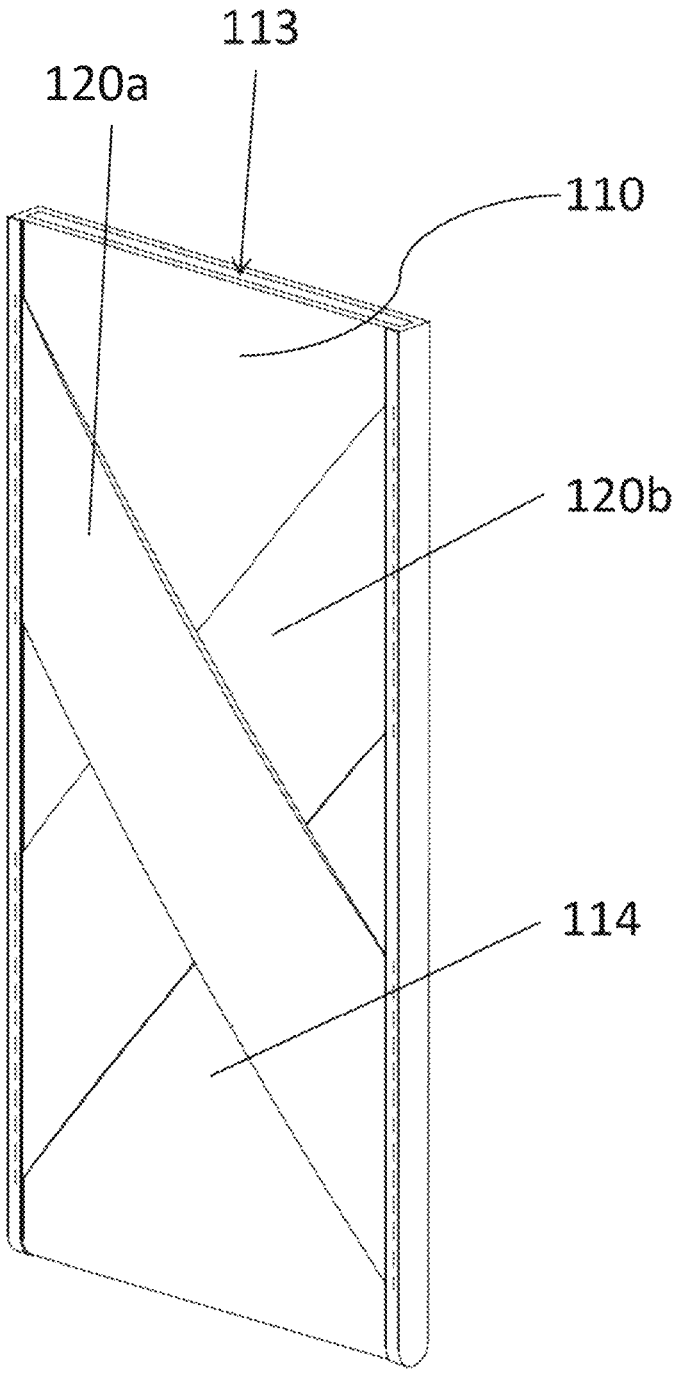
FIGS. 1A-1E show several views of an embodiment of a bag of the disclosure.
Figure 1B:
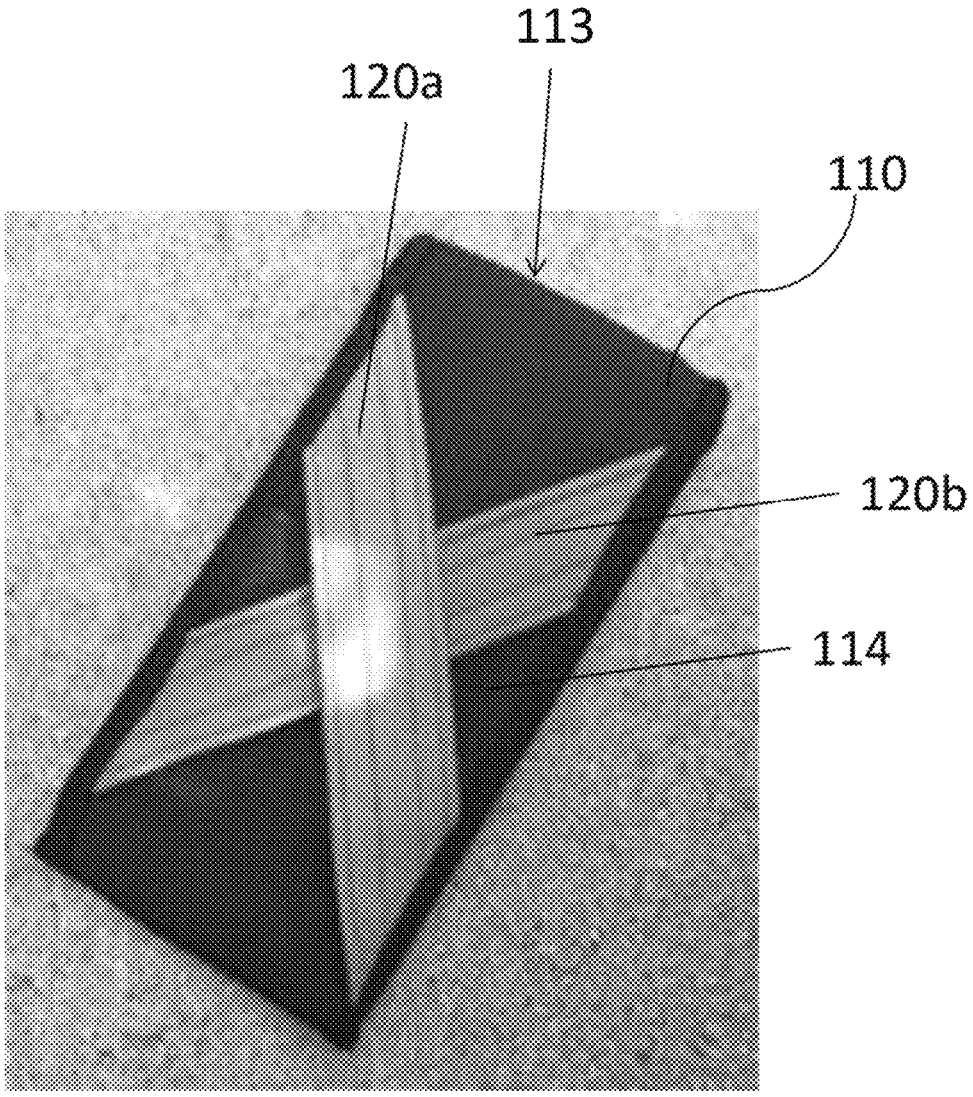

Embodiments of the present disclosure include a bag 110, as shown in FIGS. 1A and 1B. In this embodiment, bag 110 is a pouch, meaning that the opening 113 does not include a closing element (e.g., a cord that can be used to cinch the opening and secured with a toggle, button(s), zipper(s), snap(s), clip(s), etc.).

Figure 1C:
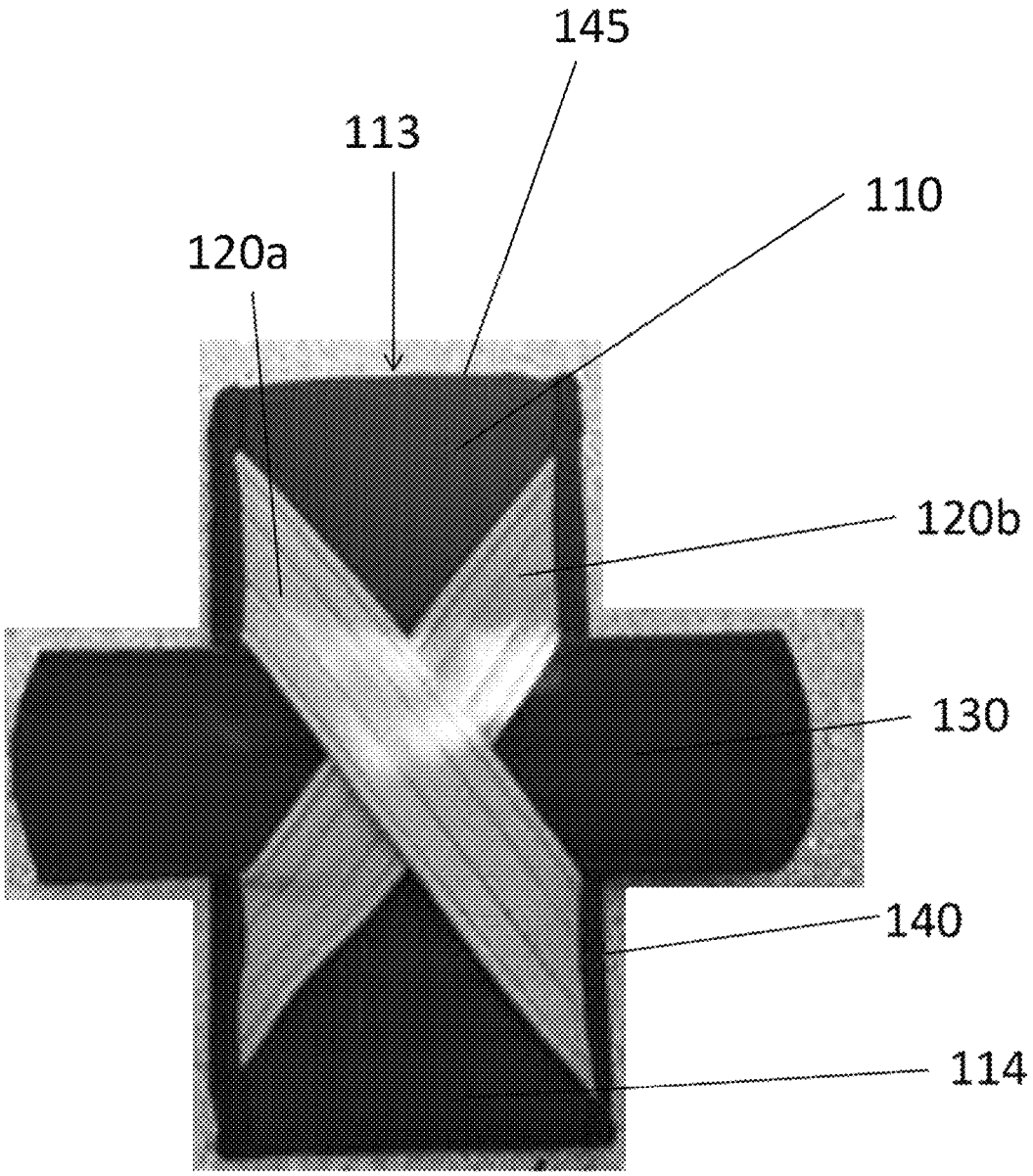

The exterior 114 of the bag 110 includes two securing elements 120*a*, 120*b* that form an "X" pattern on the outside of the bag 110. As can be seen in FIG. 1C, a strap 130 is inserted under the securing elements 120*a*, 120*b* (i.e., between the bag 110 and the securing elements 120*a*, 120*b*). The securing elements 120*a*, 120*b* are sized and arranged such that the strap 130 can be inserted under the securing elements 120*a*, 120*b* such that the strap 130 is substantially parallel to a first side 140 of the bag 110 or in a perpendicular direction, such that the strap 130 is substantially parallel to a second side 145 of the bag 110.

Figure 1D:
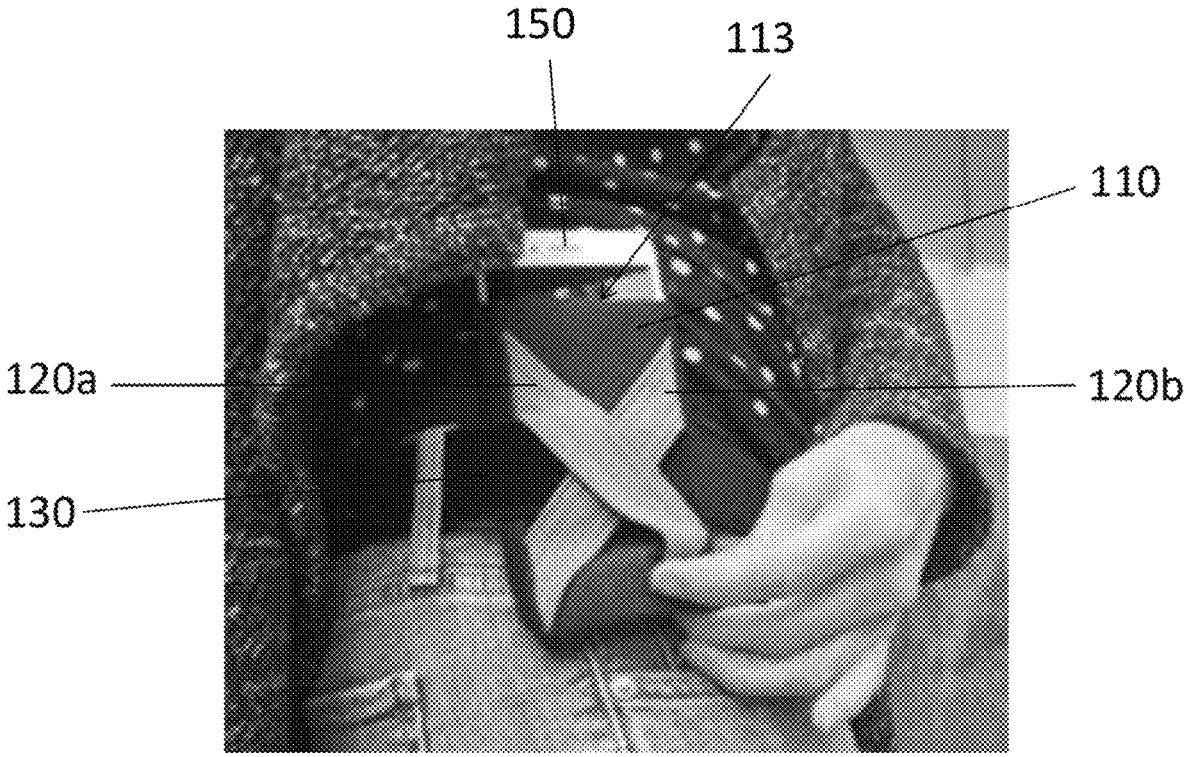

The strap 130 is arranged under securing elements 120*a*, 120*b* and around the user's waist, as shown in FIG. 1D. In this embodiment, the strap 130 is arranged such that the bag is between the user and the strap 130. However, in other embodiments, the strap 130 may be arranged between the user and the bag 110. In this embodiment, bag 110 is sized such that a mobile phone 150 can be securely positioned in the bag 110. As is understood, the size and configuration of the bag 110 can be selected based on the user's preferences and ultimate purpose.

Figure 1E:
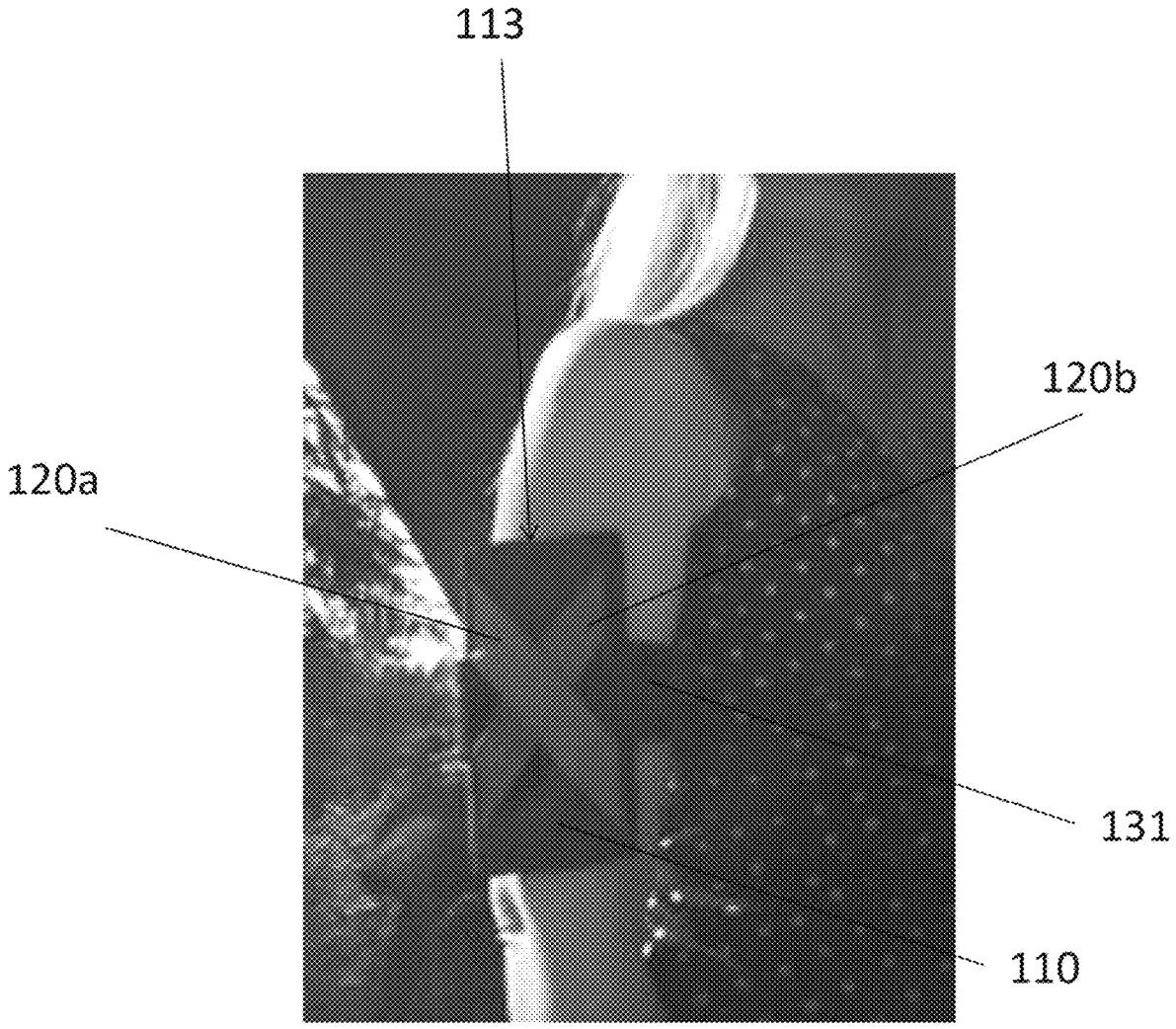

As shown in FIG. 1E, bag 110 may be coupled to a different strap 131. Strap 131 is sized to fit around a user's arm and can be used, for example, when exercising.

Figure 2A:
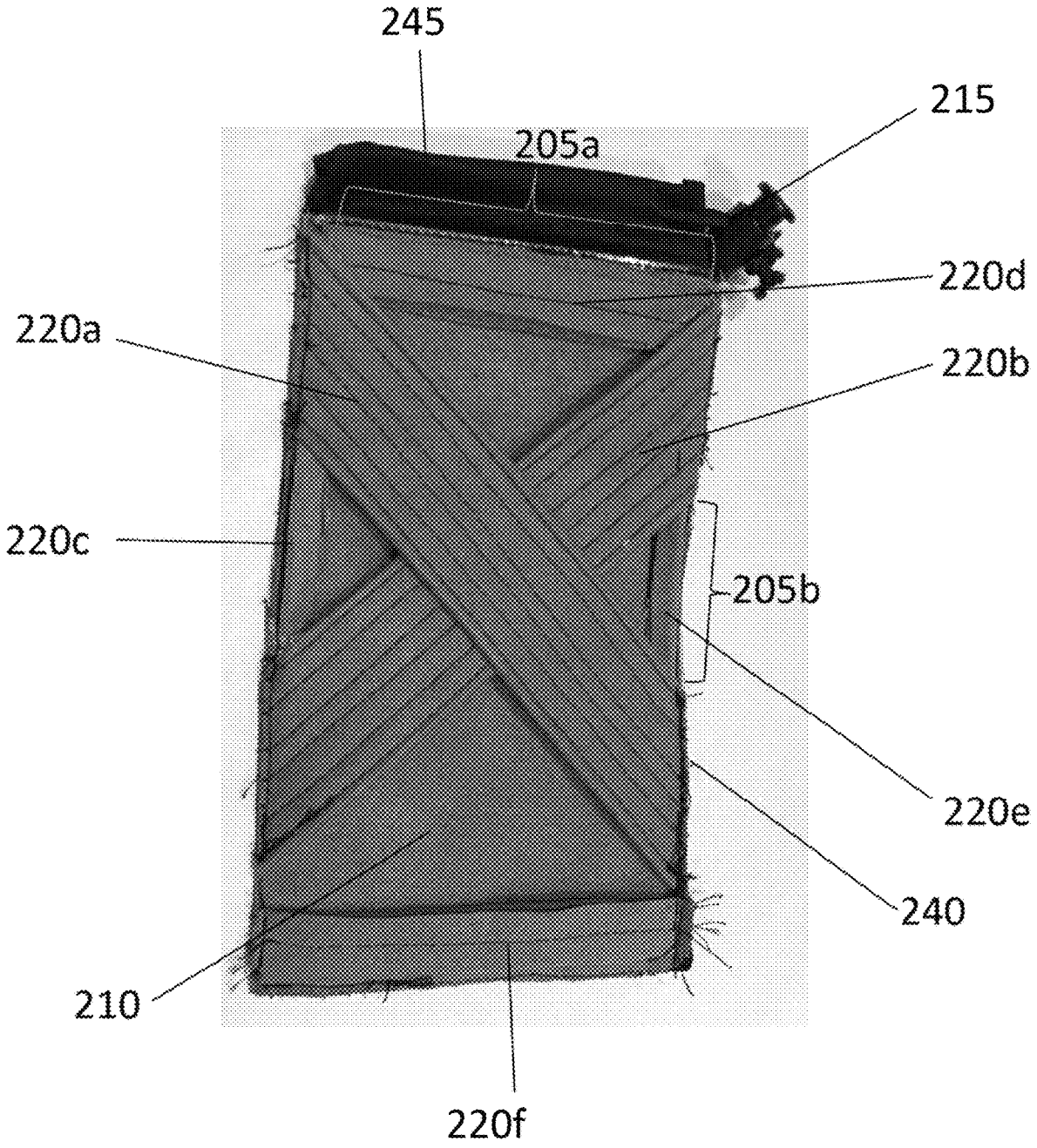
FIGS. 2A-2E show several views of an embodiment of a bag of the disclosure.

An alternate embodiment of a bag 210 of the disclosure is shown in FIG. 2A. In this embodiment, bag 210 includes a cord 215 that can be used to cinch the opening closed and can be secured by the toggle. Bag 210 can be suitably sized to accommodate a mobile phone or a pair of glasses. For example, side 245 is about 3 to 4 inches and side 240 is about 6 to 7 inches. In a specific example, side 245 is about 3.75 inches and side 240 is about 6.25 inches.

Figure 2B:
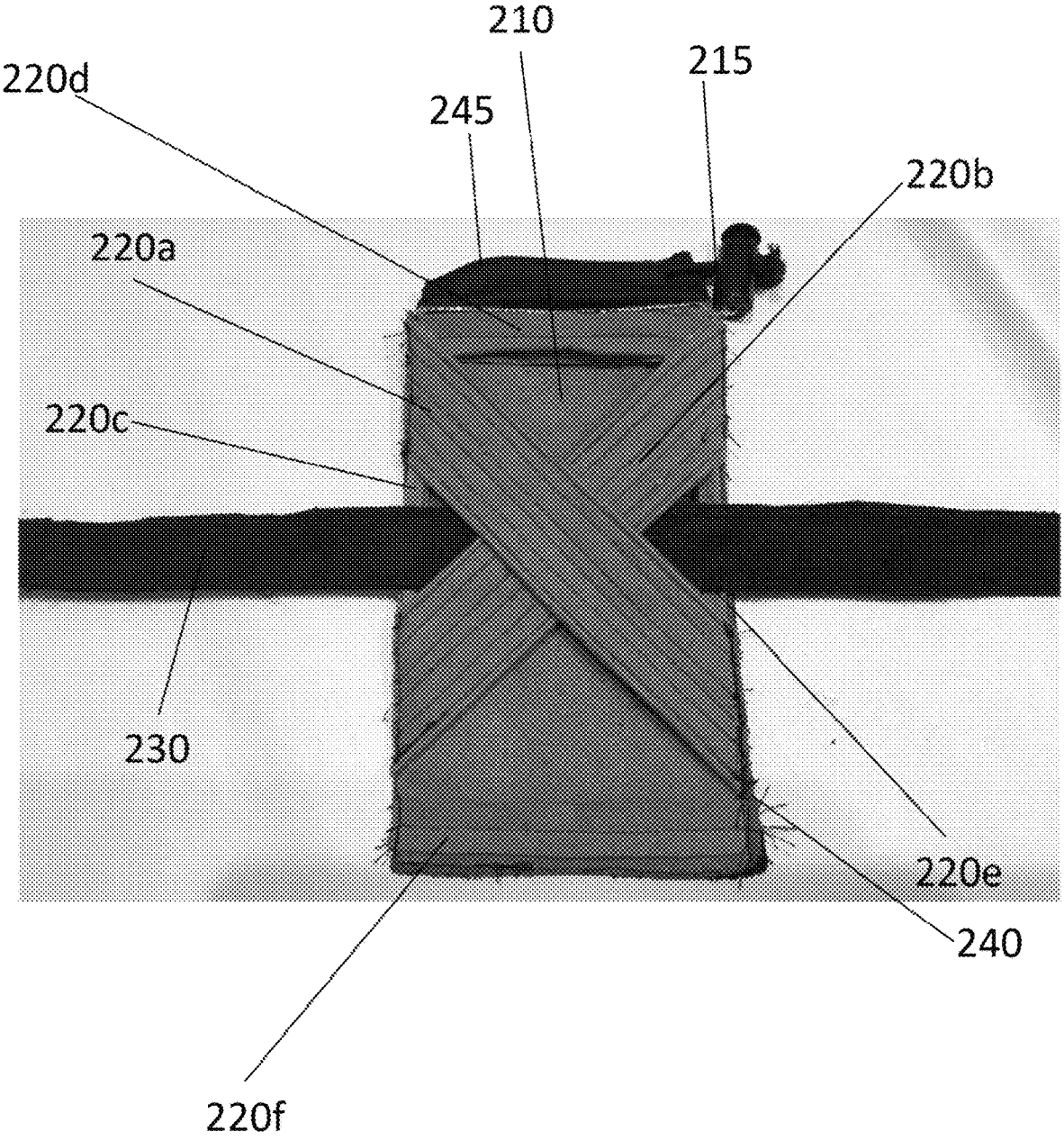

Bag 210 includes securing elements 220*a*, 220*b* arranged in an "X" pattern on the outside of the bag 210. This embodiment further includes securing elements 220*c*-220*f* arranged around the perimeter of the bag 210. Strap 230 can be arranged under securing elements 220*a*, 220*b*, but over securing elements 220*c*, 220*e*, as shown in FIG. 2B. The opening 205*a* between securing elements 220*a*, 220*b* on side 245 ranges from about 2 to about 4 inches. For example, the opening 205*a* is about 3 inches. The opening 205*b* between securing elements 220*a*, 220*b* on side 240 ranges from about 2 to about 4 inches. For example, the opening 205*b* is about 2.25 inches.

Figure 2C:
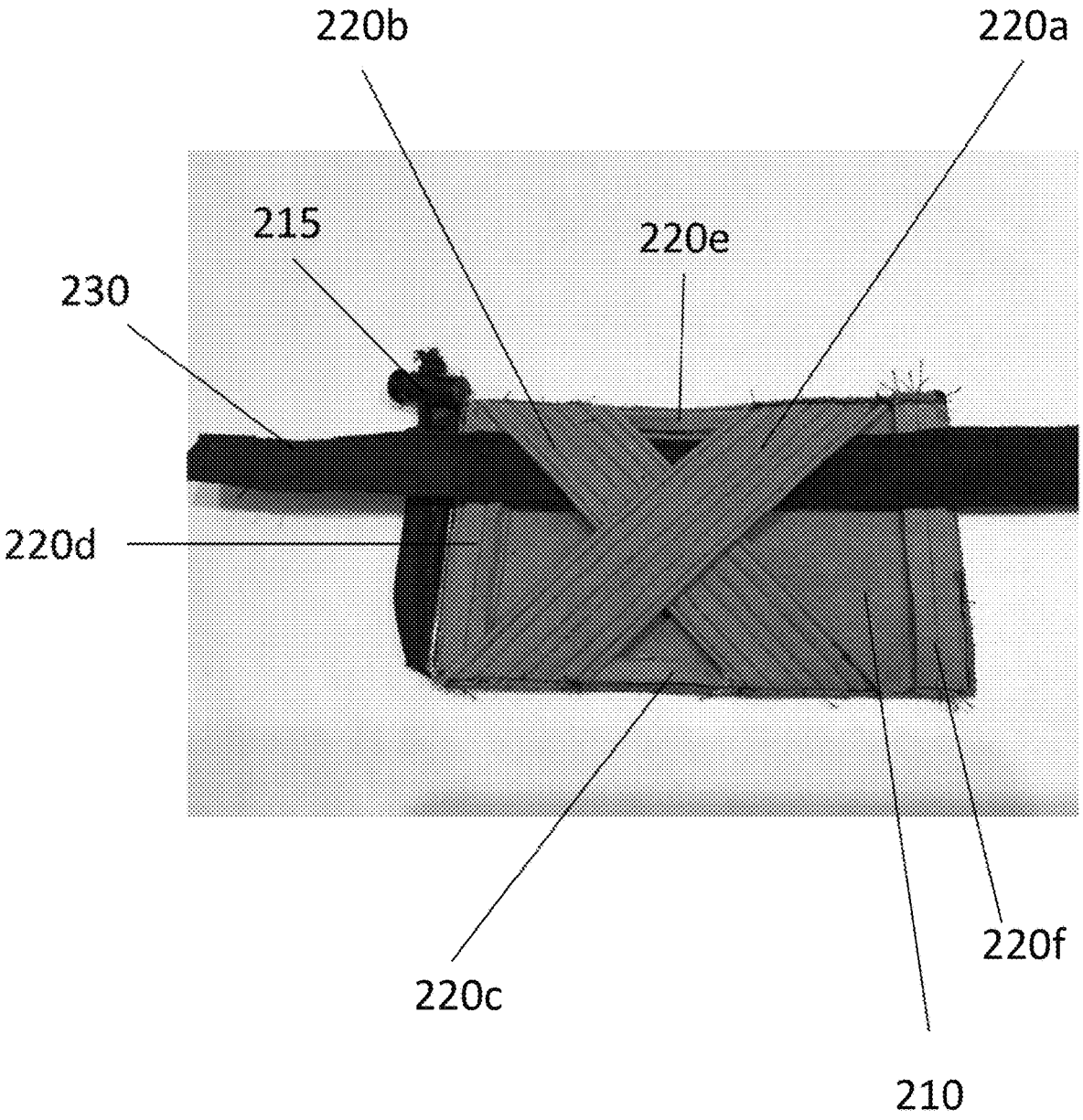
Figure 2D:
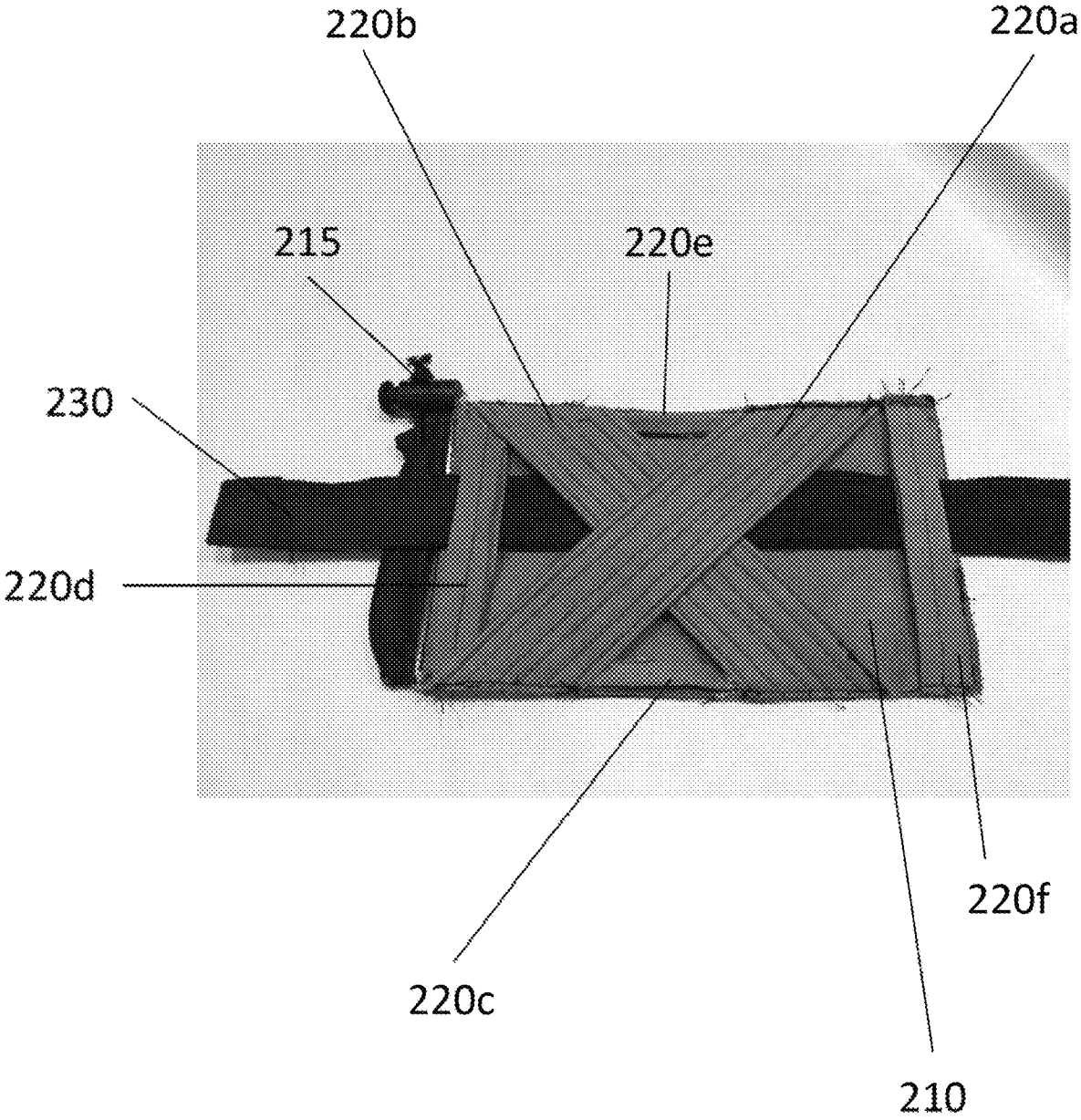
Figure 2E:
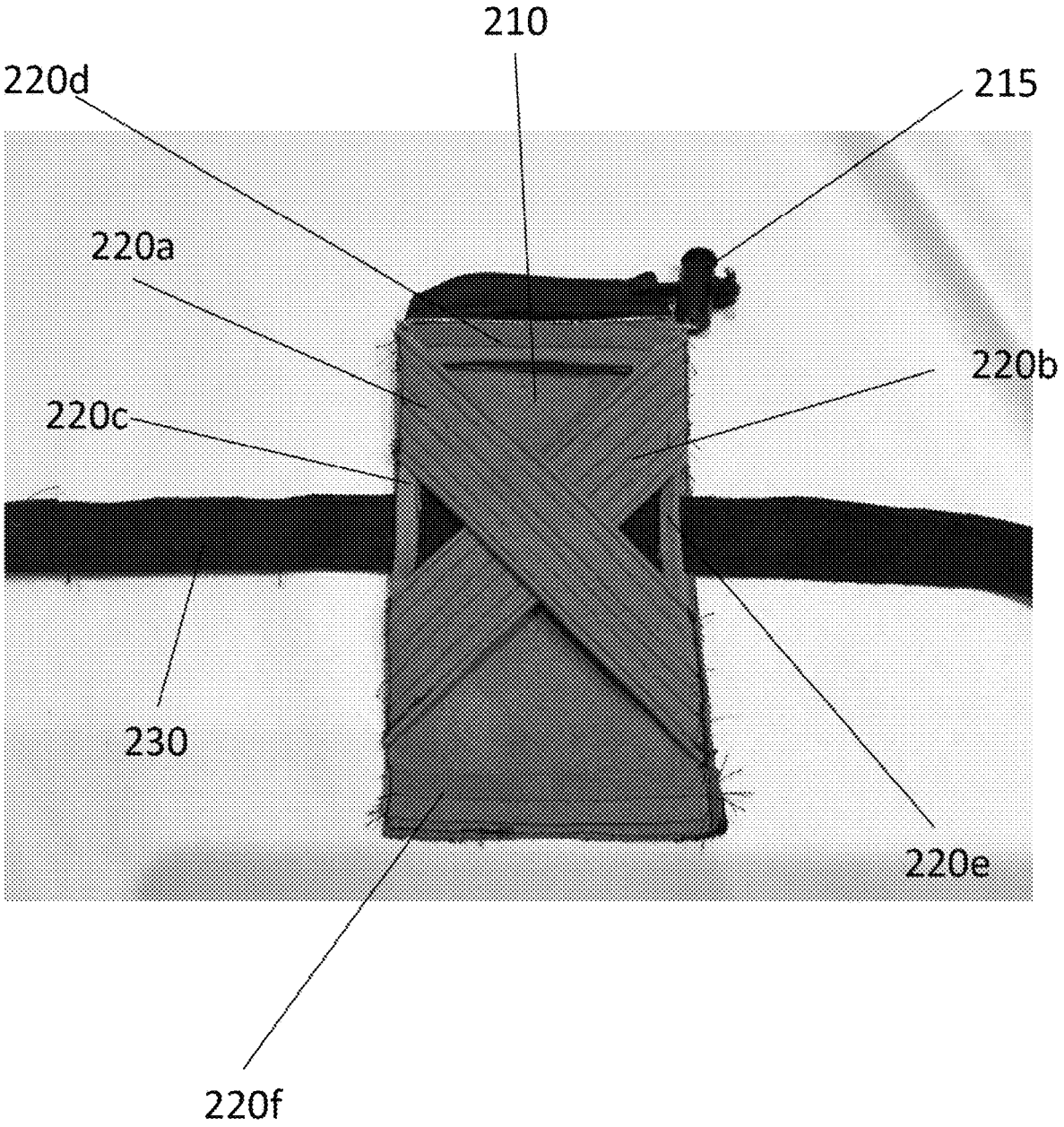

Alternatively, strap 230 can be arranged under securing elements 220*a*, 220*b*, but over securing elements 220*d*, 220*f*, as shown in FIG. 2C. Further, strap 230 can be arranged under securing elements 220*a*, 220*b*, 220*d*, 220*f*, as shown in FIG. 2D. Alternatively, strap 230 can be arranged under securing elements 220*a*, 220*b*, 220*c*, 220*e*, as shown in FIG. 2E.

Figure 3A:
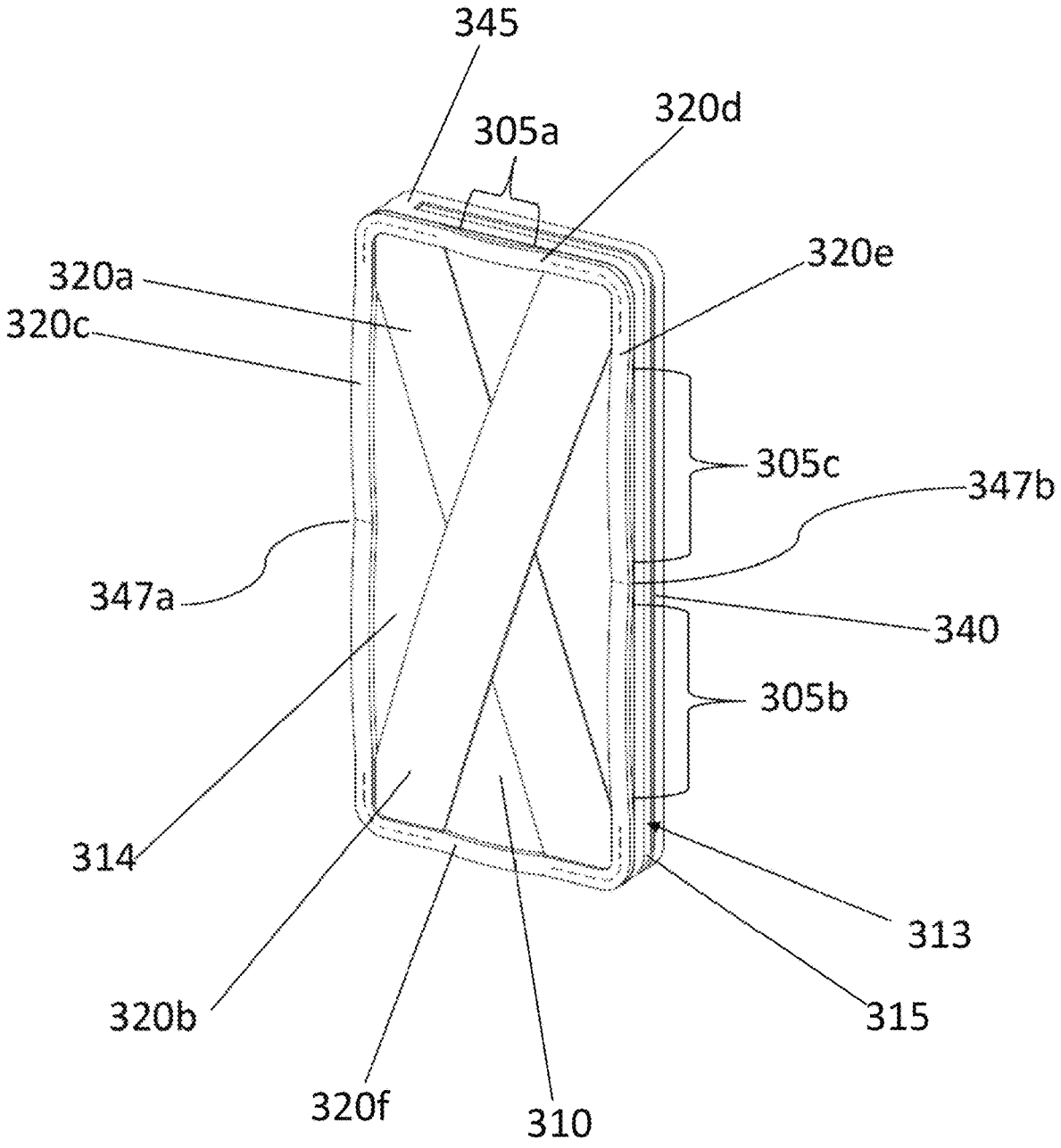
FIGS. 3A-3C show two views of an embodiment of a bag of the disclosure.
Figure 3B:
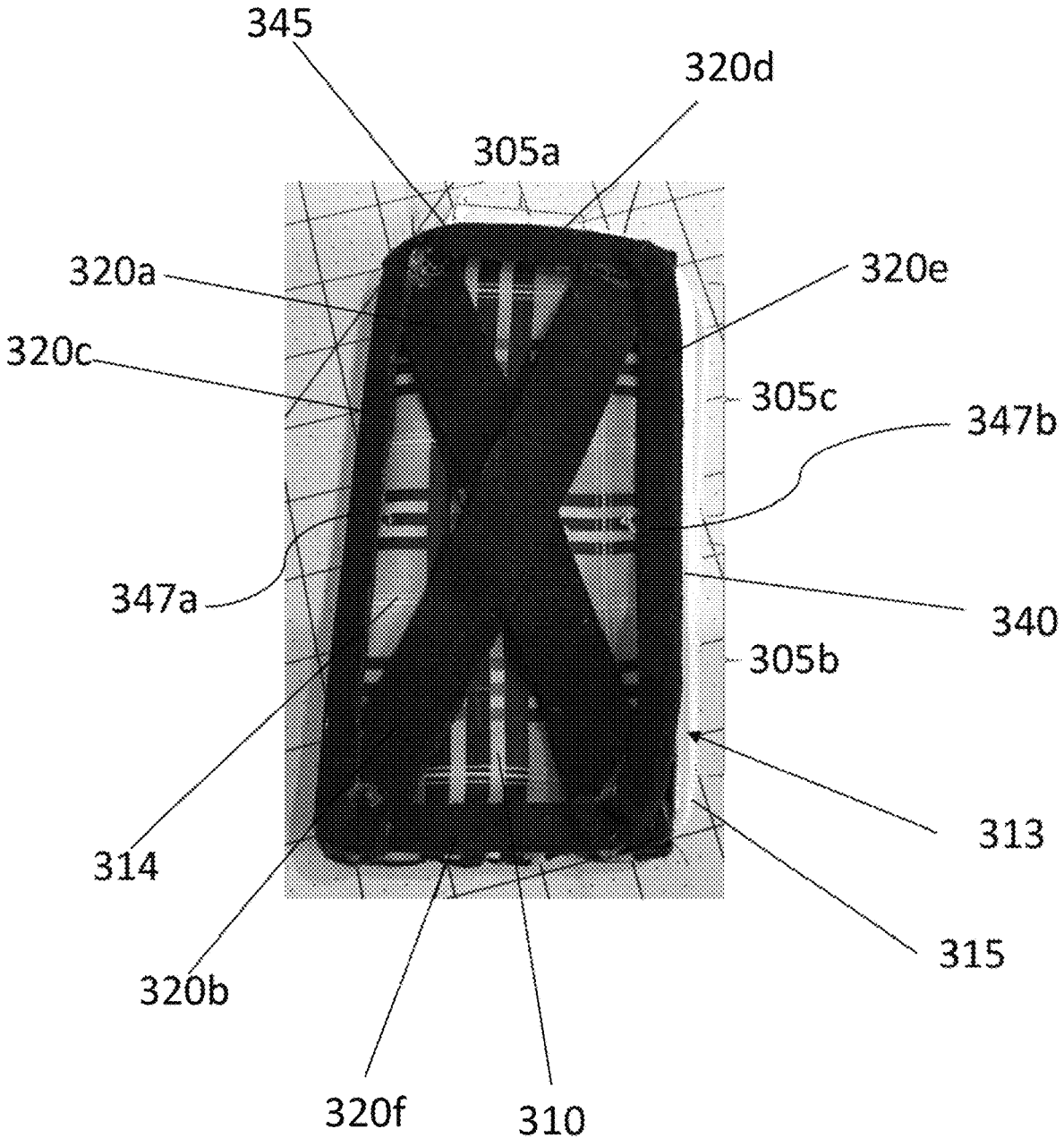

The exterior 314 of a further embodiment of a bag 310 of the disclosure is shown in FIGS. 3A and 3B. In this embodiment, the opening 313 of the bag 310 extends along the first side 340 and the second side 345 of the bag 310. A zipper 315 closes the opening 313.

In embodiments, bag 310 is designed to be used while kayaking, boating, rafting, hiking, camping, etc. In such embodiments, bag 310 is made of a water-resistant or waterproof material. Zipper 315 may also be water-resistant or waterproof in such embodiments. In other embodiments, zipper 315 is replaced with a roll-top or other water-resistant or waterproof closure.

Figure 3C:
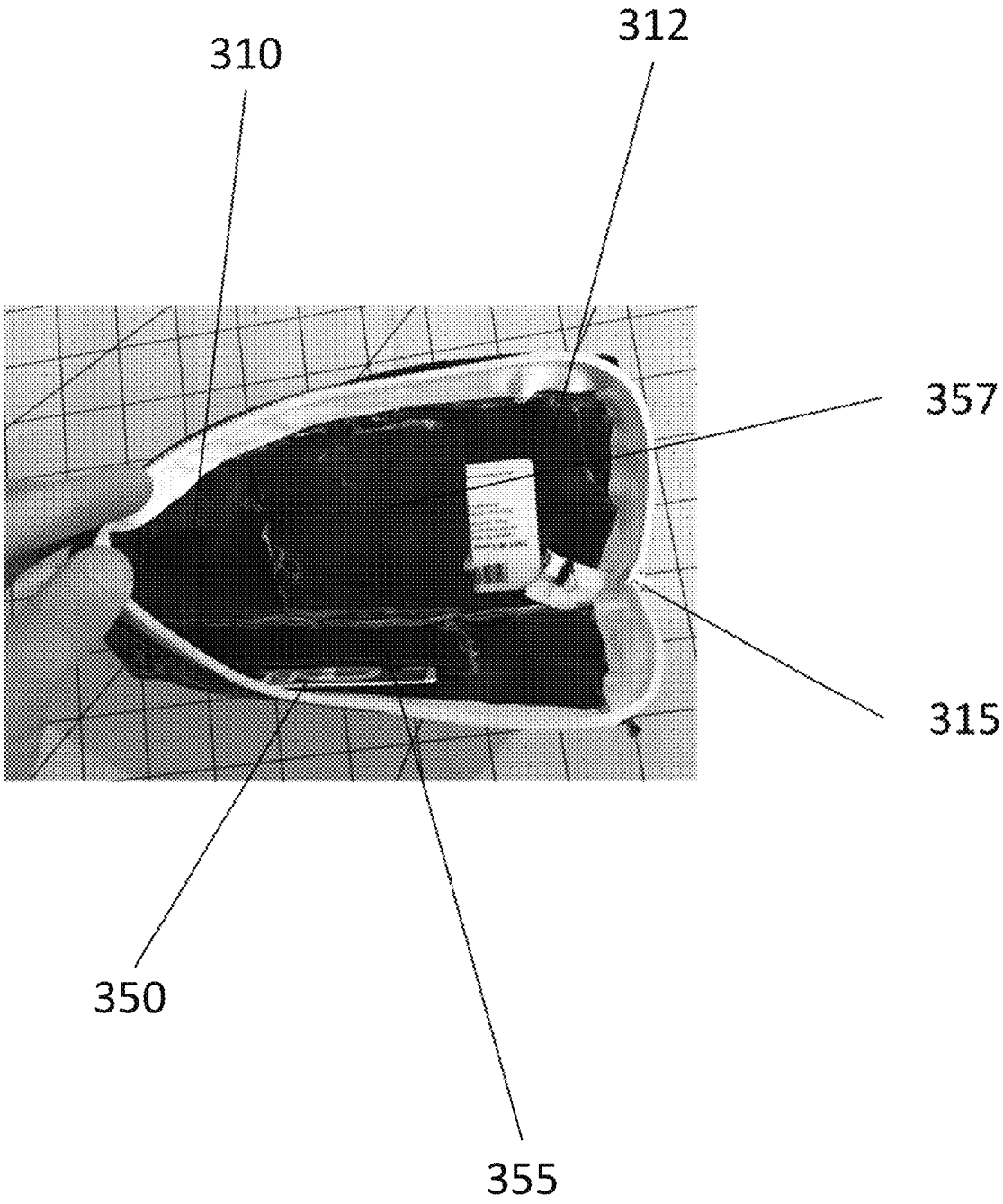

FIG. 3C shows the interior 312 of bag 310. As can be seen, bag 310 includes pocket(s) 355 or strap(s) 357 suitably sized to accommodate cards 350, money, a mobile phone, a checkbook, and the like. Zipper 315 can be used to close the opening 313 of bag 310.

Returning to FIG. 3B, it can be seen that bag 310 includes securing elements 320*a*, 320*b* arranged in an "X" pattern on the outside of the bag 310. This embodiment further includes securing elements 320*c*-320*f* arranged around the perimeter of the bag 310. In this embodiment, side 345 is about 3 to 5 inches and side 340 is about 7 to 8 inches. In a specific example, side 345 is about 4 inches and side 340 is about 7.5 inches. The opening 305*a* between securing elements 320*a*, 320*b* on side 345 ranges from about 2 to about 3 inches. For example, the opening 305*a* is about 2.5 inches.

As shown, securing elements 320*c* and 320*e* are secured (e.g., stitching, adhesive, removable couplings (for example, hook and loop fasteners, buttons, snaps, etc.), and the like) to the surface of the bag at mid-points 347*a*, 347*b* of the length of the second side 340. Thus, securing elements 320*c* and 320*e* are separated into two portions under either of which a strap can be arranged. The opening 305*b* between securing element 320*a* and midpoint 347*b* on side 340, opening 305*c* between securing element 320*b* and midpoint 347*b* on side 340 ranges from about 2 to about 4 inches. For example, openings 305*b*, 305*c* are each about 2.5 inches.

Figure 4A:
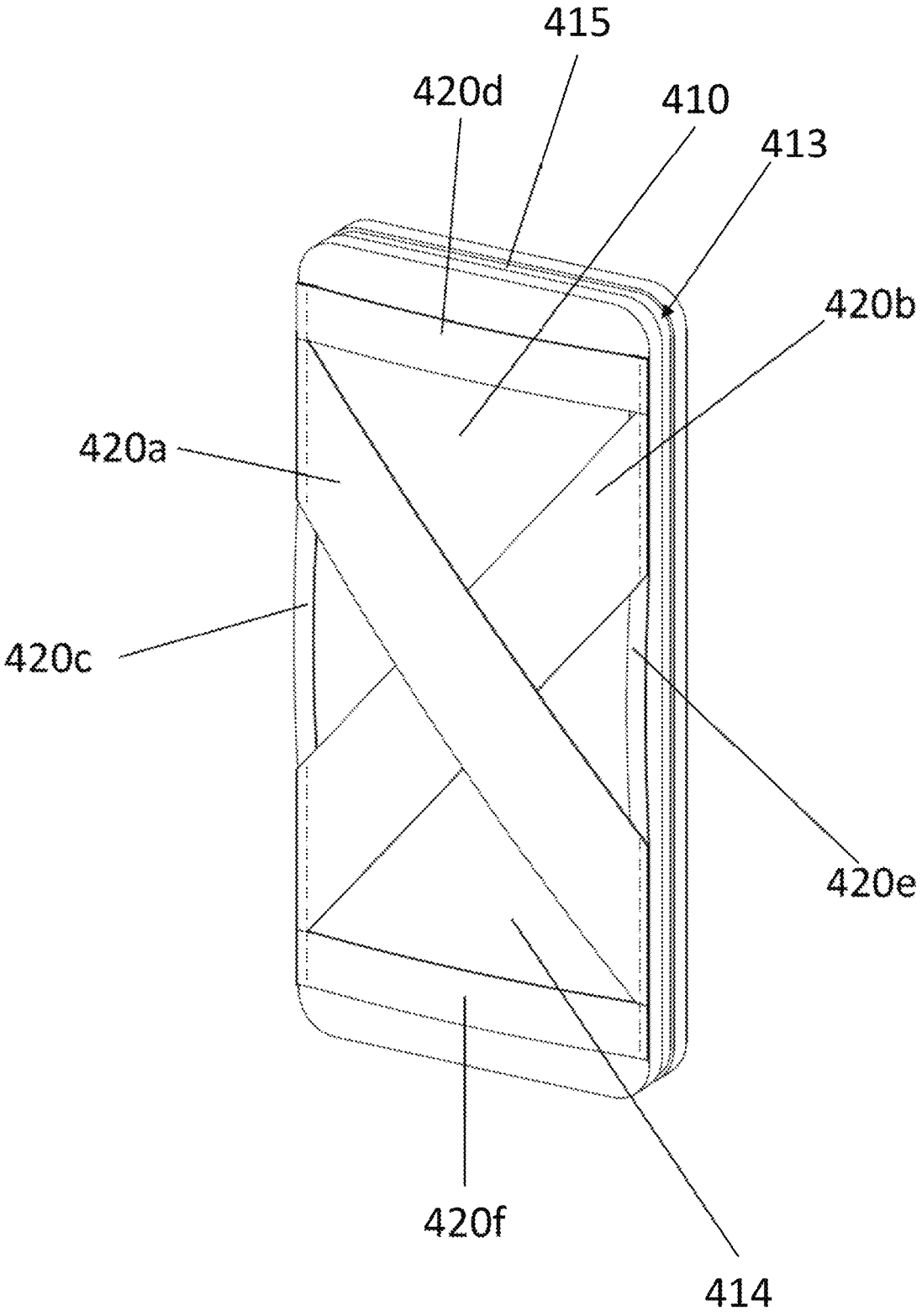
FIGS. 4A-4E show several views of an embodiment of a bag of the disclosure.
Figure 4B:
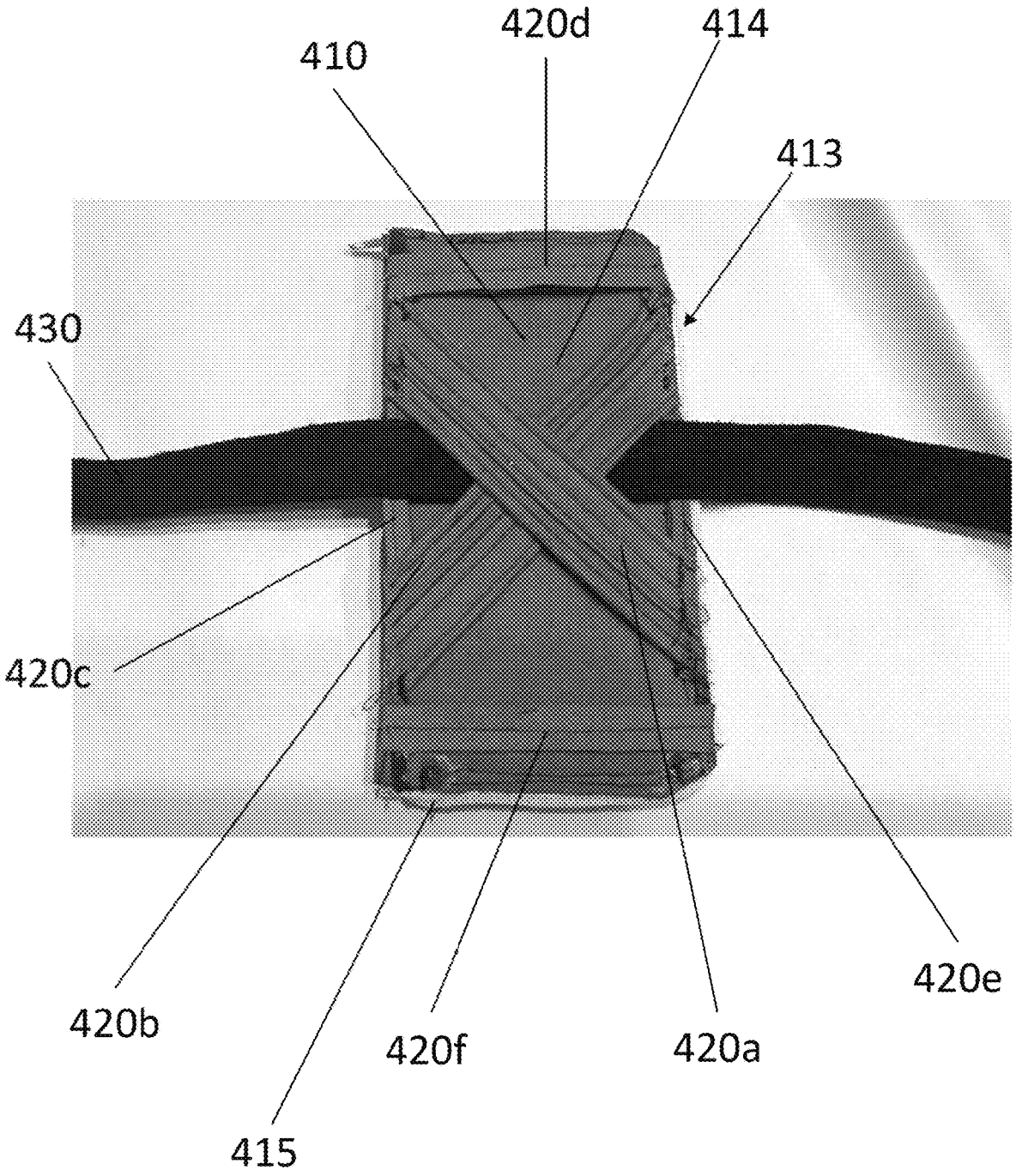
Figure 4C:
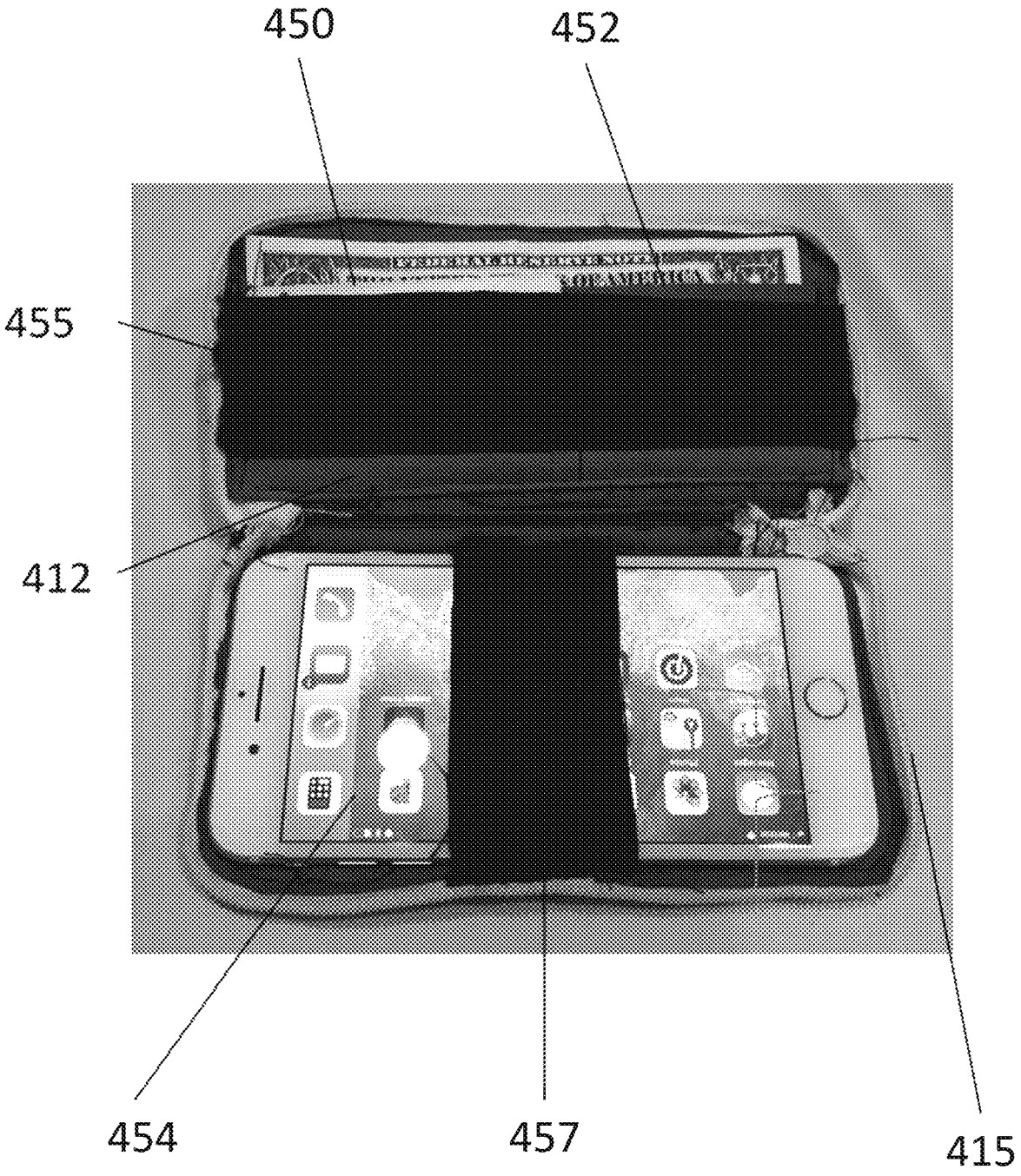

As shown in FIG. 4A and FIG. 4B, bag 410 includes an opening 413 along three of the four sides that is closed by a zipper 415. Thus, when the zipper 415 is opened, the bag can be opened and laid flat, as shown in FIG. 4C. As can be seen, interior 412 of bag 410 may include pocket(s) 455 or strap(s) 457 suitably sized to accommodate cards 450, money 452, a mobile phone 454, a checkbook, and the like. The zipper 415 can be used to close the opening 413 of bag 410.

Figure 4D:
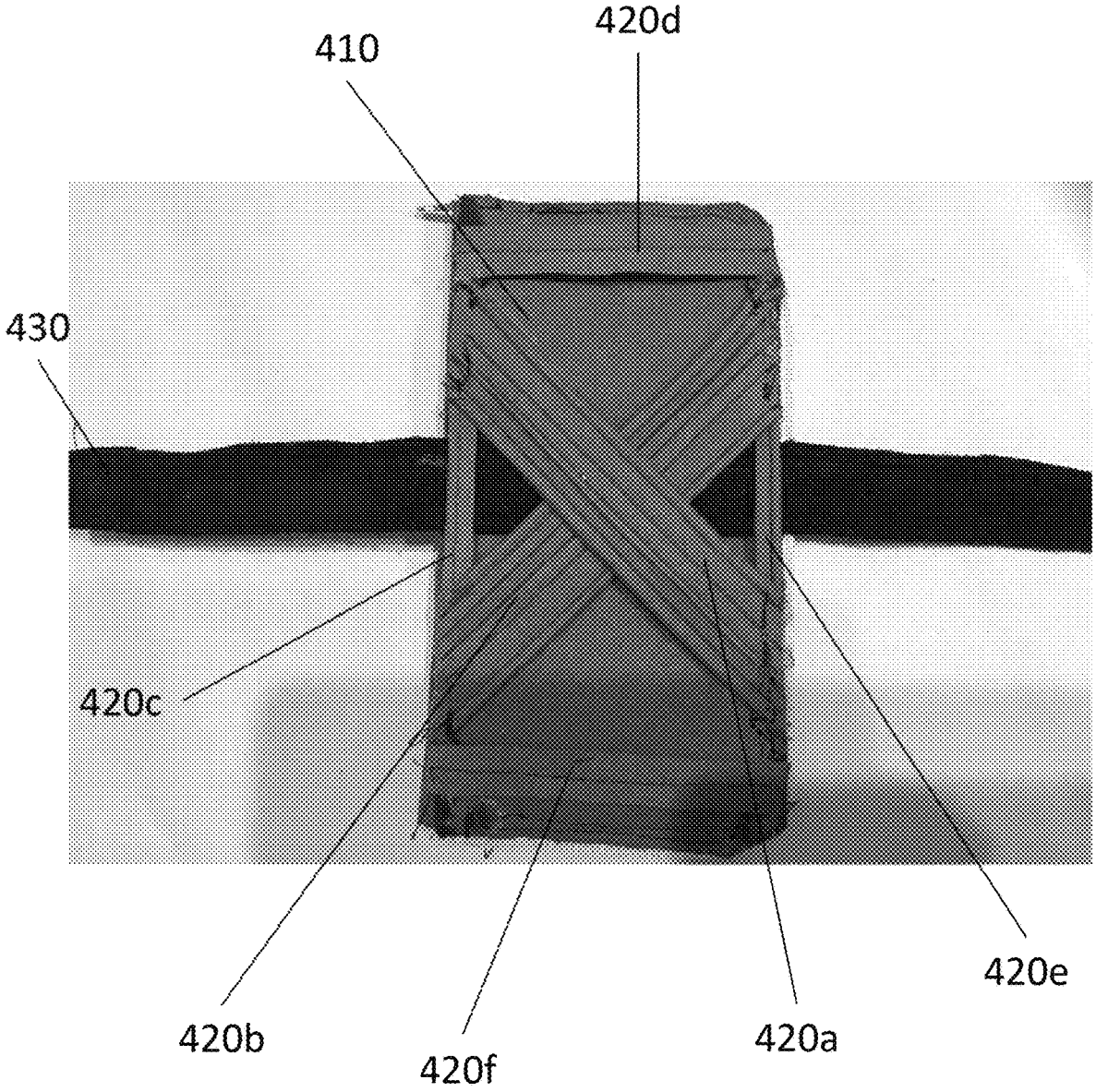
Figure 4E:
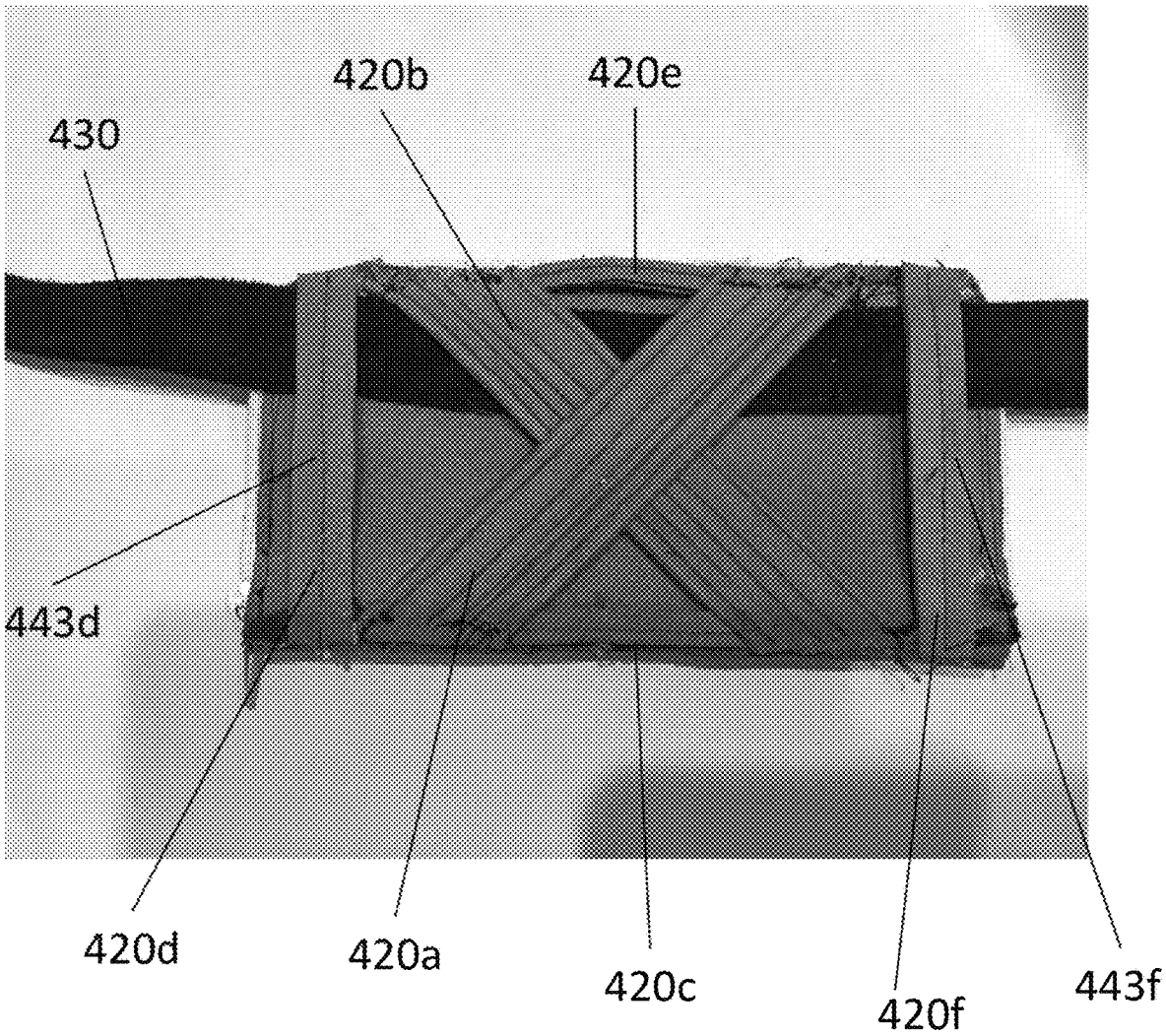

Returning to FIG. 4A, the exterior 414 of bag 410 includes securing elements 420*a*, 420*b* arranged in an "X" pattern on the outside of the bag 410. This embodiment further includes securing elements 420*c*-420*f* arranged around the perimeter of the bag 410. Strap 430 can be arranged under securing elements 420*a*, 420*b*, but over securing straps 420*c*, 420*e*, as shown in FIG. 4B. Strap 430 can be arranged under securing elements 420*a*, 420*b*, but over securing straps 420*d*, 420*f*. Alternatively, strap 430 can be arranged under securing elements 420*a*, 420*b*, 420*c*, 420*e*, as shown in FIG. 4D. Further, strap 430 can be arranged under securing elements 420*a*, 420*b*, 420*d*, 420*f*, as shown in FIG. 4E. Additionally, the mid-points 443*d*, 443*f* of securing elements 420*d*, 420*f*, respectively can be secured (e.g., stitching, adhesive, removable couplings (for example, hook and loop fasteners, buttons, snaps, etc.)) to the surface of the bag.

Figure 5A:
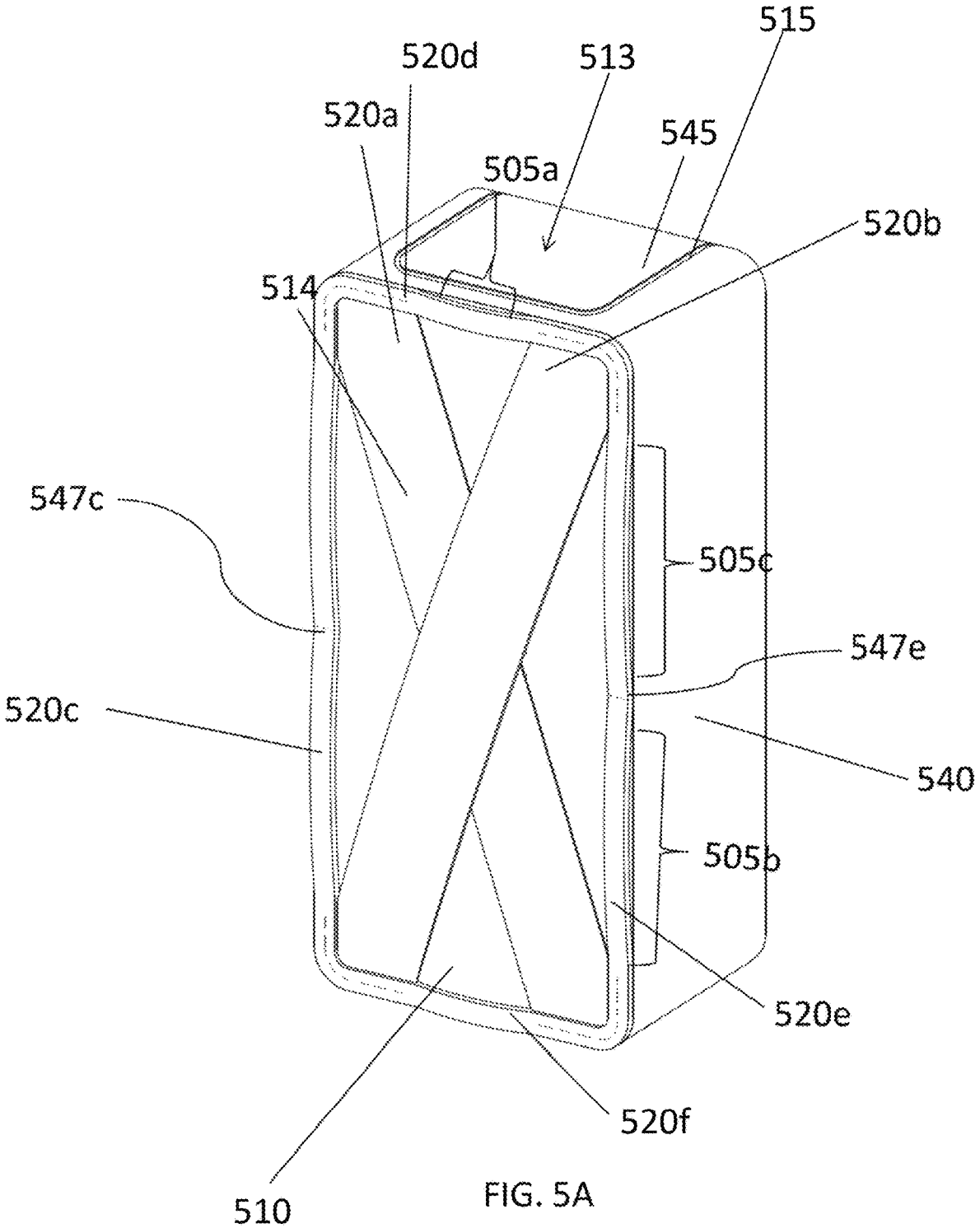
FIGS. 5A-5E show several views of an embodiment of a bag of the disclosure.
Figure 5B:
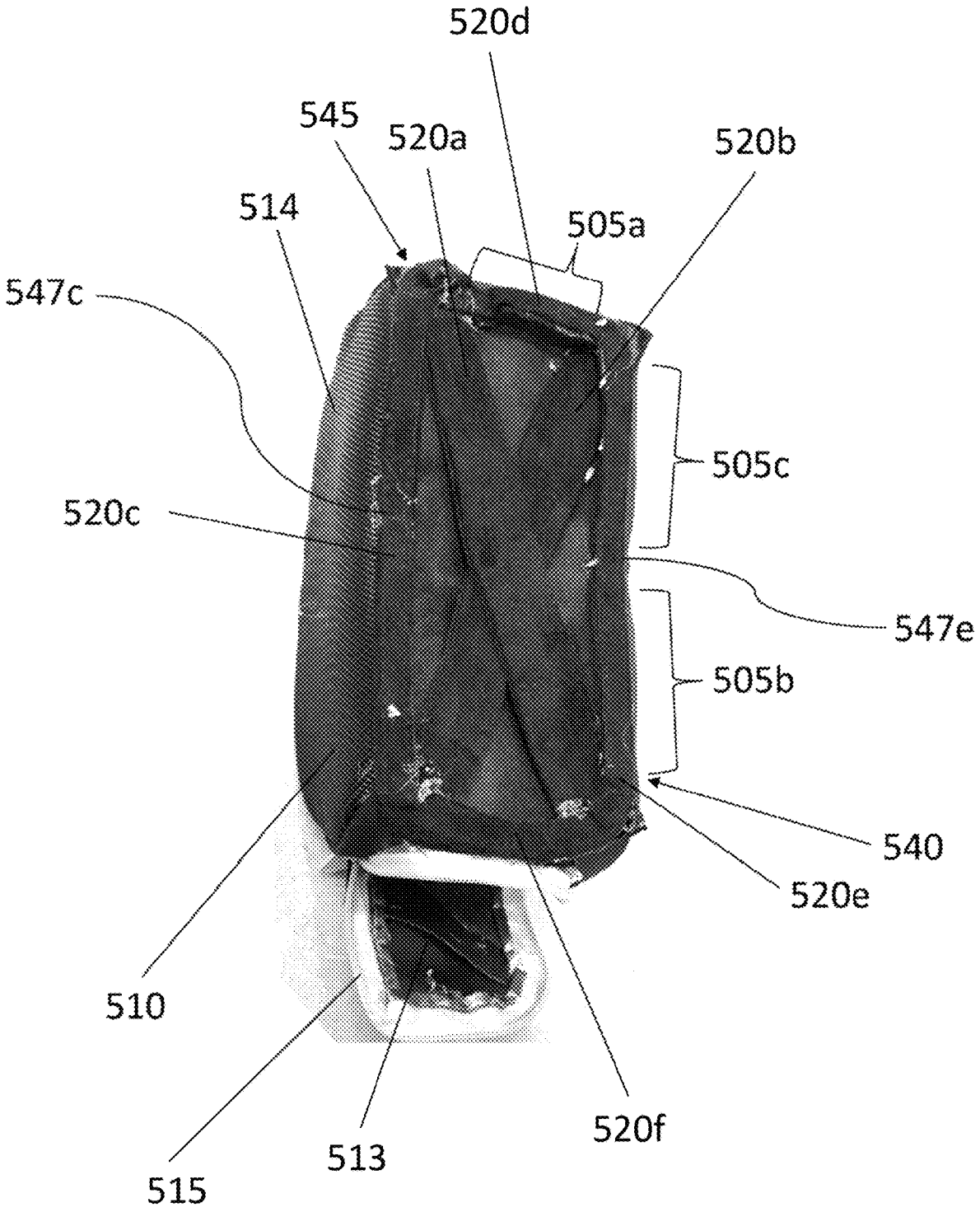

A further embodiment of a bag 510 of the present disclosure is shown in FIG. 5A and FIG. 5B. Bag 510 includes securing elements 520*a*, 520*b* arranged in an "X" pattern on the outside of the bag 510. Bag 510 has side 545, which is about 3 to 4 inches long and side 540, which is about 7 to 8 inches. In a specific example, side 545 is about 3.5 inches and side 540 is about 7.5 inches. The opening 505*a* under securing element 520*d* and between securing elements 520*a*, 520*b* on side 545 ranges from about 2 to about 3 inches. For example, the opening 505*a* is about 2.5 inches.

This embodiment further includes securing elements 520*c*-520*f* arranged around the perimeter of the face of the bag 510. Additionally, mid-points 547*c*, 547*e* of securing elements 520*c*, 520*e*, respectively can be secured (e.g., stitching, adhesive, removable couplings (for example, hook and loop fasteners, buttons, snaps, etc.)) to the surface of the bag. The opening 505*b* between securing element 520*a* and midpoint 547*e* on side 540, the opening 505*c* between securing element 520*b* and midpoint 547*e* on side 540, ranges from about 2 to about 4 inches. For example, openings 505*b*, 505*c* are each about 3 inches.

Figure 5C:
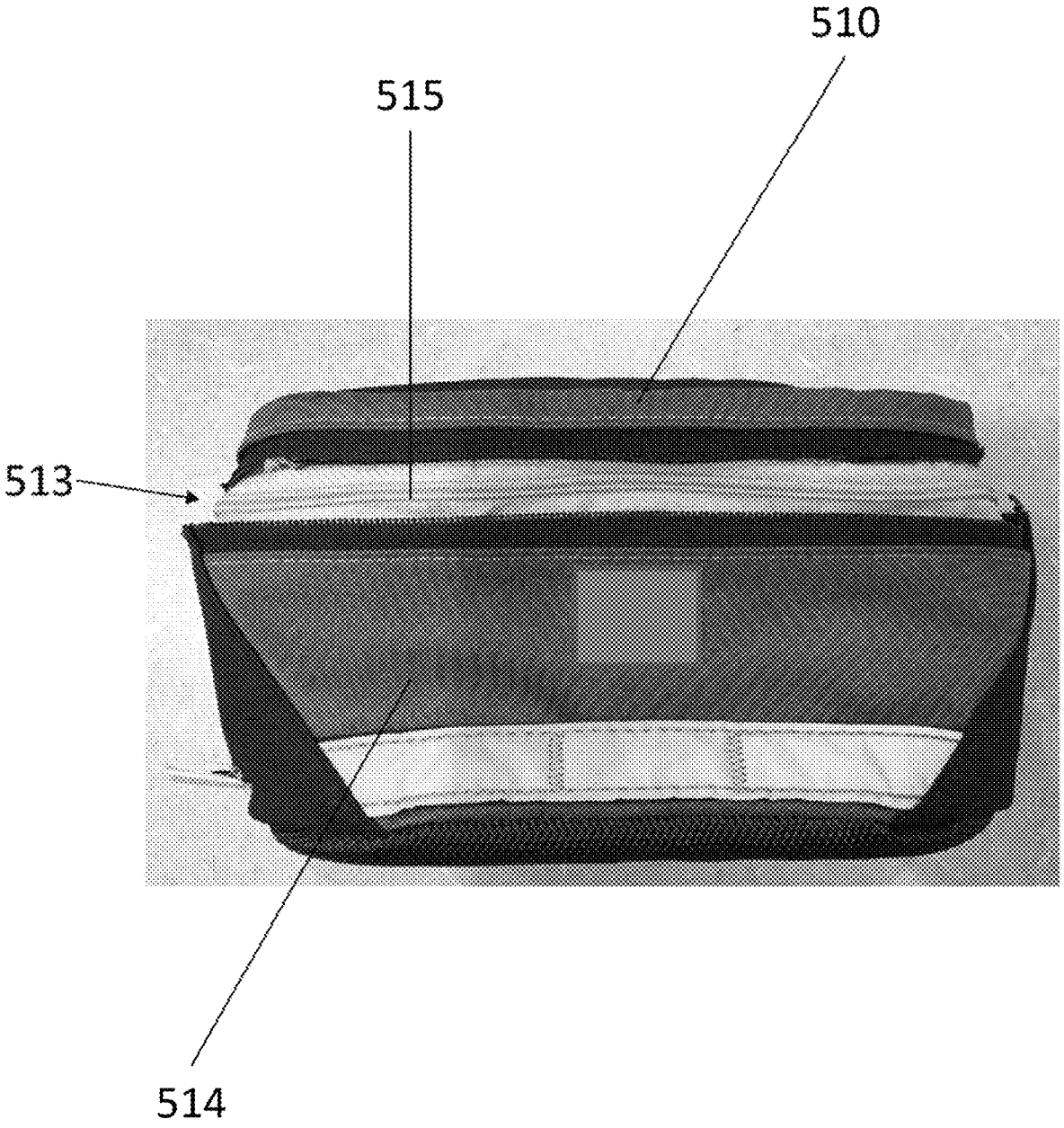
Figure 5D:
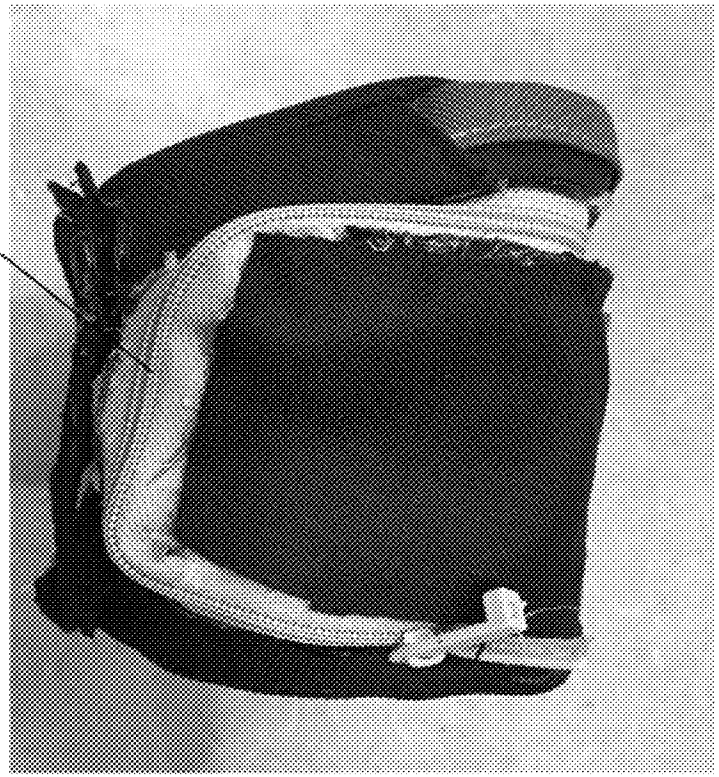
Figure 5E:
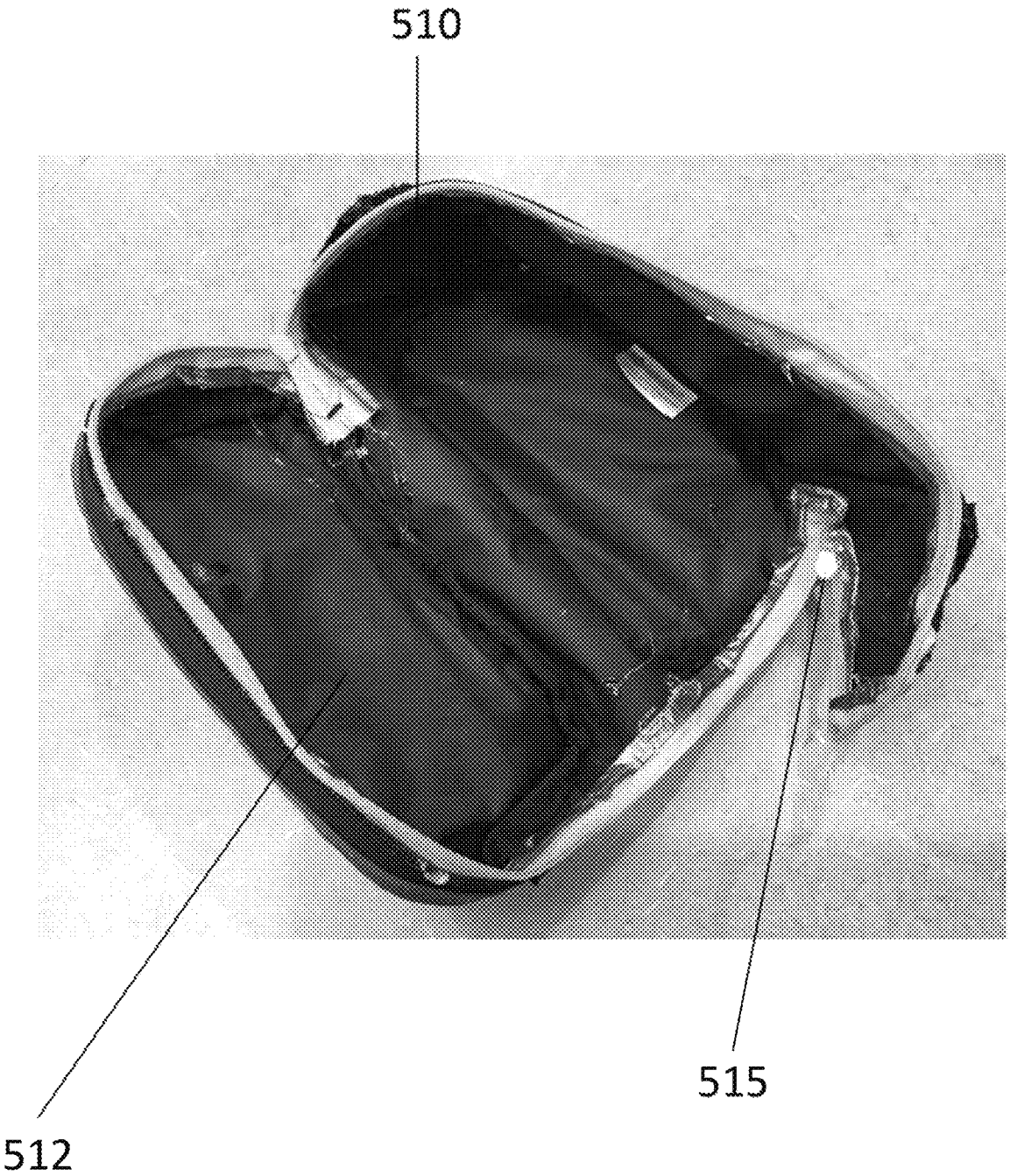

Another view of the exterior 514 of bag 510 is shown in FIG. 5C. The opening 513 is closed by a zipper 515. The zipper 515 further extends around to another face of the bag 510, and forms a U-shape, as shown in FIG. 5D. Thus, when the zipper 515 is partially opened, as is shown in FIG. 5B, a bottle or other beverage container can be removed without having to open the bag 510 completely. FIG. 5E shows the interior 512 of the bag 510 when the zipper 515 is opened almost completely.

Figure 6A:
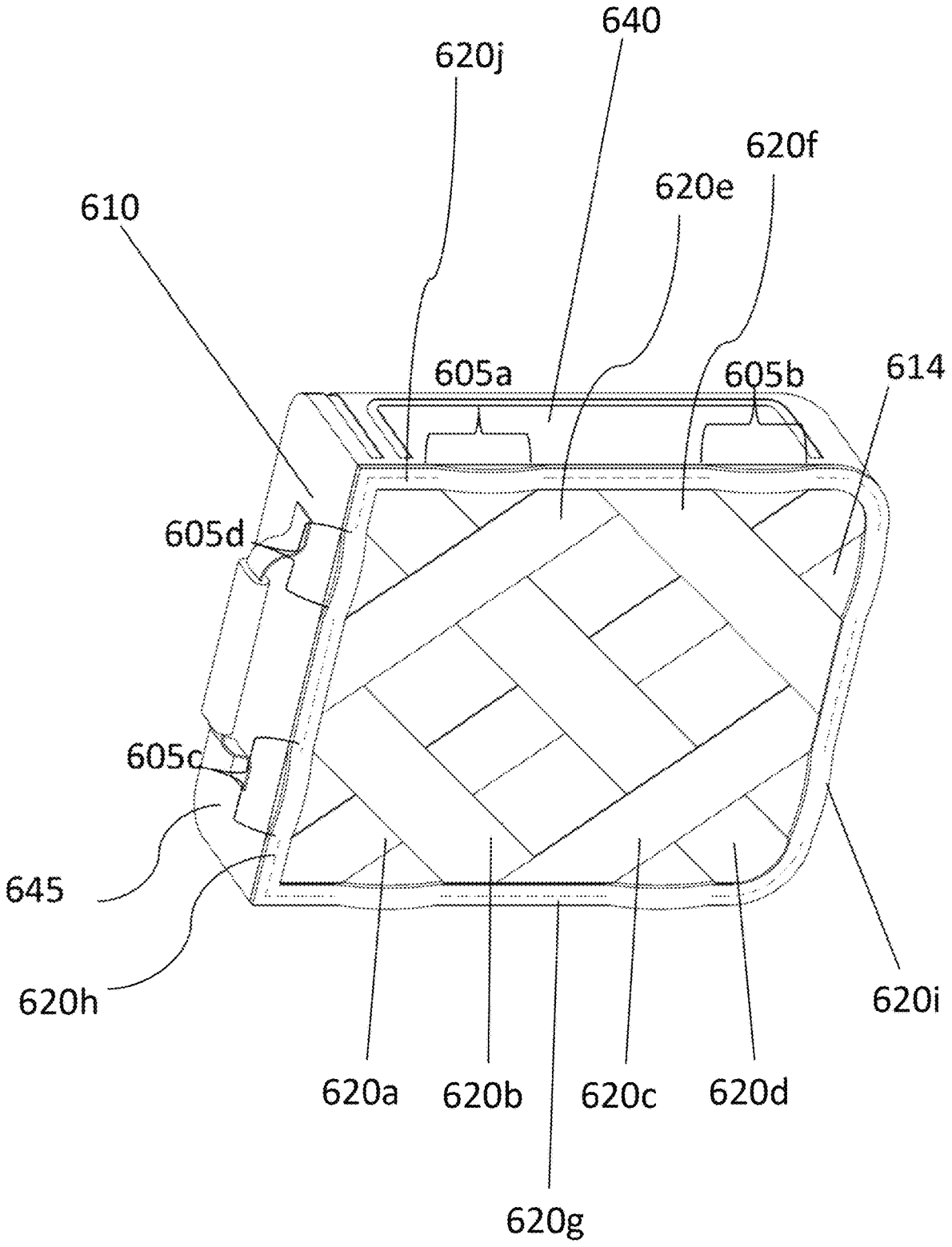
FIGS. 6A-6E show several views of an embodiment of a bag of the disclosure.
Figure 6B:
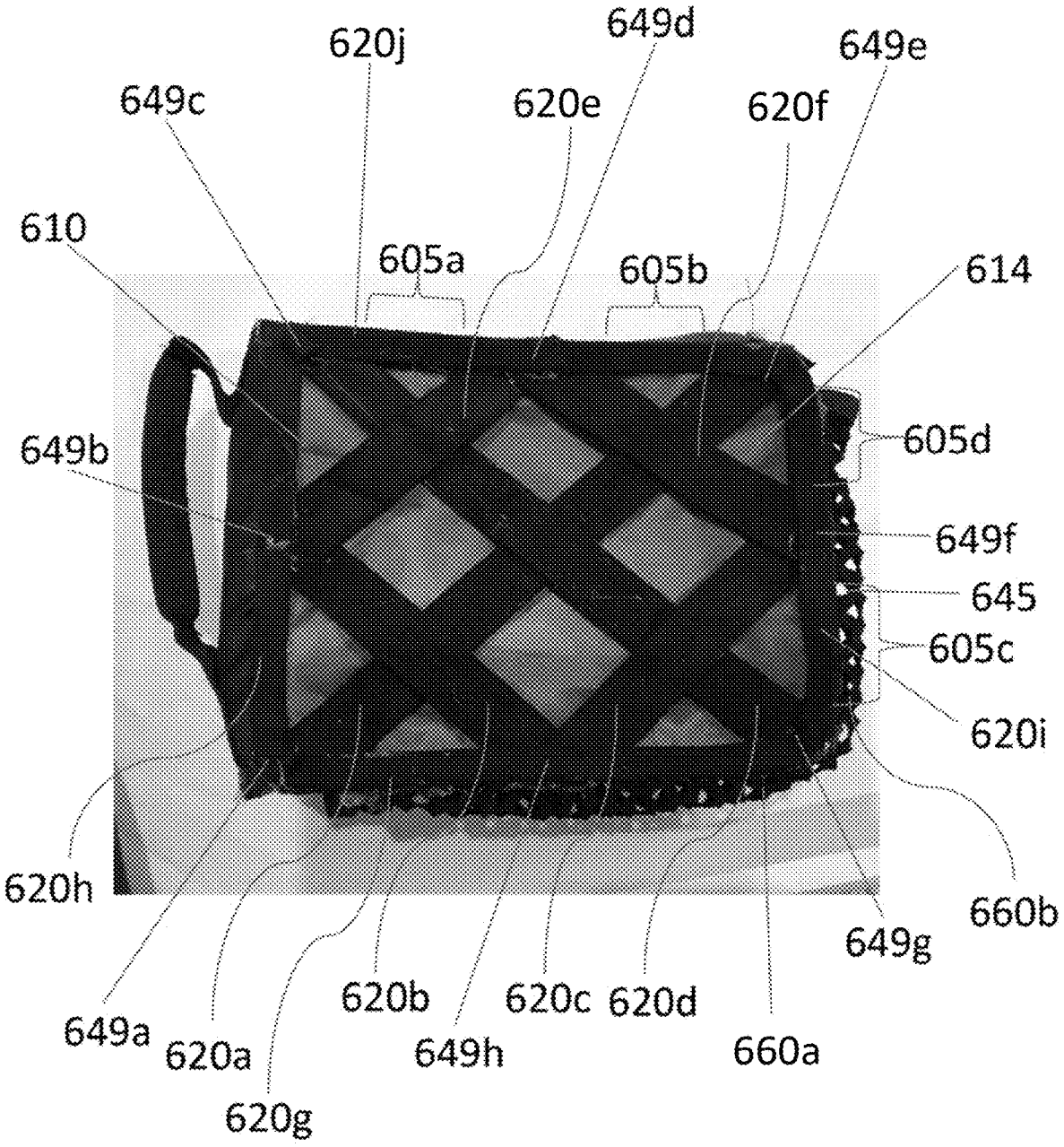

FIG. 6A and FIG. 6B show another embodiment of the present disclosure. Bag 610 is an insulated bag that could be used as a lunch bag or cooler bag. Side 645 is about 6 to 8 inches and side 640 is about 8 to 9 inches. In a specific example, side 645 is about 7 inches and side 640 is about 8.5 inches.

Bag 610 includes securing elements 620*a*-620*f* arranged in a lattice (i.e., crisscrossed) pattern on the exterior 614 of the bag 610. Bag 610 further includes securing elements 620*g*-620*j* arranged around the perimeter of the face of the bag 610. Additionally, points 649*a*-649*h* where securing elements 620*a*-620*f* intersect with securing elements 620*g*-620*j* are secured (e.g., stitching, adhesive, removable couplings (for example, hook and loop fasteners, buttons, snaps, etc.)) to the surface of the bag. The openings 605*a*, 605*b* between securing elements 620*d*, 620*e* and securing elements 620*a*, 620*f* on side 640 each ranges from about 2 to about 3 inches. For example, the openings 605*a*, 605*b* are each about 2.75 inches. The openings 605*c*, 605*d* between securing elements 620*d*, 620*c* and securing elements 620*a*, 620*f* on side 645 each ranges from about 2 to about 3 inches. For example, the openings 605*c*, 605*d* are each about 2 inches.

Thus, a strap can be arranged under any subset of securing elements 620*a*-620*j*. In some embodiments, a strap can be arranged under the securing elements in a direction that is substantially parallel to securing element 620*h*. In some embodiments, a strap can be arranged under the securing elements in a direction that is substantially parallel to securing element 620*g*. In other embodiments, a strap can be arranged in a direction transverse to securing elements 620*h* and 620*g*.

Figure 6C:
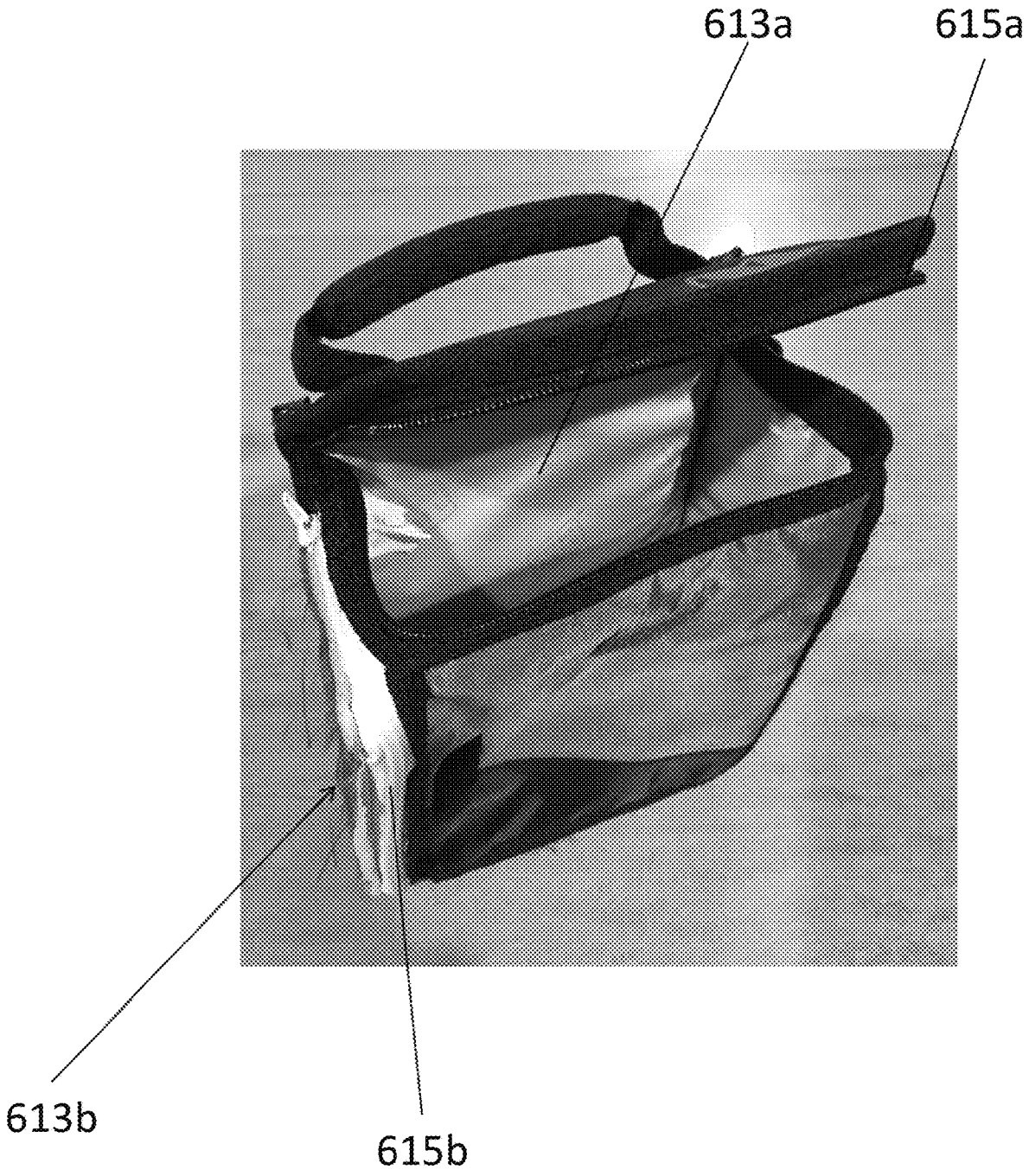
Figure 6D:
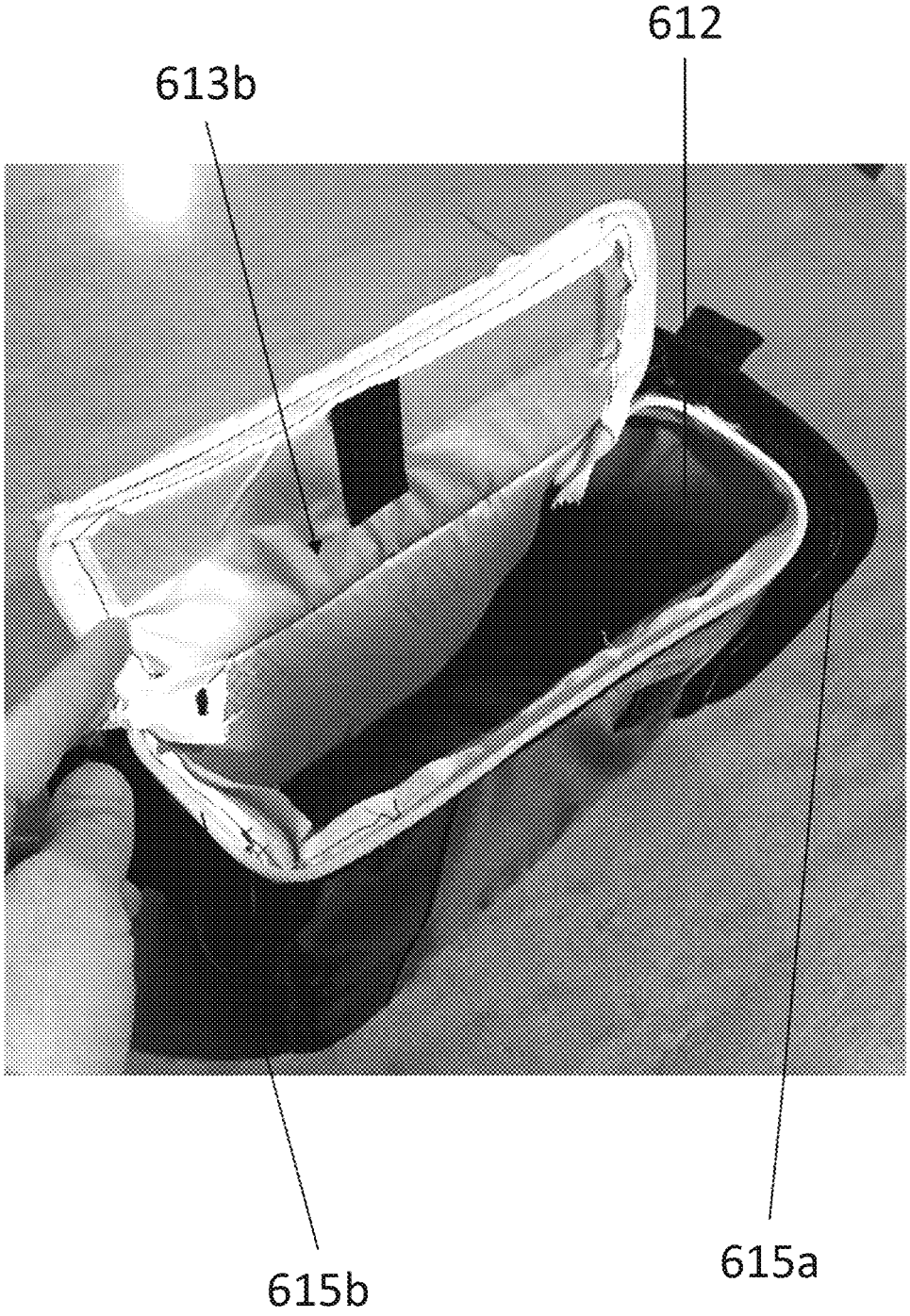

Bag 610 includes a first opening 613*a* and a second opening 613*b*, as shown in FIG. 6C. First opening 613*a* is closed by a zipper 615*a*, and second opening 613*b* is closed by zipper 615*b*. FIG. 6C shows the first opening 613*a* with zipper 615*a* open, and FIG. 6D shows the second opening 613*b* with zipper 615*b* open. A pocket may be positioned in the interior 612 in which a cold pack may be arranged.

Figure 6E:
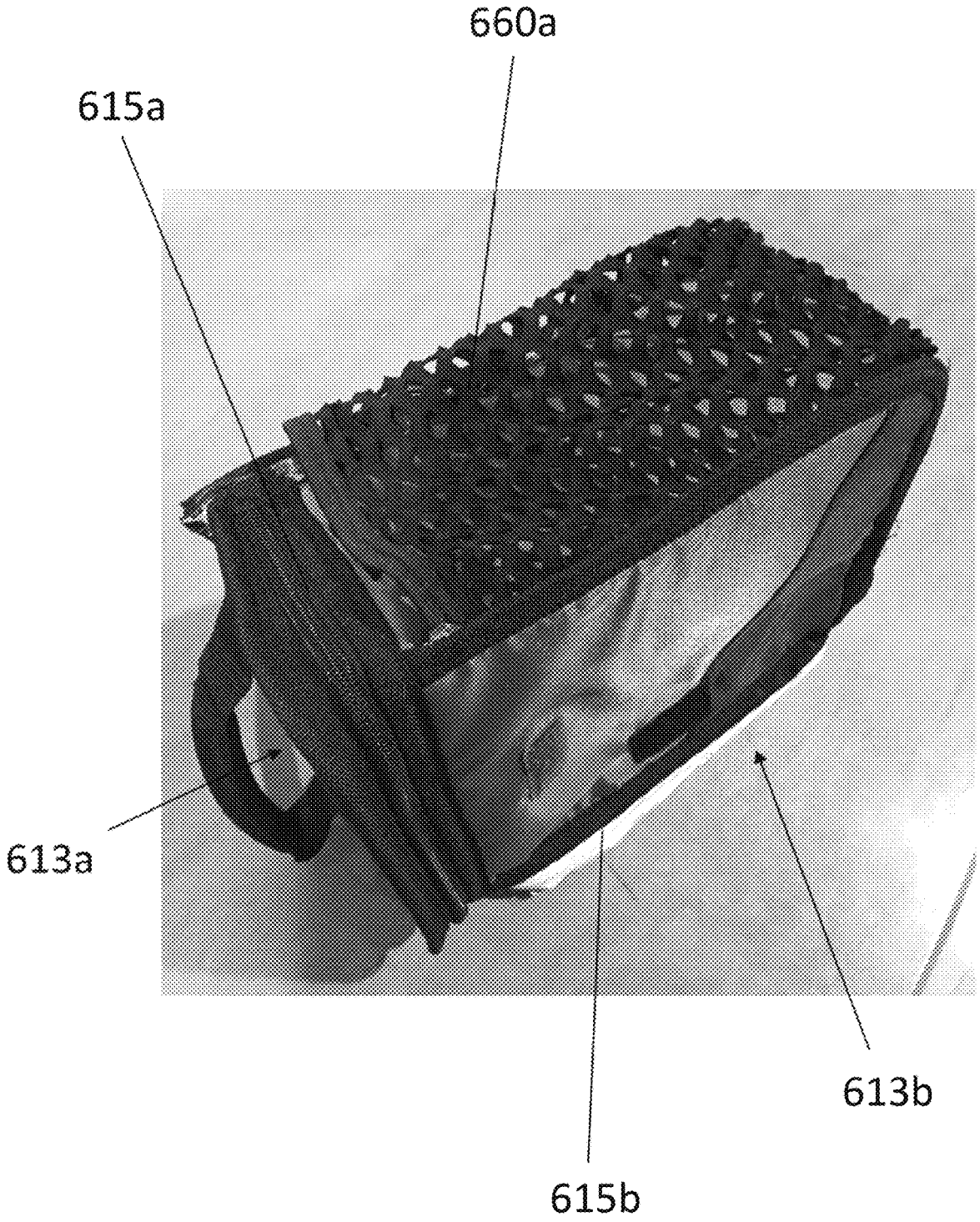

Returning to FIG. 6B, exterior pockets 660*a*, 660*b* are arranged on opposite sides of bag 610 from the first and second openings 613*a*, 613*b*, and are sized to accommodate a beverage container (e.g., a water bottle). Exterior pocket 660*a* is shown in FIG. 6E.

Figure 7A:
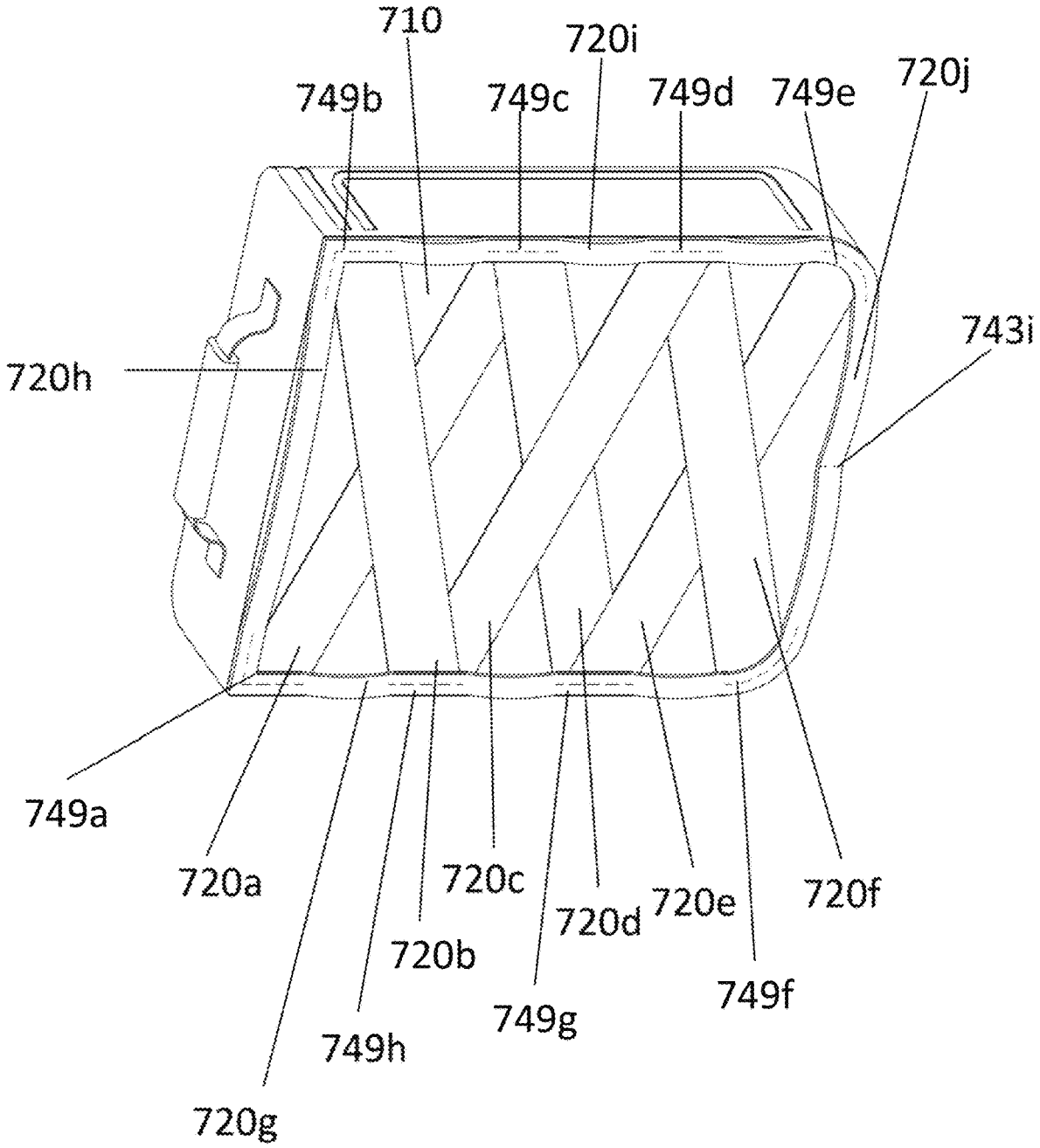
FIGS. 7A-7C show several views of an embodiment of a bag of the disclosure.
Figure 7B:
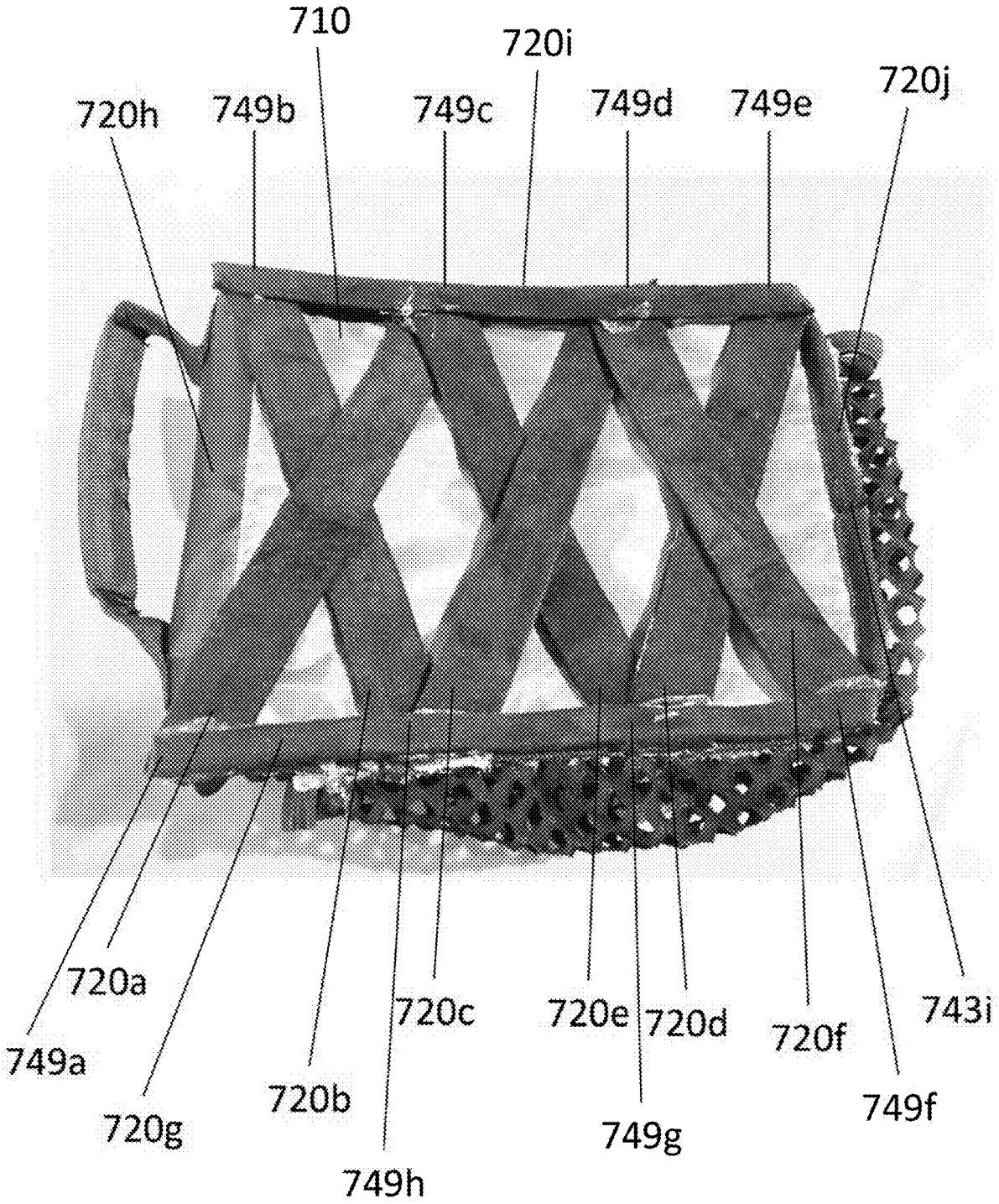
Figure 7C:
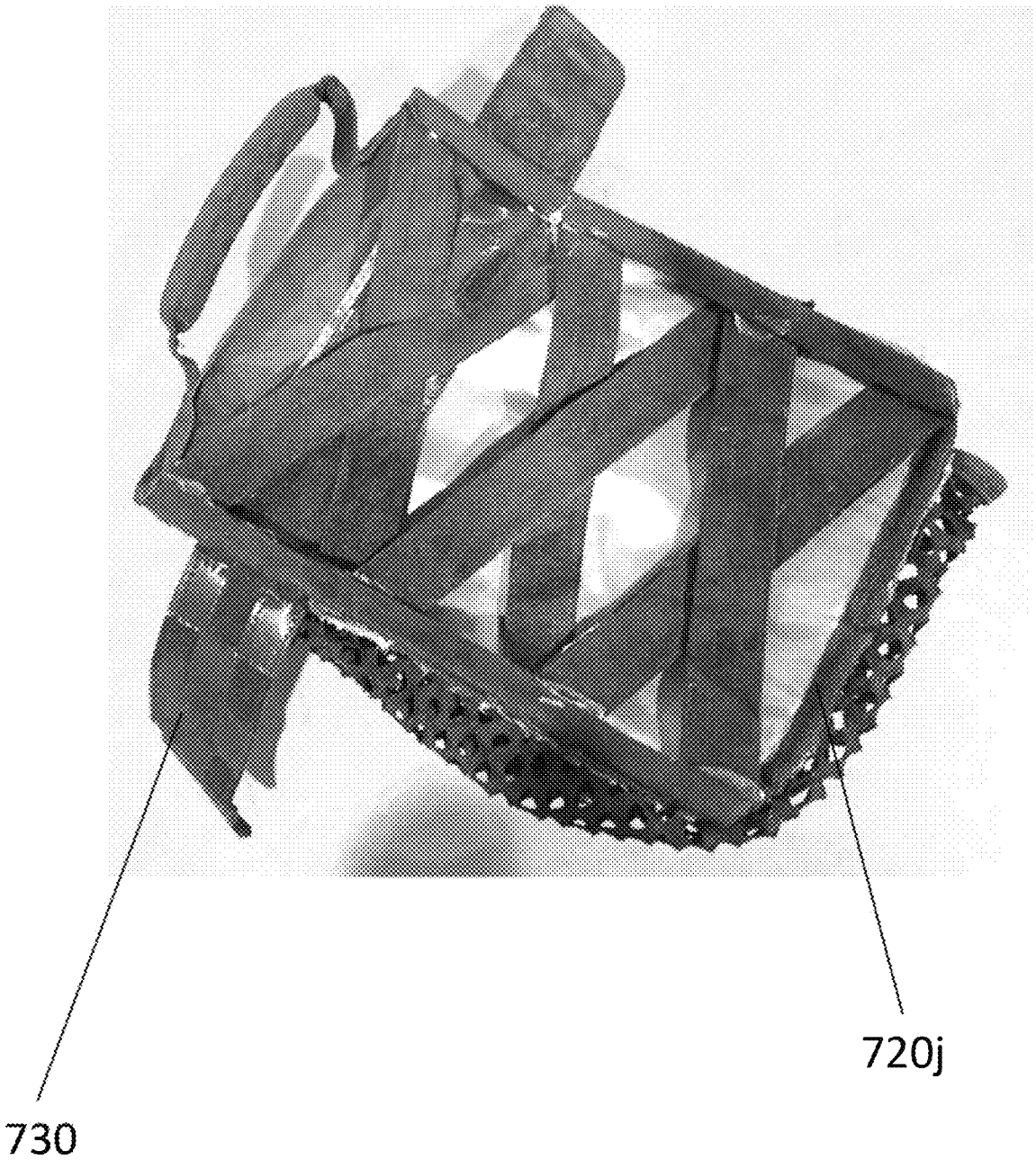

FIG. 7A and FIG. 7B show an alternate arrangement of securing elements 720*a*-720*j* for use on a bag such as bag 610 shown in FIG. 6A-6E and described above. Bag 710 includes securing elements 720*a*-720*f* arranged in three "X" shapes on the outside of the bag 710. Bag 710 further includes securing elements 720*g*-720*i* arranged around the perimeter of the face of the bag 710. Additionally, points 749*a*-749*h* where securing elements 720*a*-720*f* intersect with securing elements 720*g*-720*i* are secured (e.g., stitching, adhesive, removable couplings (for example, hook and loop fasteners, buttons, snaps, etc.)) to the surface of the bag. Additionally, mid-point 743*i* of securing element 720*i*, respectively can be secured (e.g., stitching, adhesive, removable couplings (for example, hook and loop fasteners, buttons, snaps, etc.)) to the surface of the bag. Thus, a strap can be arranged under any subset of securing elements 720*a*-720*j*. In some embodiments, a strap 730 can be arranged under the securing elements in a direction that is substantially parallel to securing element 720*j*, as shown in FIG. 7C. In some embodiments, a strap can be arranged under the securing elements in a direction that is substantially parallel to securing element 720*g*. In other embodiments, a strap can be arranged in a direction transverse to securing elements 720*g* and 720*j*.

Figure 8A:
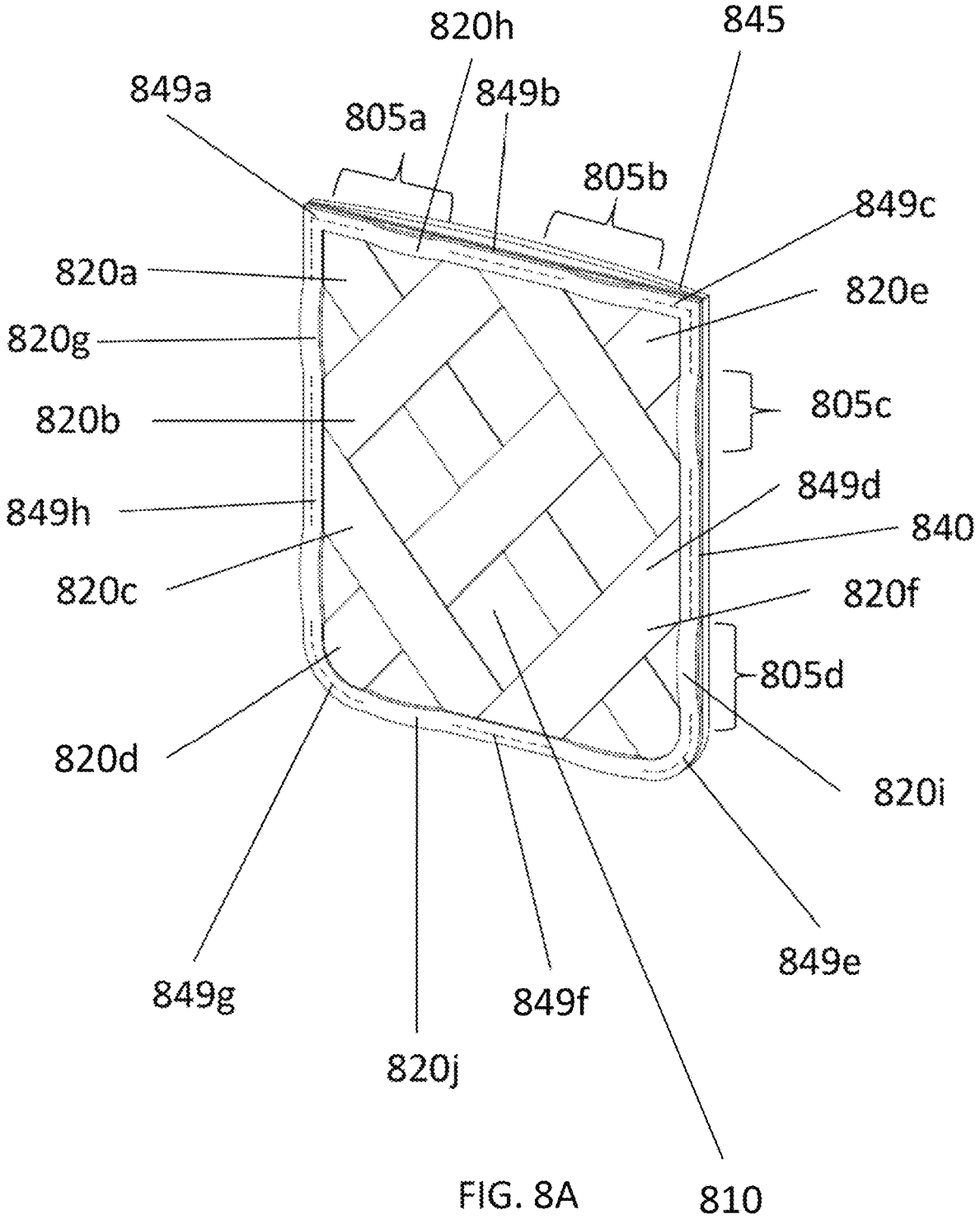
FIGS. 8A-8D show several views of an embodiment of a bag of the disclosure.
Figure 8B:
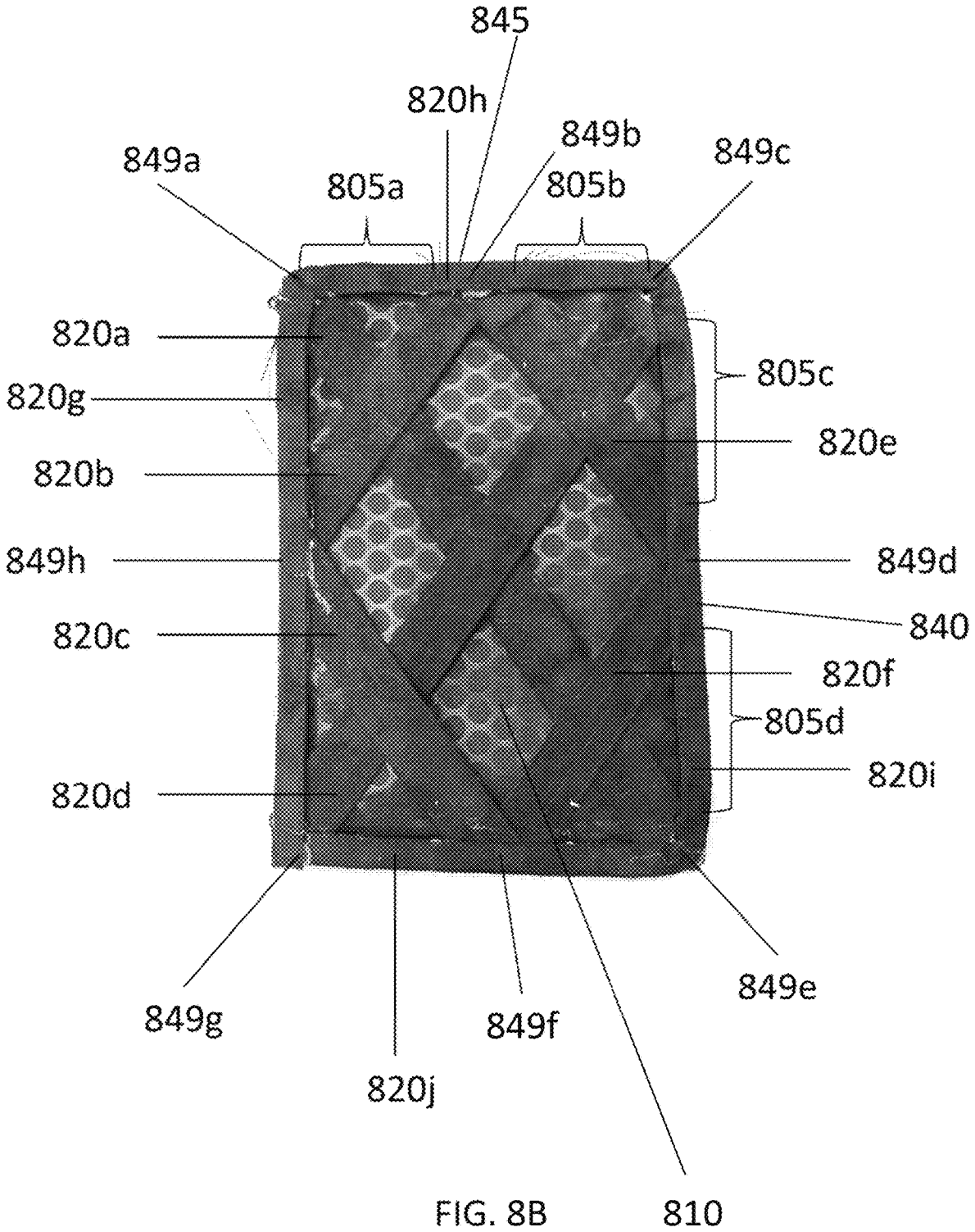

FIG. 8A and FIG. 8B show the exterior 814 of another embodiment of the present disclosure. Bag 810 has several pockets that are sized to accommodate electronic devices. In some embodiments, one or more of the pockets are padded to protect electronic devices stored therein. Side 845 is about 6 to 8 inches and side 840 is about 9 to 10 inches. In a specific example, side 845 is about 6.75 inches and side 840 is about 9.75 inches.

Bag 810 includes securing elements 820*a*-820*f* arranged in a lattice (i.e., crisscrossed) pattern on the outside of the bag 810. Bag 810 further includes securing elements 820*g*-820*j* arranged around the perimeter of the face of the bag 810. Additionally, points 849*a*-849*h* where securing elements 820*a*-820*f* intersect with securing elements 820*g*-820*j* are secured (e.g., stitching, adhesive, removable couplings (for example, hook and loop fasteners, buttons, snaps, etc.)) to the surface of the bag. The openings 805*a*, 805*b* on side 845 each range from about 1 to about 3 inches. For example, the openings 805*a*, 805*b* are each about 2 inches. The openings 805*c*, 805*d* on side 840 each range from about 2 to about 4 inches. For example, the openings 805*c*, 805*d* are each about 3 inches Thus, a strap can be arranged under any subset of securing elements 820*a*-820*j*. In some embodiments, a strap can be arranged under the securing elements in a direction that is substantially parallel to securing element 820*h*. In some embodiments, a strap can be arranged under the securing elements in a direction that is substantially parallel to securing element 820*g*. In other embodiments, a strap can be arranged in a direction transverse to securing elements 820*h* and 820*g*.

Figure 8C:
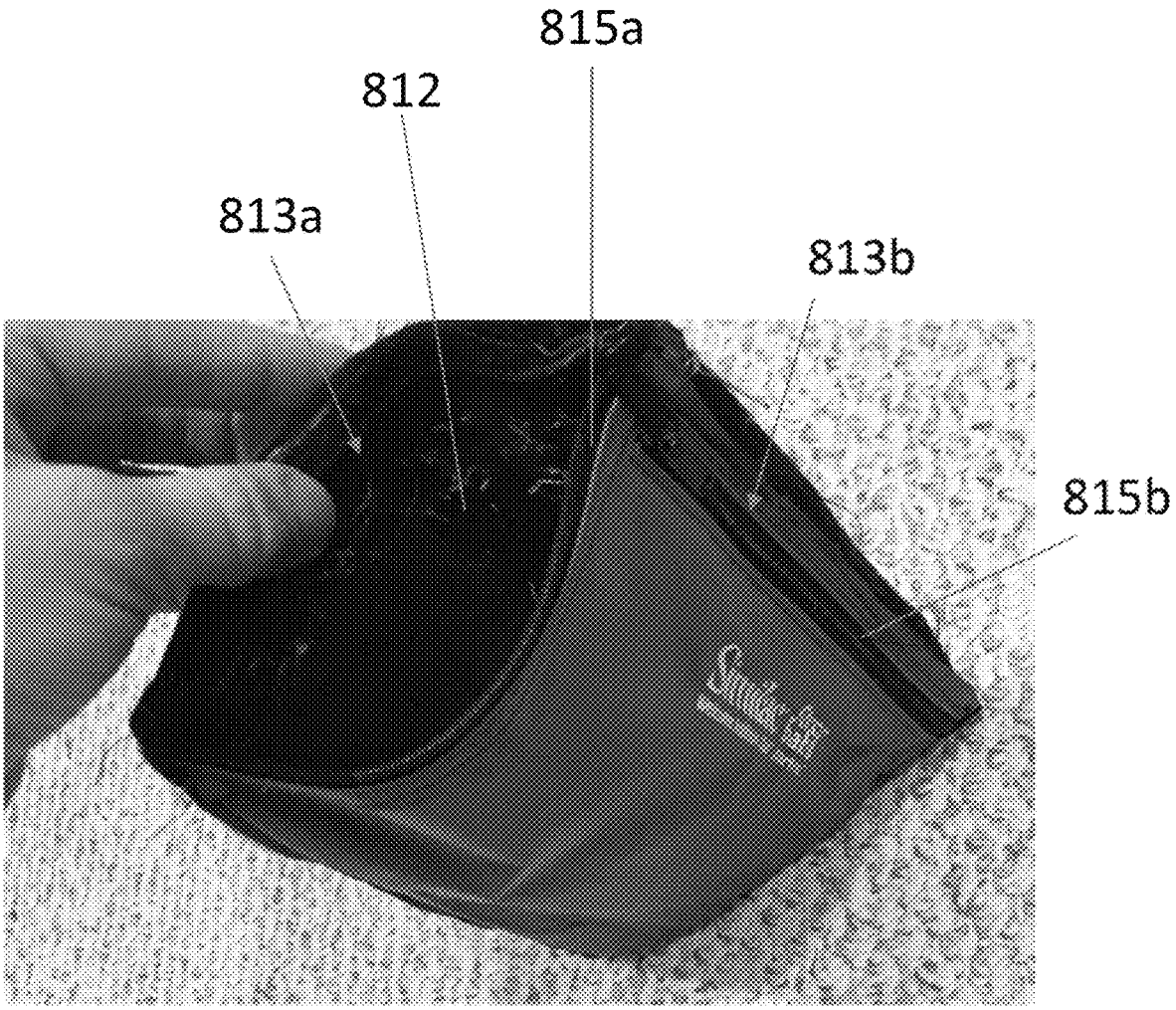
Figure 8D:
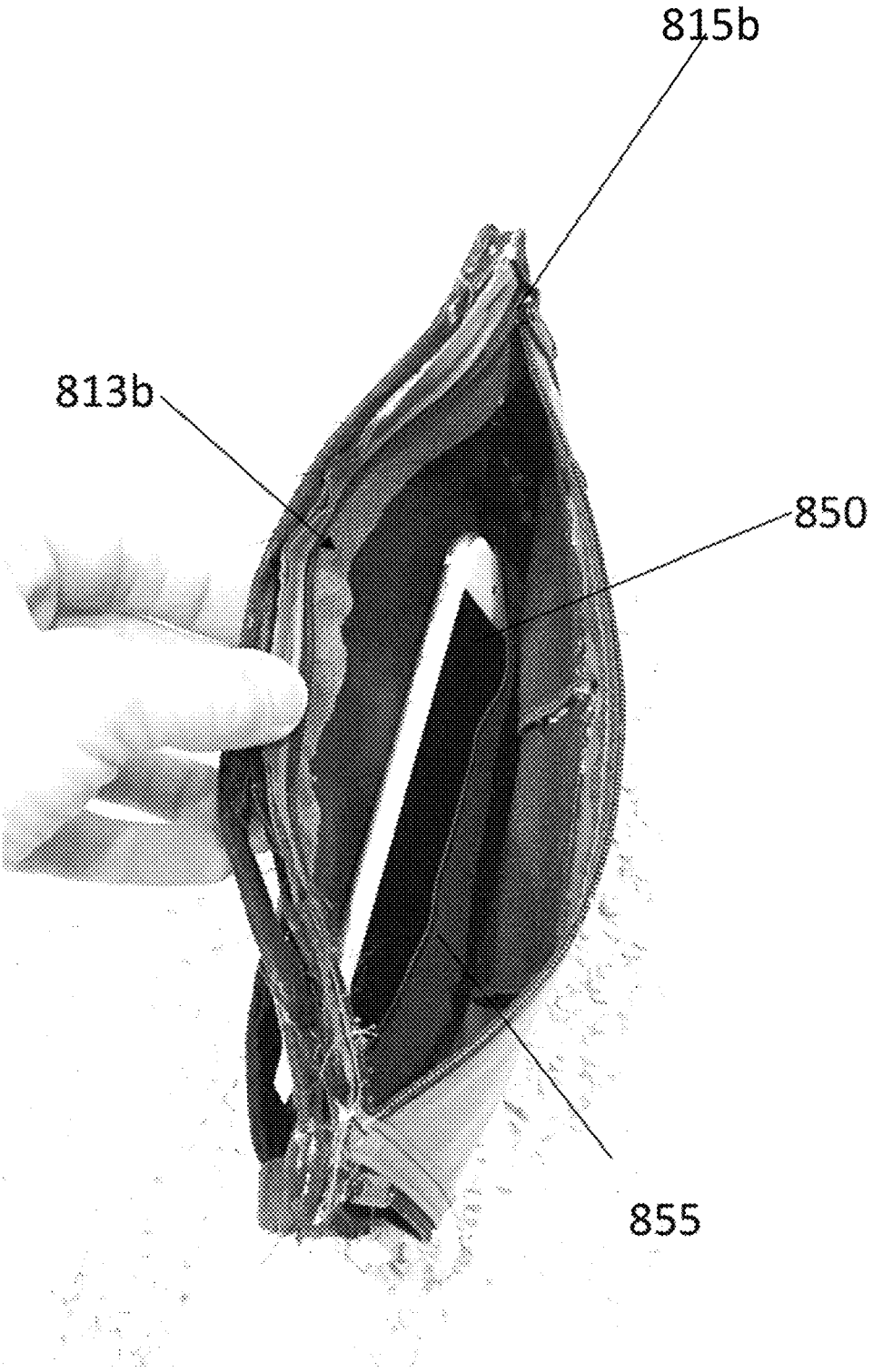

Bag 810 includes a first opening 813*a* and a second opening 813*b*, as shown in FIG. 8C. First opening 813*a* is closed by a zipper 815*a*, and second opening 813*b* is closed by zipper 815*b*. FIG. 8C shows the first opening 813*a* with zipper 815*a* open, and FIG. 8D shows the second opening 813*b* with zipper 815*b* open. The interior 812 of bag 810 includes pocket(s) 855 or strap(s) suitably sized to accommodate a mobile phone 850, a tablet, and the like.

In some embodiments, a bag (e.g., bag 810) of the disclosure further includes an expansion zipper. In such embodiments, the expansion zipper can be unzipped to expose additional fabric that effectively increases the width of the side of the bag. As is understood, an expansion zipper can be arranged on opposing sides of a bag, around a side of a bag, or any other suitable arrangement.

Figure 9A:
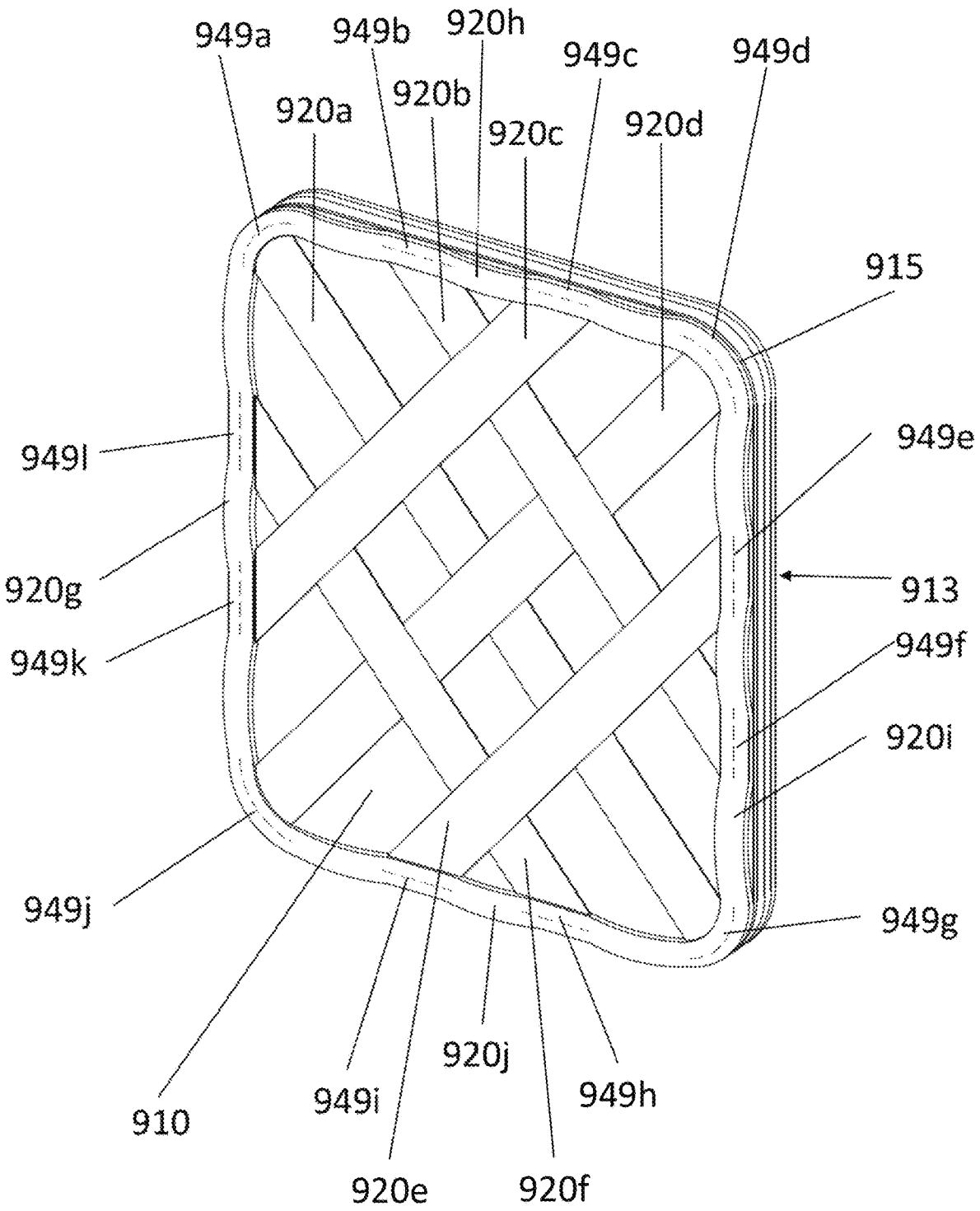
FIGS. 9A-9D show several views of an embodiment of a bag of the disclosure.
Figure 9B:
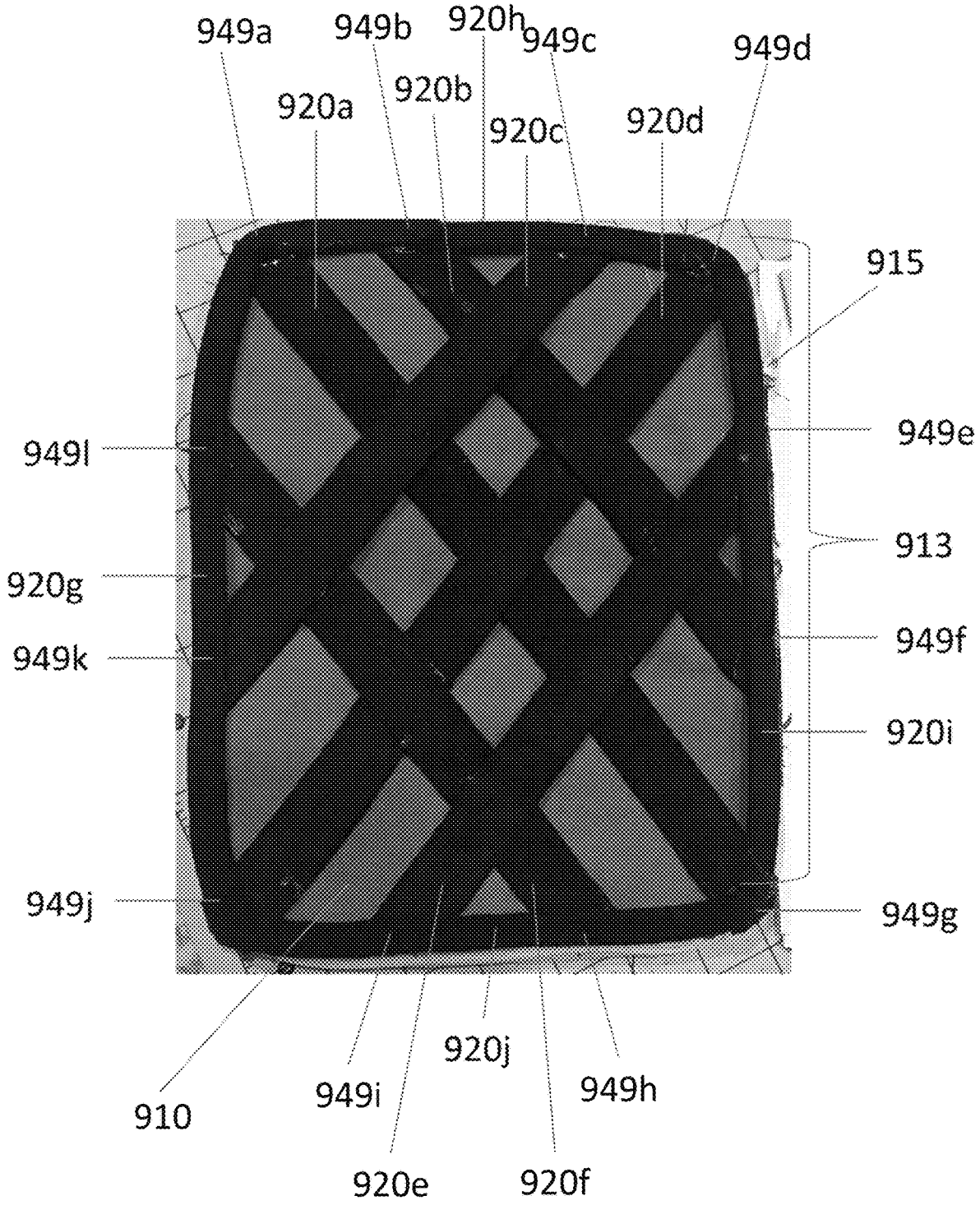

An alternate embodiment of a bag 910 designed to house and protect electronic devices is shown in FIG. 9A and FIG. 9B. Bag 910 has padded outer walls to protect electronic devices housed inside the bag. Bag 910 includes securing elements 920*a*-920*f* arranged in a lattice (i.e., crisscrossed) pattern on the outside of the bag 910. Bag 910 further includes securing elements 920*g*-920*j* arranged around the perimeter of the face of the bag 910. Additionally, points 949*a*-949*l* where securing elements 920*a*-920*f* intersect with securing elements 920*g*-920*j* are secured (e.g., stitching, adhesive, removable couplings (for example, hook and loop fasteners, buttons, snaps, etc.)) to the surface of the bag.

Figure 9C:
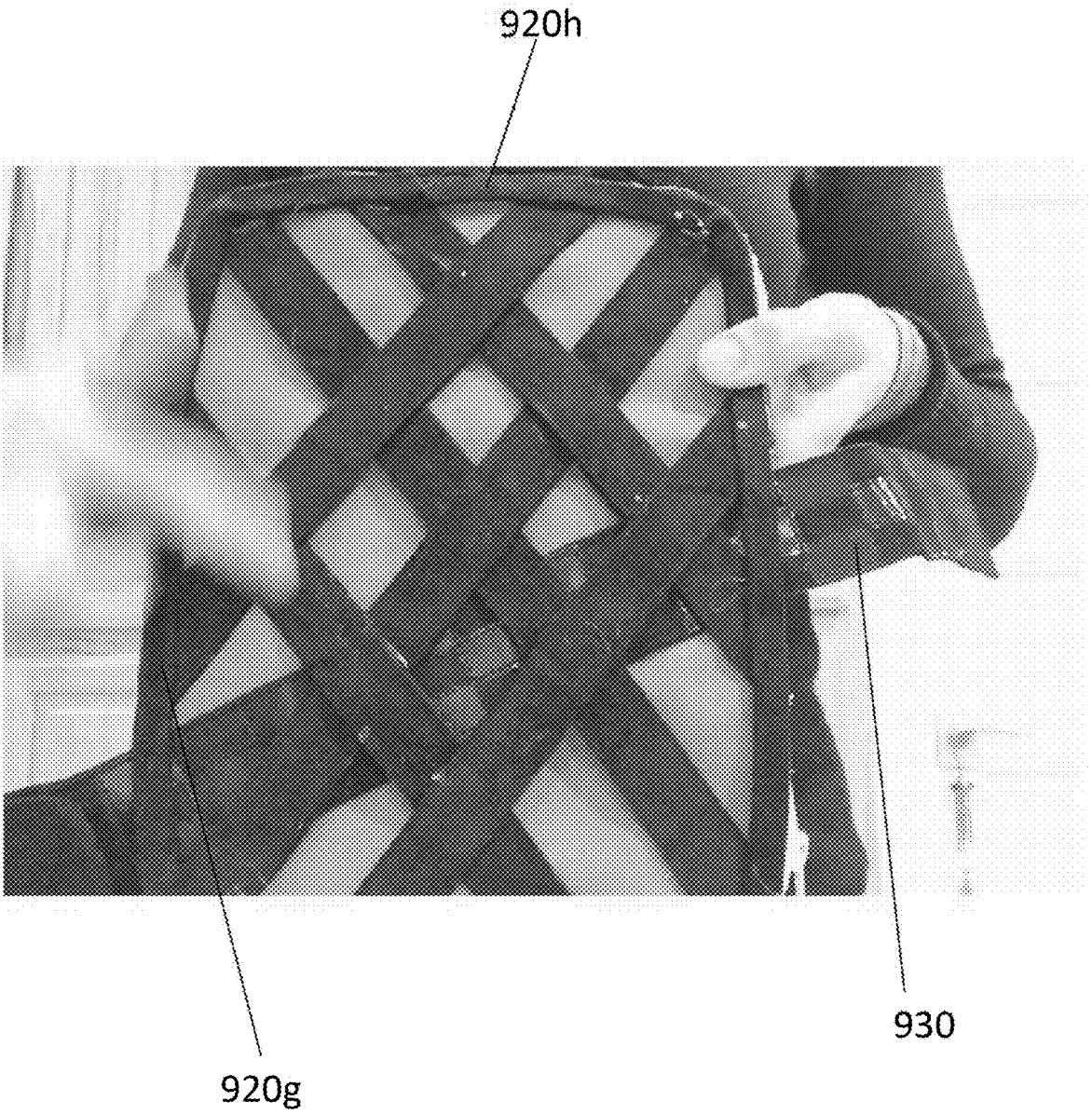

Thus, a strap can be arranged under any subset of securing elements 920*a*-920*j*. In some embodiments, a strap can be arranged under the securing elements in a direction that is substantially parallel to securing element 920*h*. In some embodiments, a strap can be arranged under the securing elements in a direction that is substantially parallel to securing element 920*g*. In other embodiments, a strap can be arranged in a direction transverse to securing elements 920*h* and 920*g*, as shown in FIG. 9C.

Figure 9D:
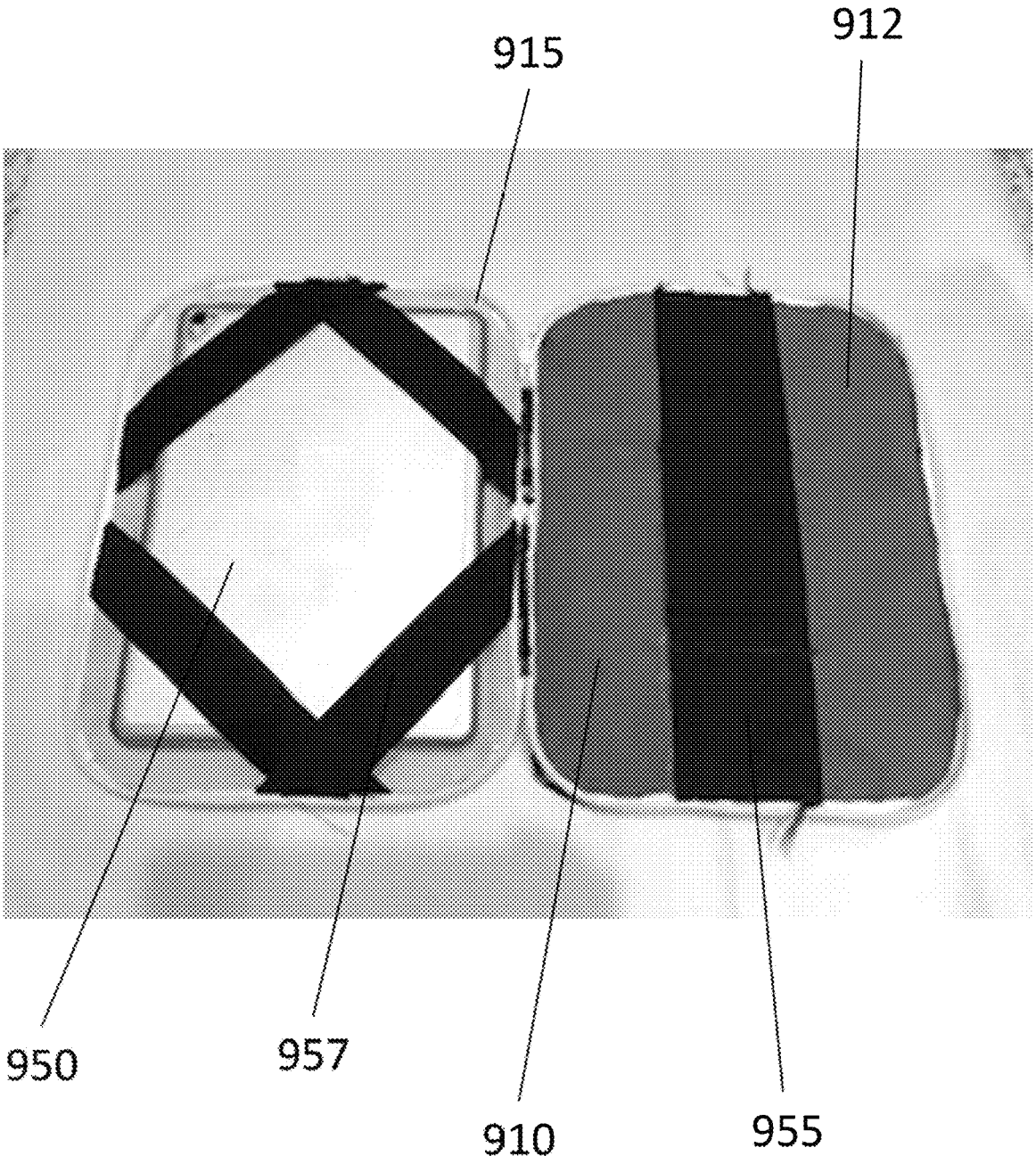

As shown in FIG. 9A, bag 910 includes an opening 913 along three of the four sides that is closed by a zipper 915. Thus, when the zipper 915 is opened, the bag can be laid flat, as shown in FIG. 9D. As can be seen, the interior 912 of bag 910 may include pocket(s) 955 or strap(s) 957 suitably sized to accommodate cards, a mobile phone, a tablet 950, a laptop, and the like. The zipper 915 can be used to close the opening 913 of bag 910.

Figure 10A:
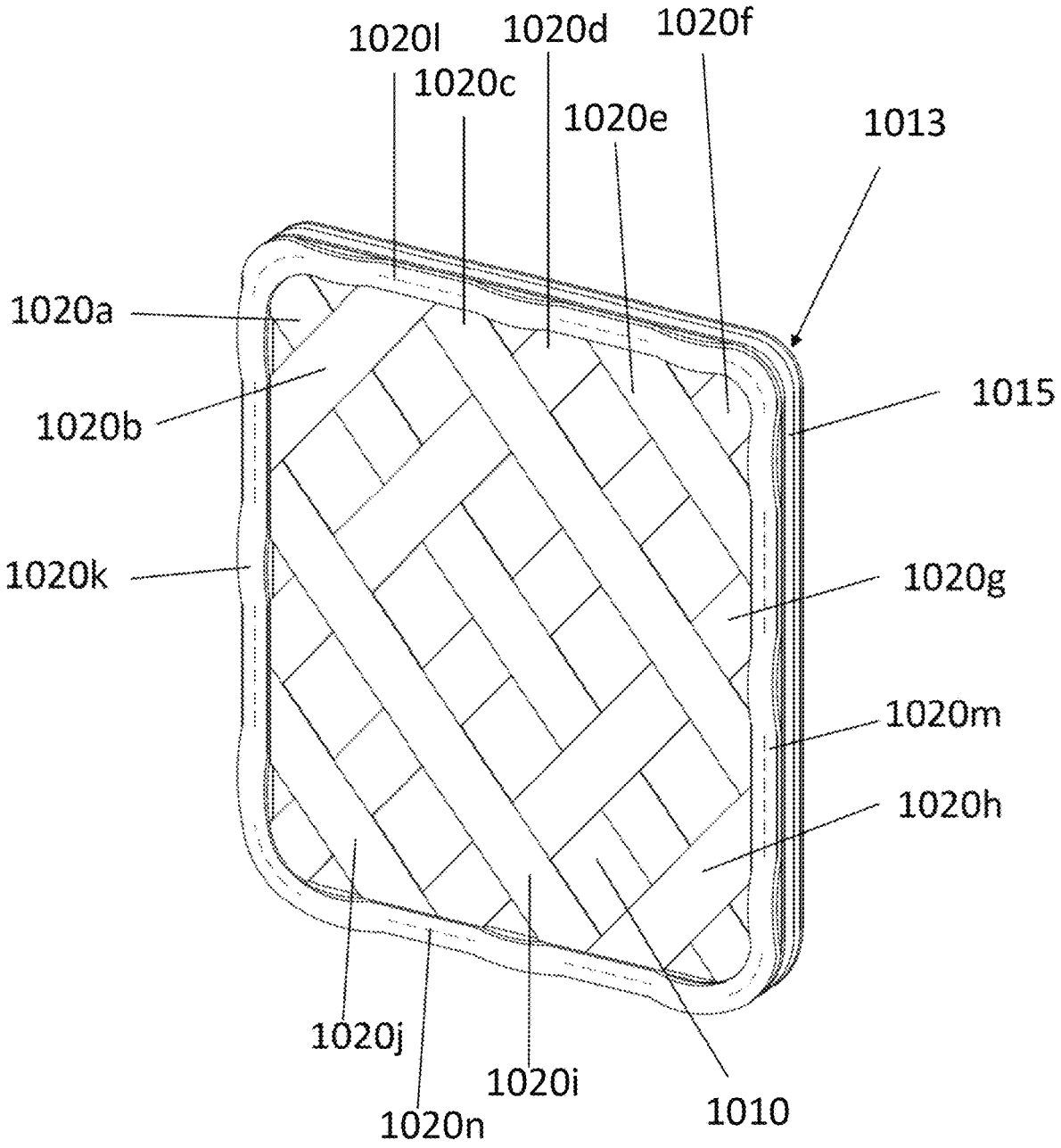
FIGS. 10A and 10B show several views of an embodiment of a bag of the disclosure.
Figure 10B:
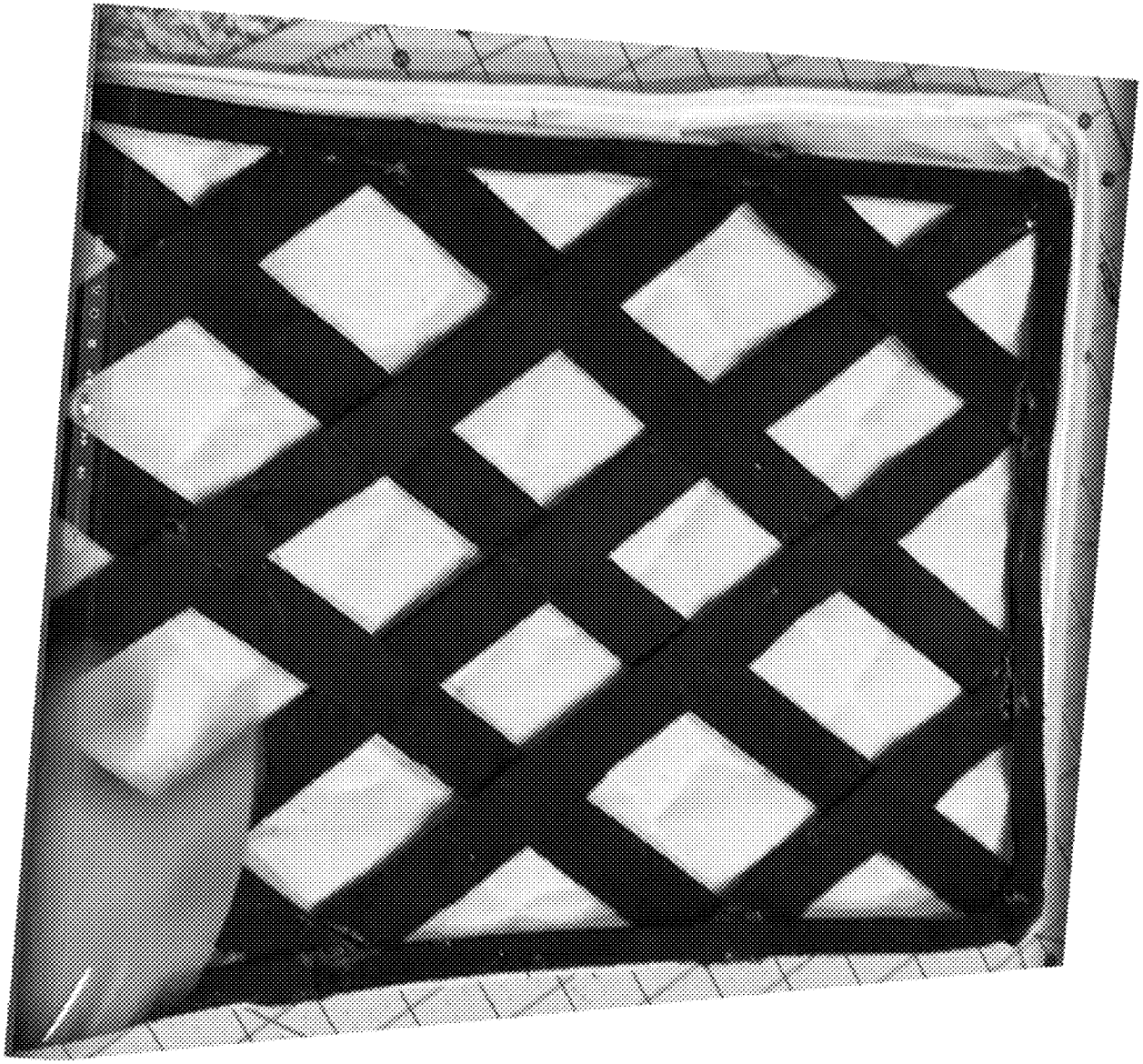

An alternate embodiment of a bag 1010 designed to house and protect electronic devices is shown in FIG. 10A and FIG. 10B. Bag 1010 has padded outer walls to protect electronic devices housed inside the bag. Bag 1010 includes securing elements 1020*a*-1020*j* arranged in a lattice (i.e., crisscrossed) pattern on the outside of the bag 1010. Bag 1010 further includes securing elements 1020*k*-1020*n* arranged around the perimeter of the face of the bag 1010.

Additionally, points where securing elements 1020*a*-1020*j* intersect with securing elements 1020*k*-1020*n* are secured (e.g., stitching, adhesive, removable couplings (for example, hook and loop fasteners, buttons, snaps, etc.)) to the surface of the bag.

Bag 1010 includes an opening 1013 along three of the four sides that is closed by a zipper 1015. Thus, when the zipper 1015 is opened, the bag can be opened and laid flat. The interior of bag 1010 may include pocket(s) or strap(s) suitably sized to accommodate cards, a mobile phone, a tablet, a laptop, and the like.

Figure 11A:
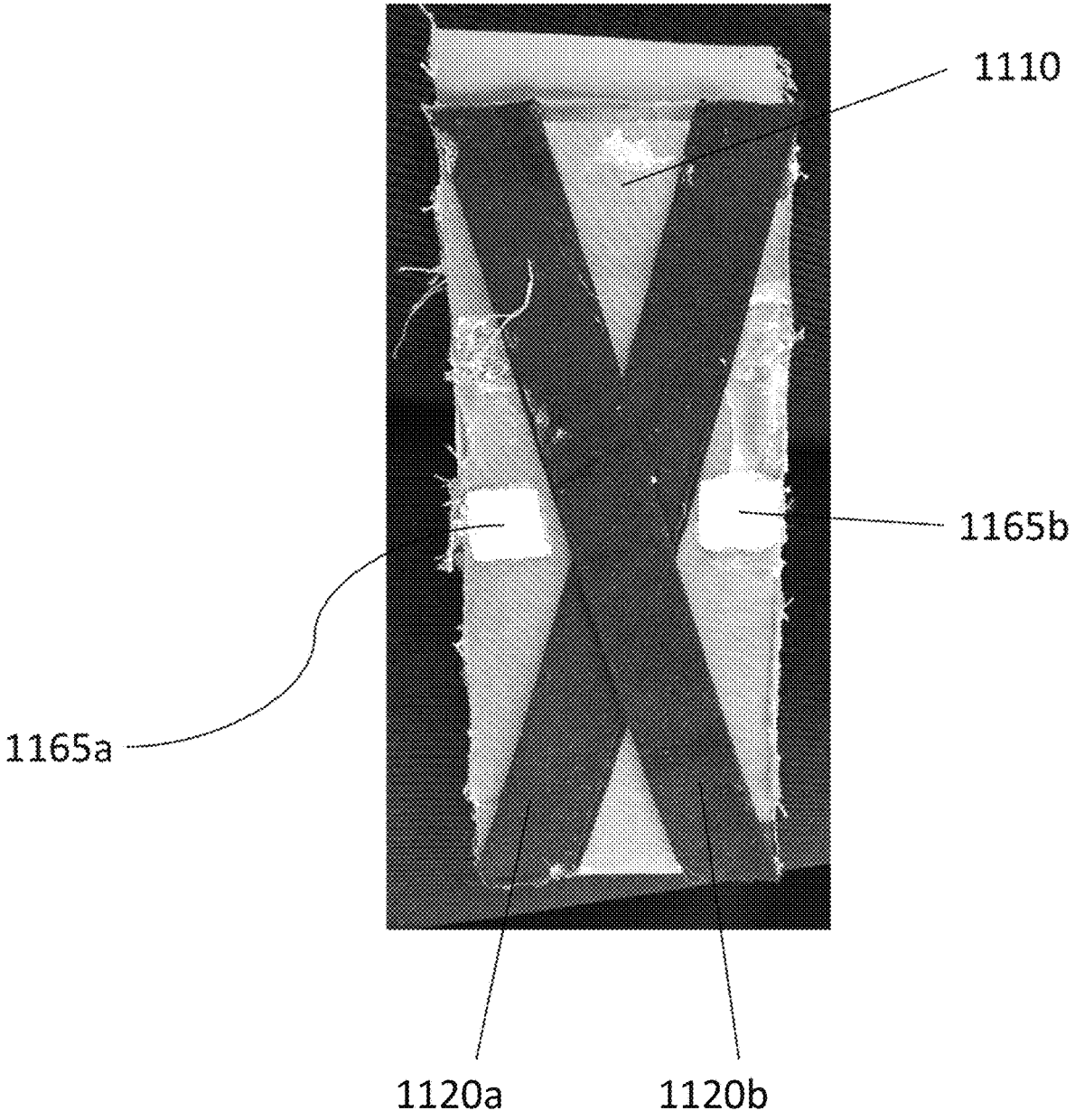
FIGS. 11A-11F show several views of an embodiment of a bag of the disclosure.
Figure 11B:
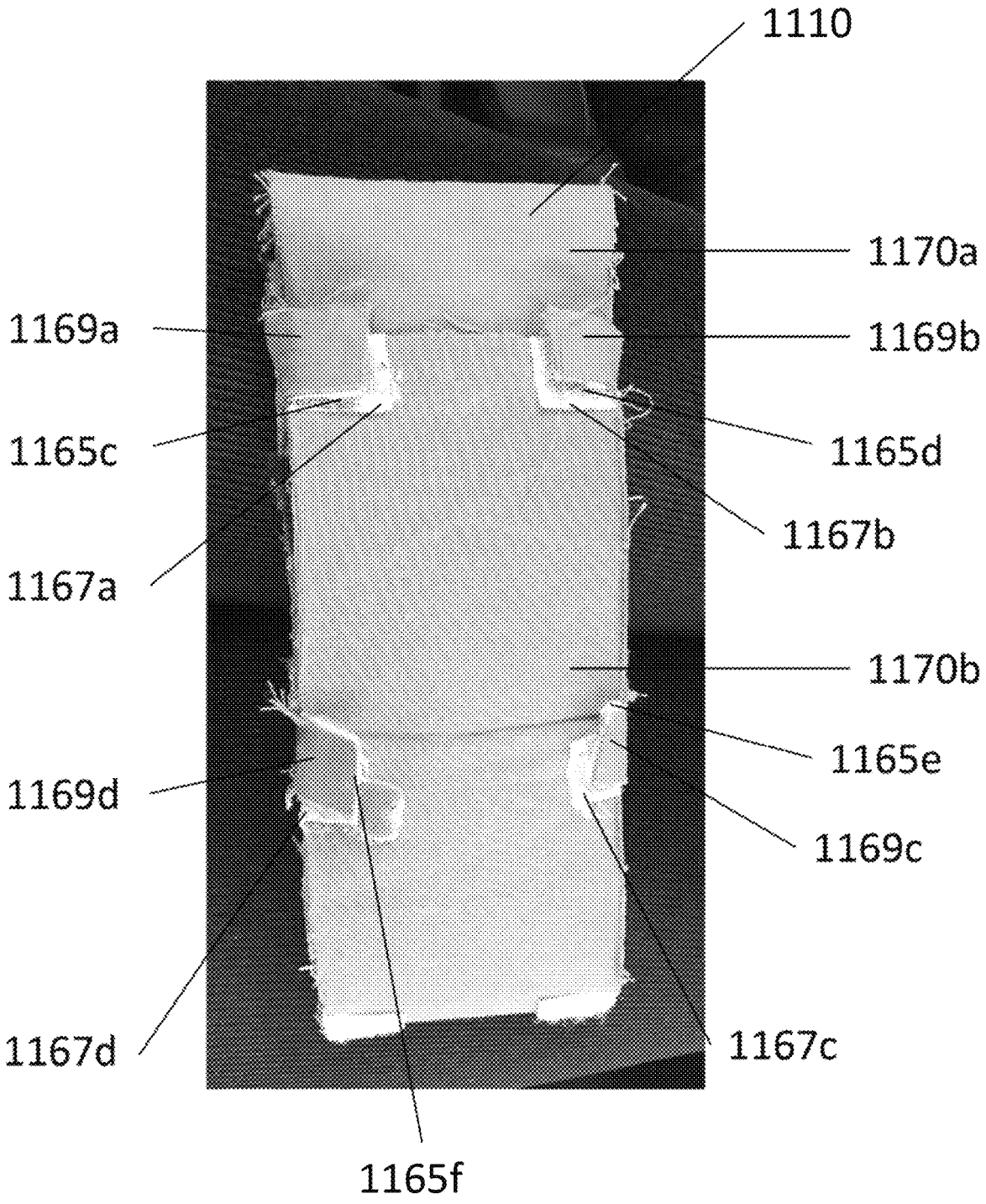

FIG. 11A shows an embodiment of another bag 1110 of the disclosure. Securing elements 1120*a*, 1120*b* are arranged in an "X" on one side of the bag 1110. Additionally, fastener elements 1165*a*, 1165*b* are arranged on the same side of bag 1110 as the securing elements 1120*a*, 1120*b*. Fastener elements 1165*a*, 1165*b* are illustrated as one side of hook-and-loop fastener (e.g., hook), however, the fastener element may be any suitable fastener (e.g., a snap, hook and loop fastener, button, clip, etc.). FIG. 11B shows a second side of bag 1110, which is opposite the side shown in FIG. 11A. Two flaps 1170*a*, 1170*b* of bag 1110 are visible on the second side of bag 1110. The first flap 1170*a*, is partially tucked behind the second flap 1170*b*.

Fastener elements 1167*a*-1167*d* are arranged on the second side of bag 1110. Additionally, tabs 1169*a*-1169*d* having fastener elements 1165*c*-1165*f* wrap around and secure to fastener elements 1167*a*-1167*d*, respectively. Fastener elements 1165*c*-1165*f* include the corresponding portion of the fastener as fastener elements 1167*a*-1167*d*. When fastener elements 1165*c*-1165*f* are decoupled from fastener elements 1167*a*-1167*d*, respectively, the first flap 1170*a* of the bag 1110 and the second flap 1170*b* of the bag 1110 can be folded back to reveal the interior 1112 of the bag 1110, as shown in FIG. 11C.

Figure 11C:
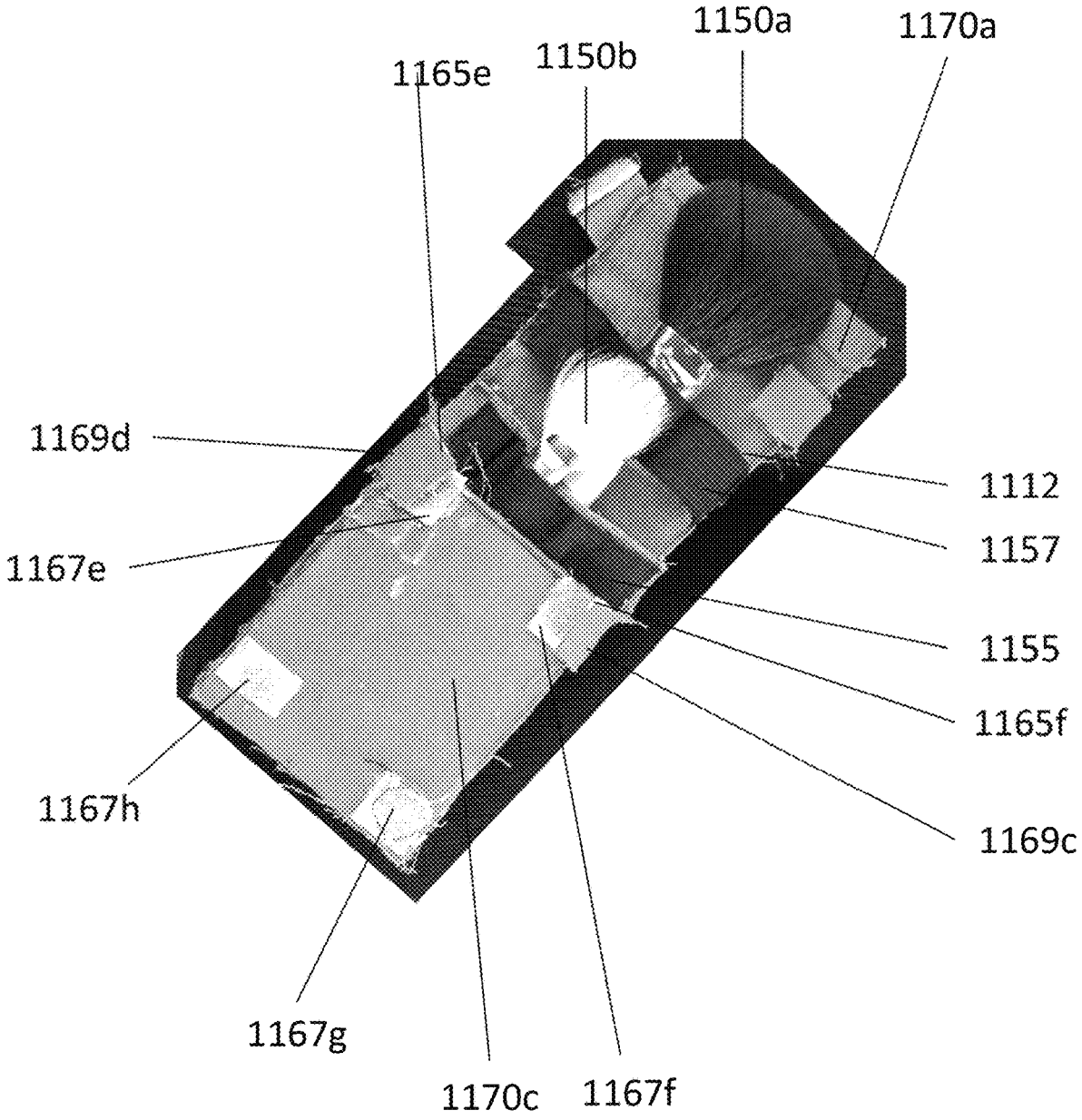

As shown in FIG. 11C, the first flap 1170*a* of the bag 1110 has been folded over to the first side of the bag 1110 and the second flap 1170*b* has been folded near the approximate midpoint such that the interior of the second flap 1170*b* of the bag 1110 is now on the exterior. Fastening elements 1167*e*-1167*h* are exposed when the second flap 1170*b* is folded. Fastener elements 1165*e*, 1165*f* of tabs 1169*c*, 1169*d*, respectively, are coupled to fastening elements 1167*e*, 1167*f*, respectively.

The folding of the second flap 1170*b* also exposes pocket(s) 1155 and strap(s) 1157 that are designed and spaced to accommodate smaller tools, such as cosmetic brushes 1150*a*, 1150*b*, hair styling supplies, tools, art supplies, and the like.

Figure 11D:
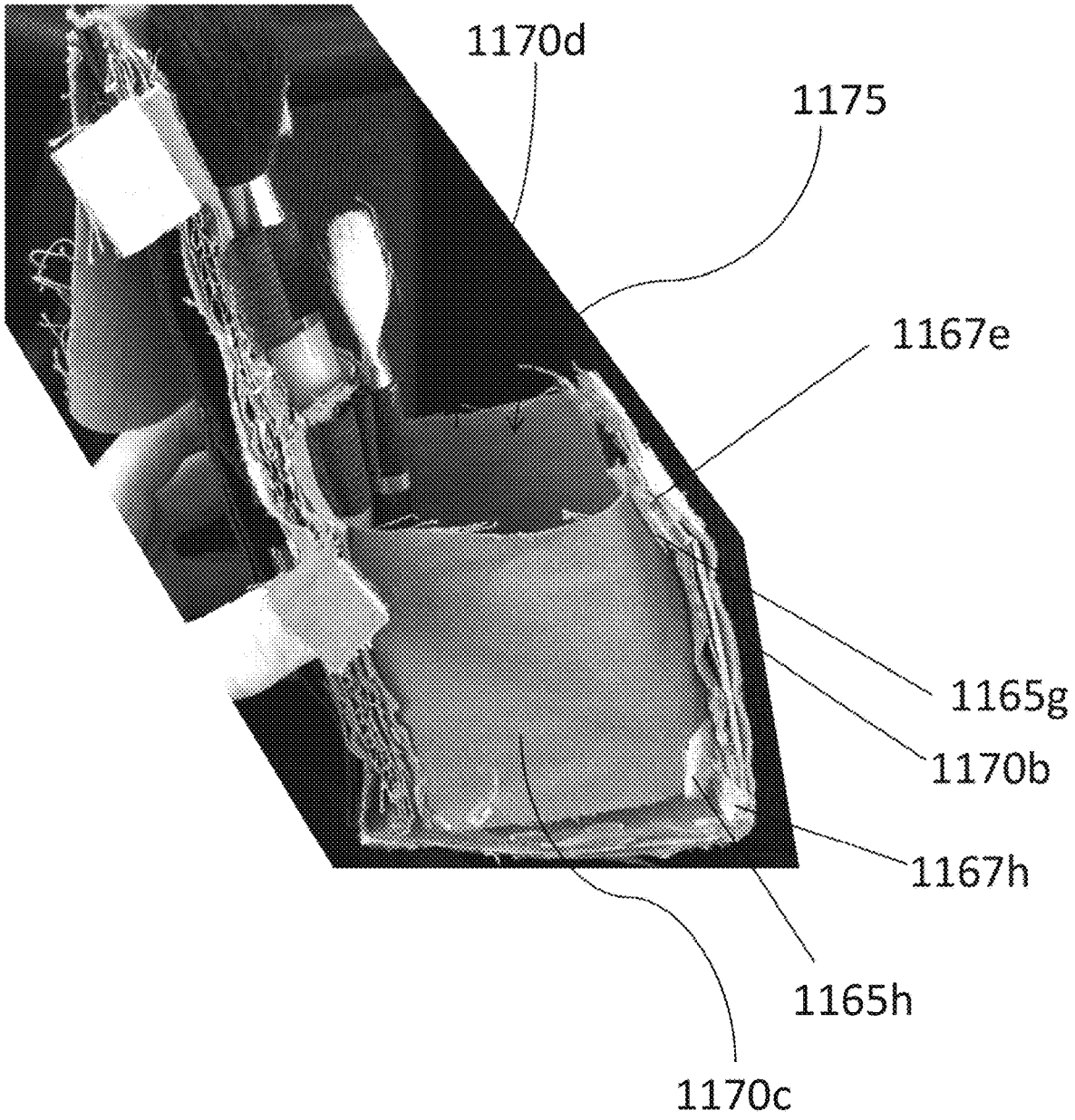
Figure 11E:
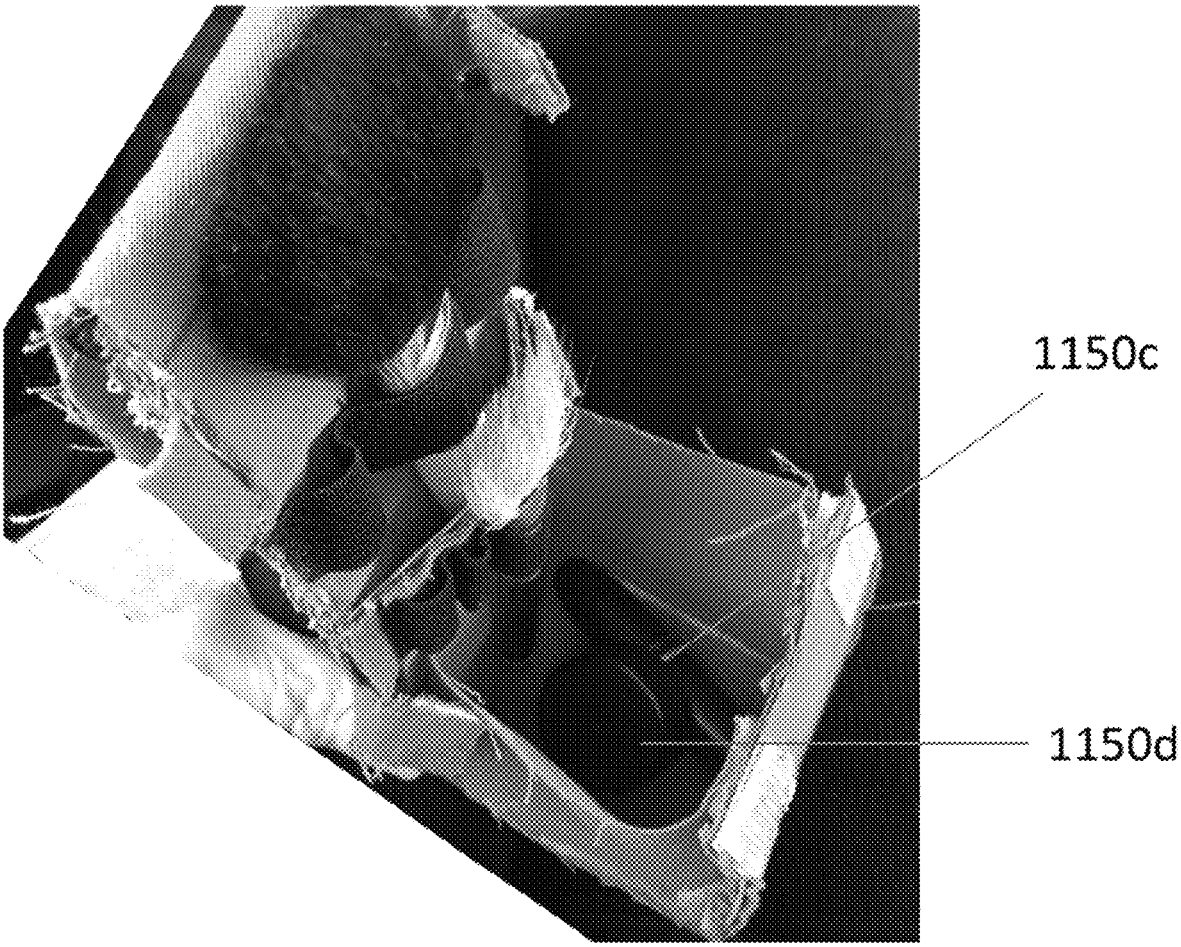

FIG. 11D shows another configuration of bag 1110 where the second flap 1170*b* is folded at the approximate midpoint in the opposite direction as shown in FIG. 11C. Fastening elements 1167*e*, 1167*h* are coupled to fastening elements 1165*g*, 1165*h*, respectively of flap 1170*c*. Fastening elements of flap 1170*d* are similarly coupled to fastening elements 1167*f*, 1167*h*, respectively, of flap 1170*b*. This forms a pouch 1175 in which additional items can be stored. For example, if bag 1110 is being used for cosmetics and cosmetics brushes, pouch 1175 can be used to store cosmetics 1150*c*, 1150*d*, as shown in FIG. 11E. In another example, if bag 1110 is being used to store tools, pouch 1175 can be used to hold nails, screw, or other small parts. In this arrangement, flap 1170*b* forms a stand that can be used to display the contents of bag 1110.

Figure 11F:
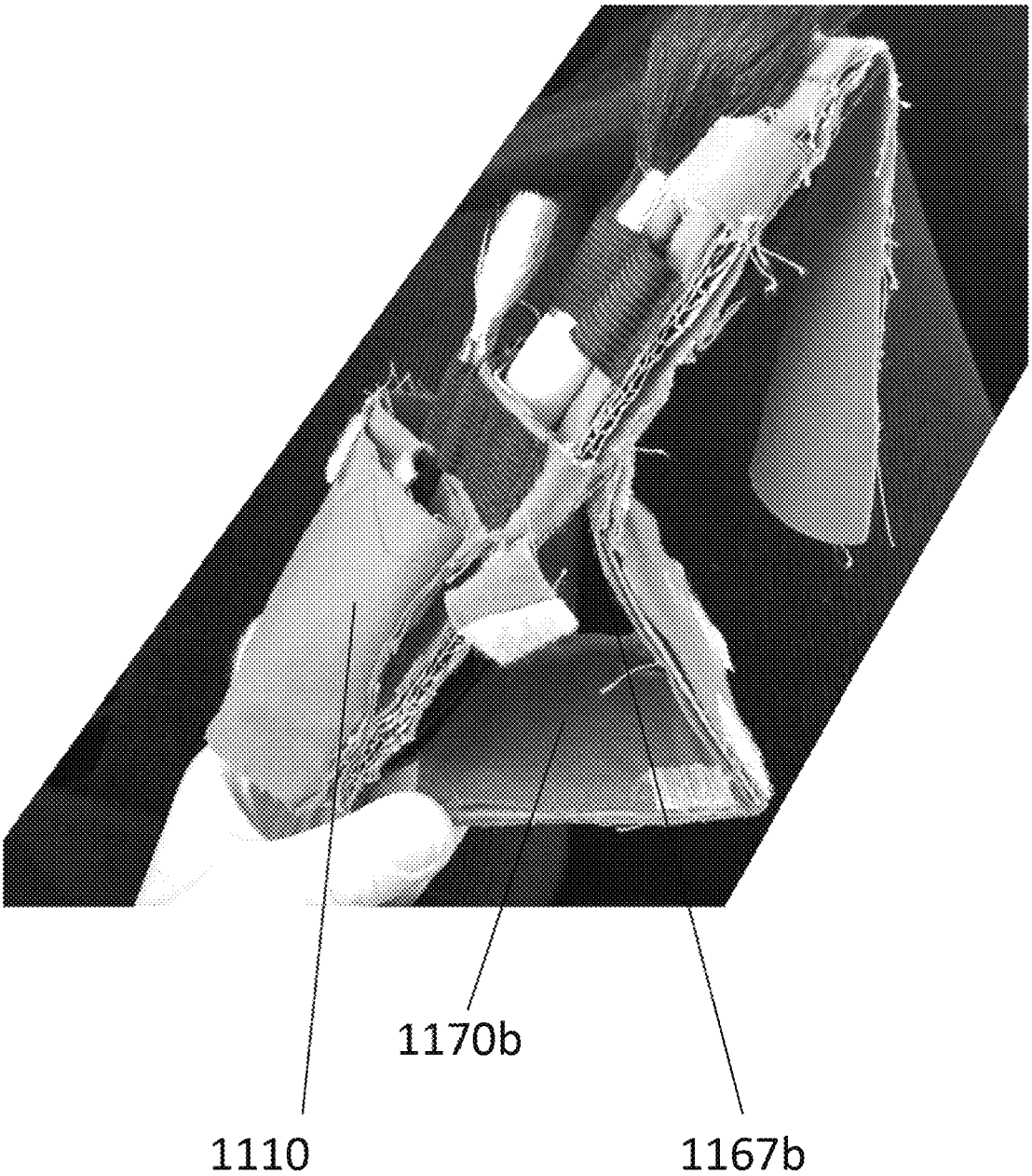

In yet a further configuration, which is shown in FIG. 11F, flap 1170*b* is folded toward the first side of bag 1110. Flap 1170*b* is folded at the approximate midpoint and fastening elements 1167*a*, 1167*b* are coupled to fastening elements 1165*a*, 1165*b*, respectively. In this arrangement, flap 1170*b* also forms a stand that can be used to display the contents of bag 1110.

Figure 12A:
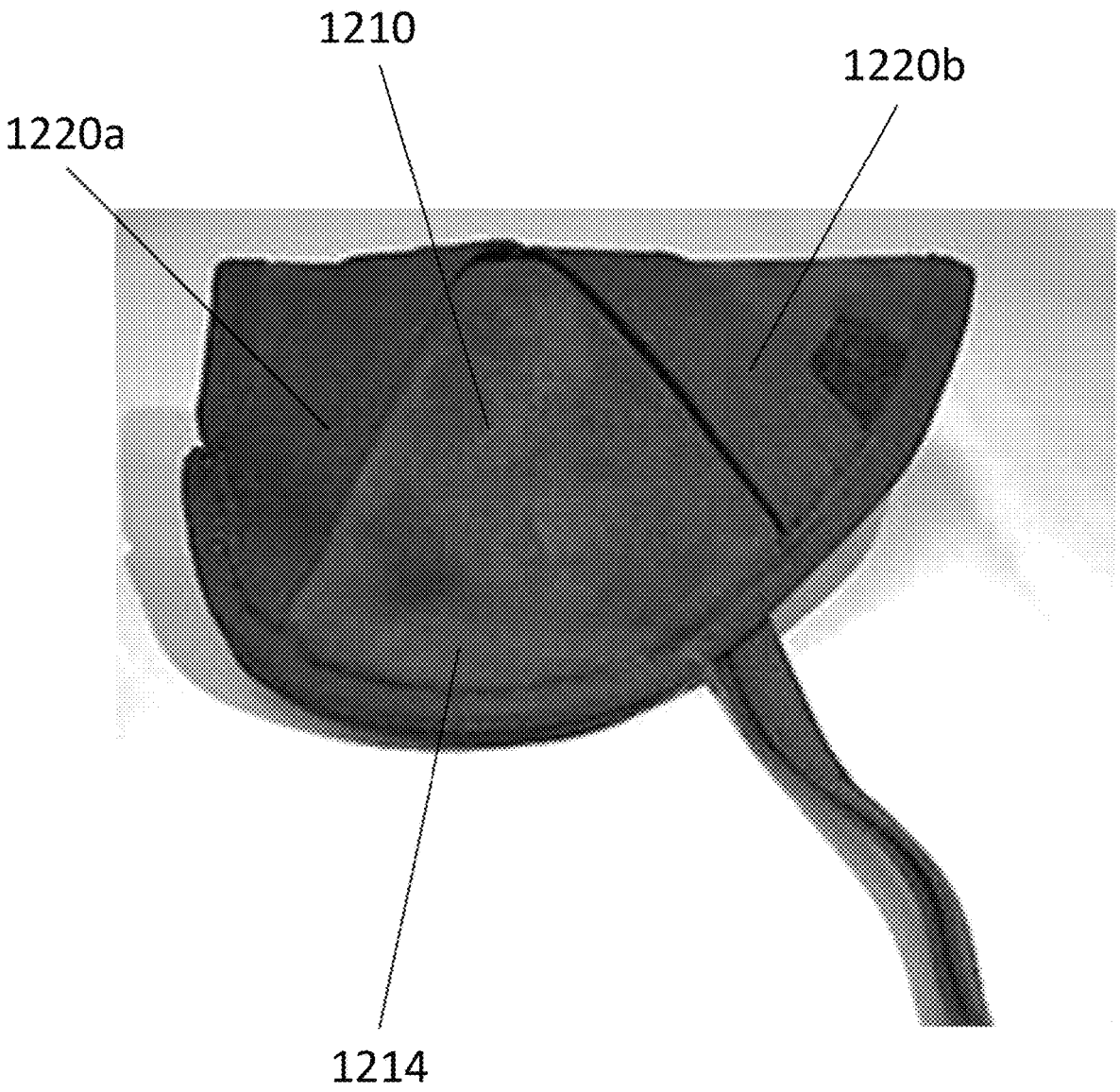
FIGS. 12A-12U show several views of an embodiment of a bag of the disclosure.
Figure 12B:
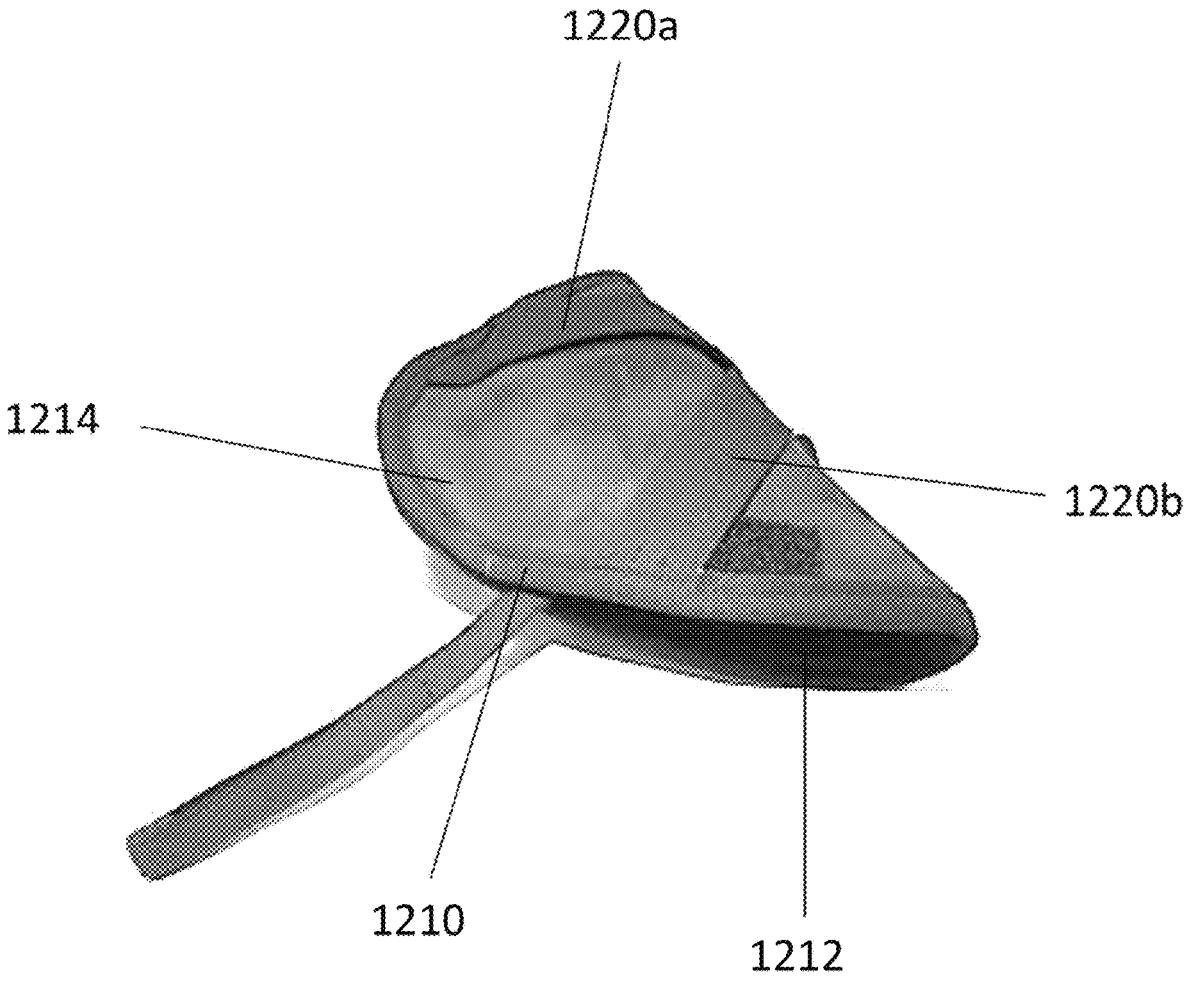

The present disclosure also includes a bag 1210 that is a soft case holster, as shown in FIG. 12A and FIG. 12B, which show two views of an embodiment of the disclosure. The bag 1210 may be suitably sized depending on the desired items that will be arranged in the holster. For example, the bag 1210 may hold a firearm. In other embodiments, the bag 1210 may be sized to hold a hair dryer, a curling iron, a hair straightener, a drill, or any other suitable items. Such a bag 1210 may be made of any suitable material or combination of materials (e.g., nylon, foam, etc.), and may be any suitable shape. The bag 1210 may be made of a heat resistant material, if desired, for example if the bag 1210 will be used for a hot tool.

As shown in FIG. 12A, the bag 1210 may be a substantially oval shaped material that has been folded over and secured. In other embodiments, the bag 1210 is substantially round, substantially rectangular, substantially rhomboid, or any other suitable shape.

Bag 1210 has an interior surface 1212 and an exterior surface 1214, as indicated in FIG. 12B. An exterior surface 1214 has a first securing element 1220*a* and a second securing element 1220*b* that intersect to form an "X" shape. Each of the first securing element 1220*a* and the second securing element 1220*b* are coupled to the exterior surface 1214. In embodiments, each end of the first securing element 1220*a* and each end of the second securing element 1220*b* are coupled to the exterior surface 1214.

Figure 12C:
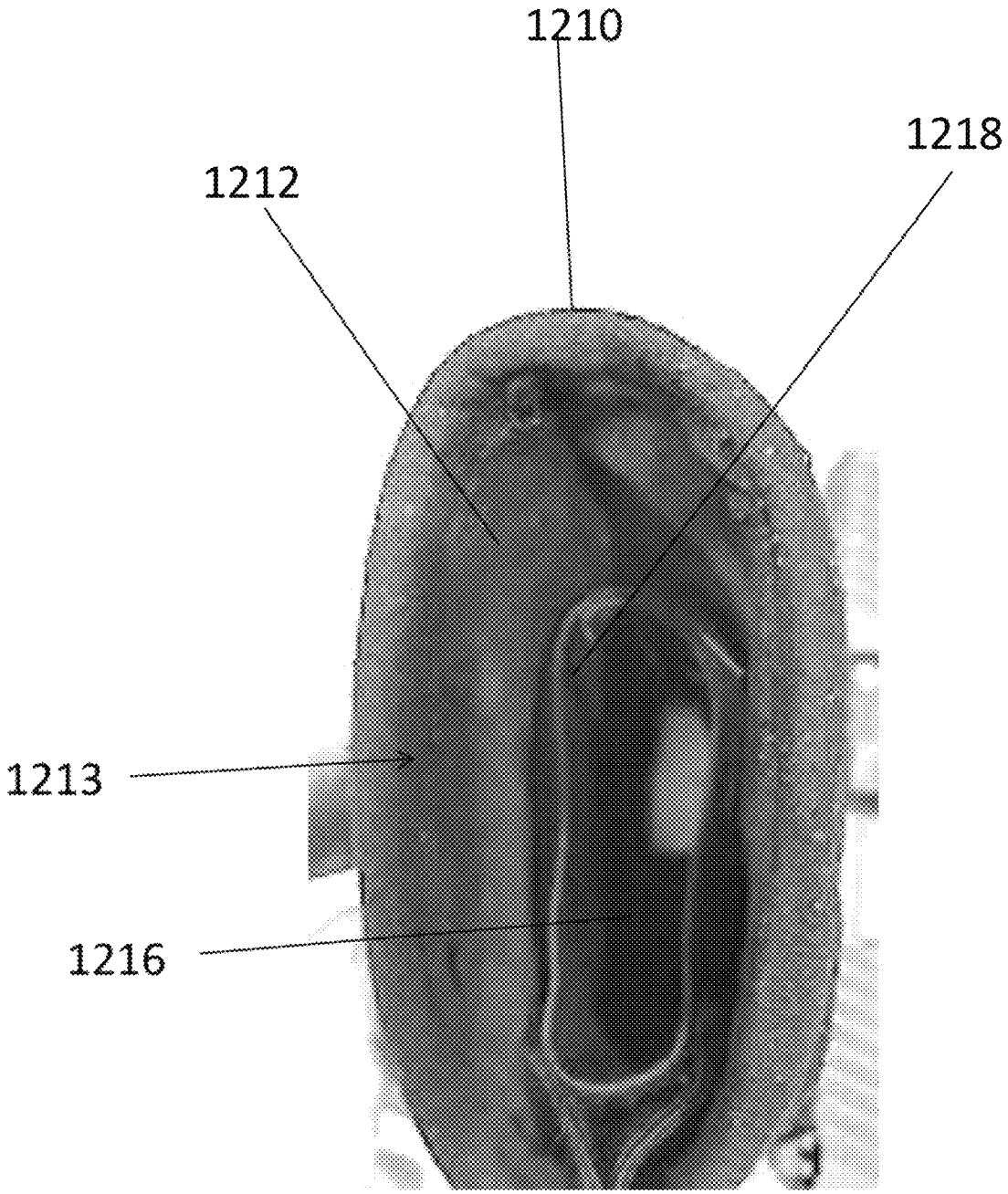
Figure 12D:
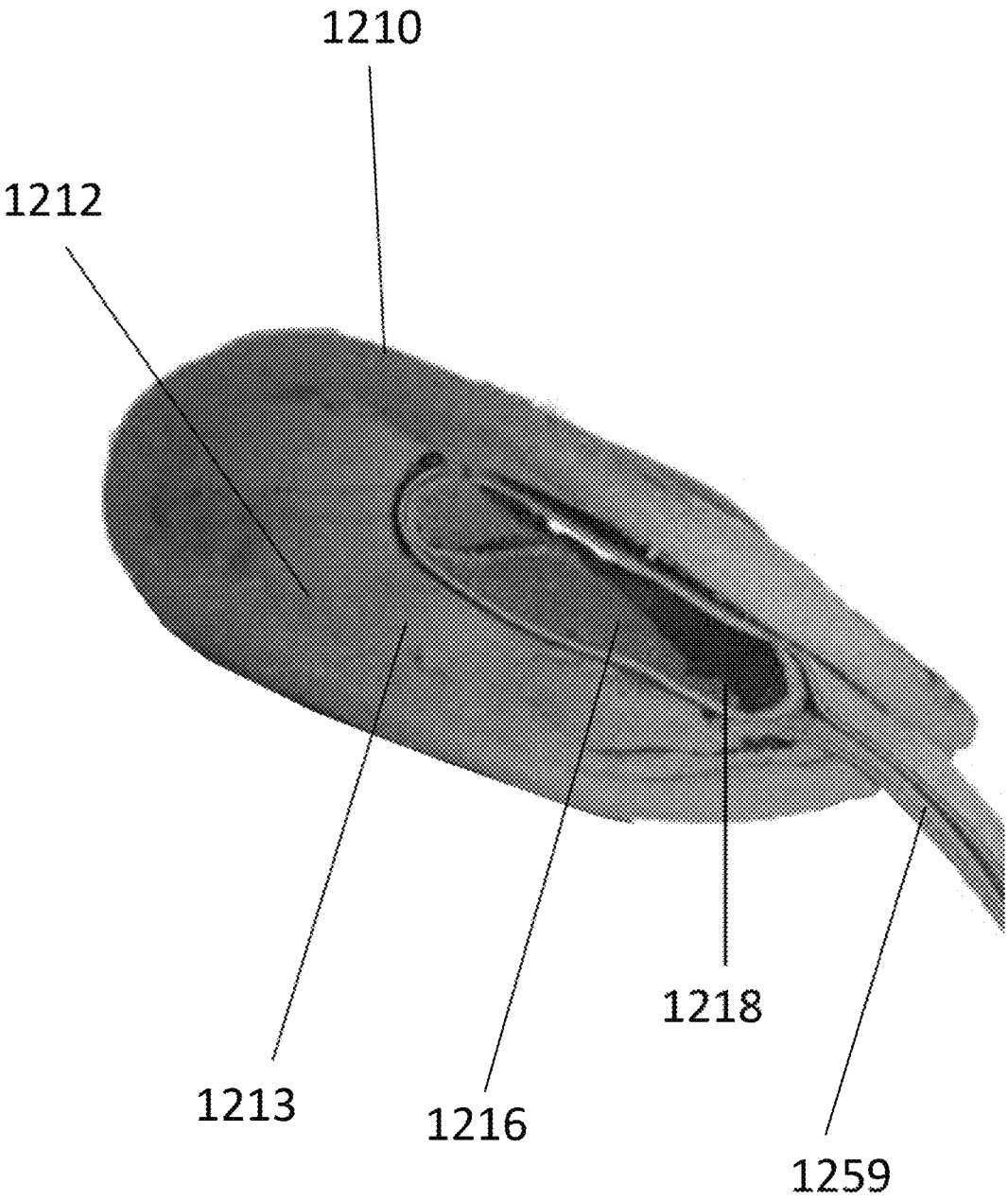

An illustrative interior surface 1212 of bag 1210 is shown in FIG. 12C and FIG. 12D. Interior surface 1212 defines a cavity 1216 into which a firearm, a tool, etc. may be inserted through the opening 1213.

In embodiments, cavity 1216 is sized such that substantially all of a barrel portion of a firearm is accommodated in the cavity 1216. As used herein a "barrel portion" of a firearm is the portion of the firearm that includes the barrel. For example, a barrel of a pistol generally extends from the rear of the ejection port to the muzzle. In another example, a barrel of a revolver generally extends from the face of the cylinder to the muzzle.

In some embodiments, cavity 1216 is sized such that the trigger guard is accommodated in the cavity 1216. In some embodiments, cavity 1216 is sized such that at least a portion of the grip is accommodated in the cavity 1216. In some embodiments where the firearm is a revolver, cavity 1216 is sized such that at least a portion of the cylinder is accommodated in the cavity 1216. In some embodiments where the firearm is fitted with a sight, cavity 1216 is sized such that at least a portion of the sight is accommodated in the cavity 1216.

In other embodiments, cavity 1216 is sized such that the barrel portion of a hair dryer is accommodated in the cavity 1216. In further embodiments, cavity 1216 is sized such that the heated portion of a hair tool is accommodated in the cavity 1216.

In some embodiments, a bag 1210 may have a second opening opposite the first opening. In embodiments where bag 1210 is intended to accommodate a firearm, the second opening may be sized to allow the muzzle end of the barrel portion of the firearm to extend through the second opening.

Elastic element 1218 is coupled to the interior surface 1212 of the bag 1210. In various embodiments, elastic element 1218 is coupled to the interior surface 1212 of the bag 1210 in more than one location. In some such embodiments, elastic element 1218 is coupled to interior surface 1212 in at least two locations. Elastic element 1218 may be coupled to interior surface 1212 using any suitable mechanism (e.g., stitching, adhesive, removable couplings (for example, hook and loop fasteners, buttons, snaps, etc.), and the like). In particular embodiments, elastic element 1218 is coupled to interior surface 1212 by one or more lines of stitches that run parallel to either end of the elastic element 1218. In particular embodiments, elastic element 1218 is coupled to interior surface 1212 by one or more lines of stitches that run perpendicular to either end of the elastic element 1218. In use, the item to be held, or a portion thereof, (e.g. a barrel of a firearm) is inserted through elastic element 1218.

The elastic element 1218 acts to secure the item inserted into the bag 1210 in place. In embodiments, the elastic element 1218 secures the item (e.g. firearm, hair dryer, etc.) in place such that the bag 1210 may be turned upside down without the item being freed. In some embodiments, the elastic element 1218 secures the item in place such that the bag 1210 may be turned upside down and shaken vigorously without the item being freed. In some embodiments, the elastic element 1218 secures the item in place such that the bag 1210 may be jostled vigorously (e.g., if the user is running) without the item being freed.

As shown in FIG. 12D, a fitting element 1259 is coupled to the elastic element 1218. In some embodiments, fitting element 1259 is coupled to the elastic element 1218 in two or more locations. In some embodiments, each end of fitting element 1259 is coupled to elastic element 1218. In some embodiments, each end of fitting element 1259 is coupled to a surface of elastic element 1218 that faces interior surface 1212. In some such embodiments, each end of fitting element 1259 is coupled to interior surface 1212 and to a surface of elastic element 1218 that faces interior surface 1212.

In use, fitting element 1259 is pulled away from elastic element 1218 when inserting the barrel of a firearm to allow for ease of use. In some embodiments, fitting element 1259 is made of an elastic material. In some embodiments, fitting element 1259 is made from a material that substantially does not stretch.

Figure 12E:
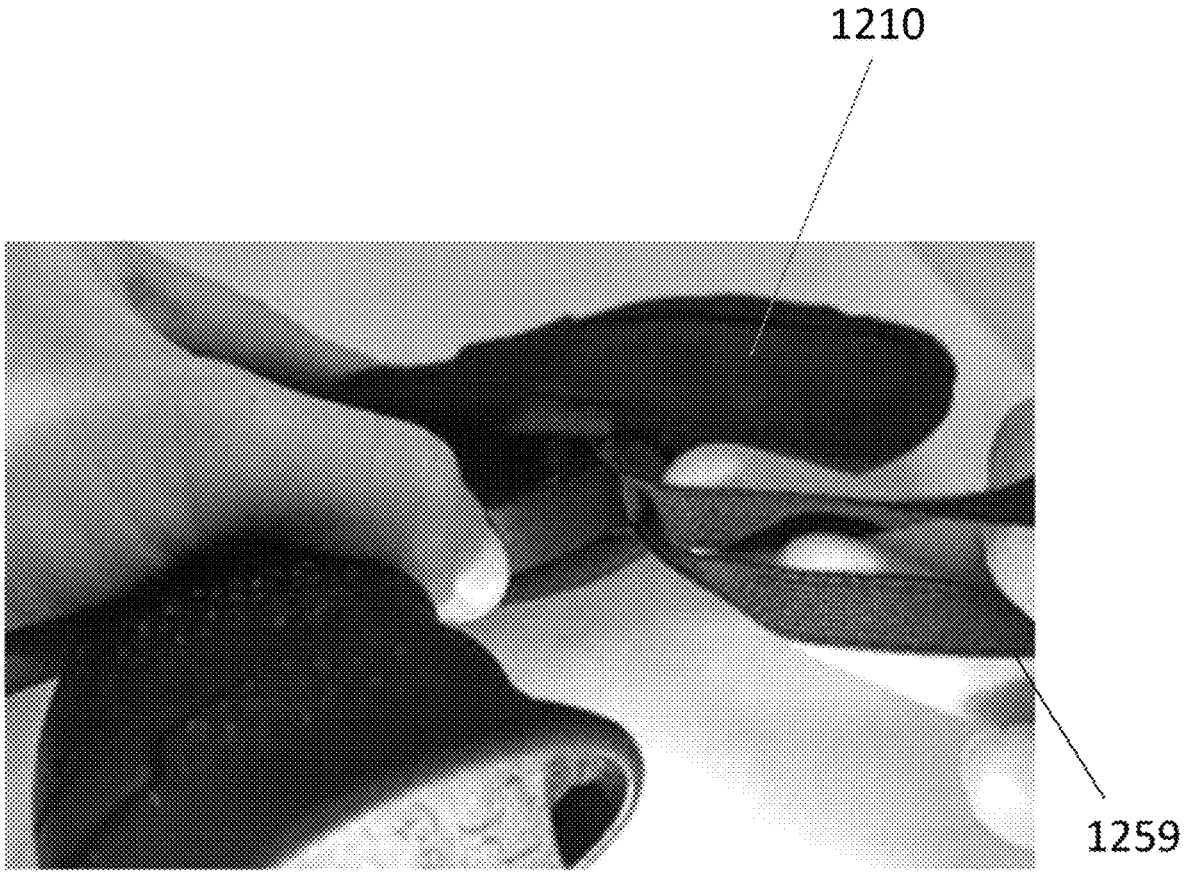
Figure 12F:
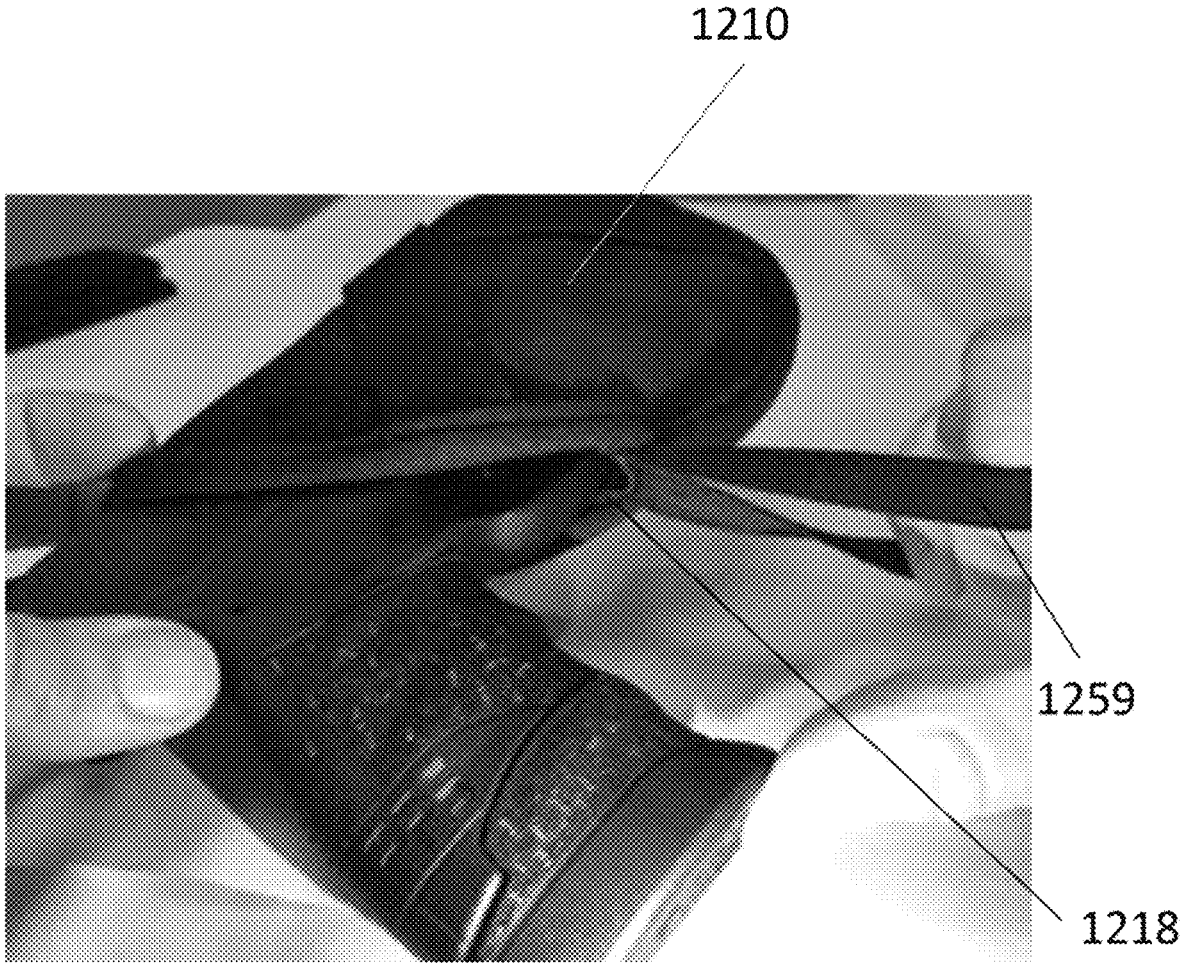
Figure 12G:
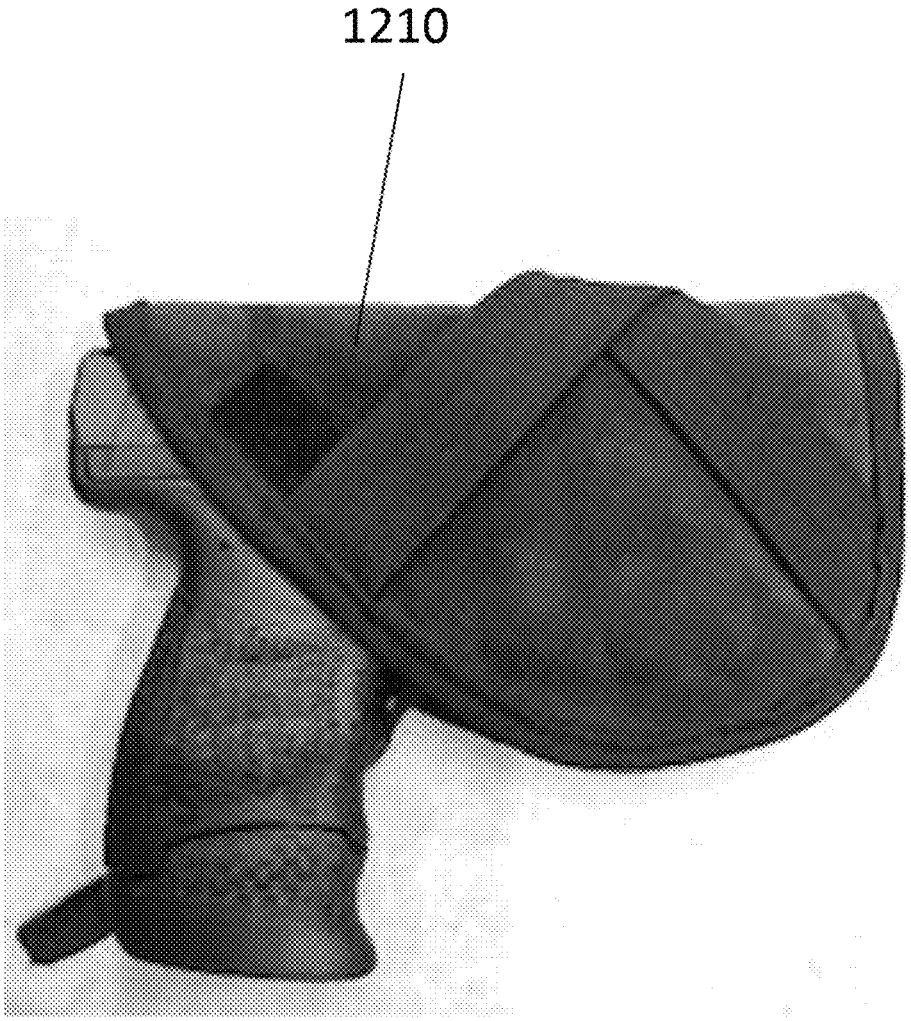

An example of a particular embodiment in which a firearm is inserted into bag 1210 of the disclosure is shown in FIG. 12E and FIG. 12F. First, as shown in FIG. 12E, the barrel of the firearm is inserted into the cavity and through the elastic element (not visible). Second, as shown in FIG. 12F, fitting element 1259 is extended away from elastic element 1218 to allow for easier fitting of the firearm.

Figure 12H:
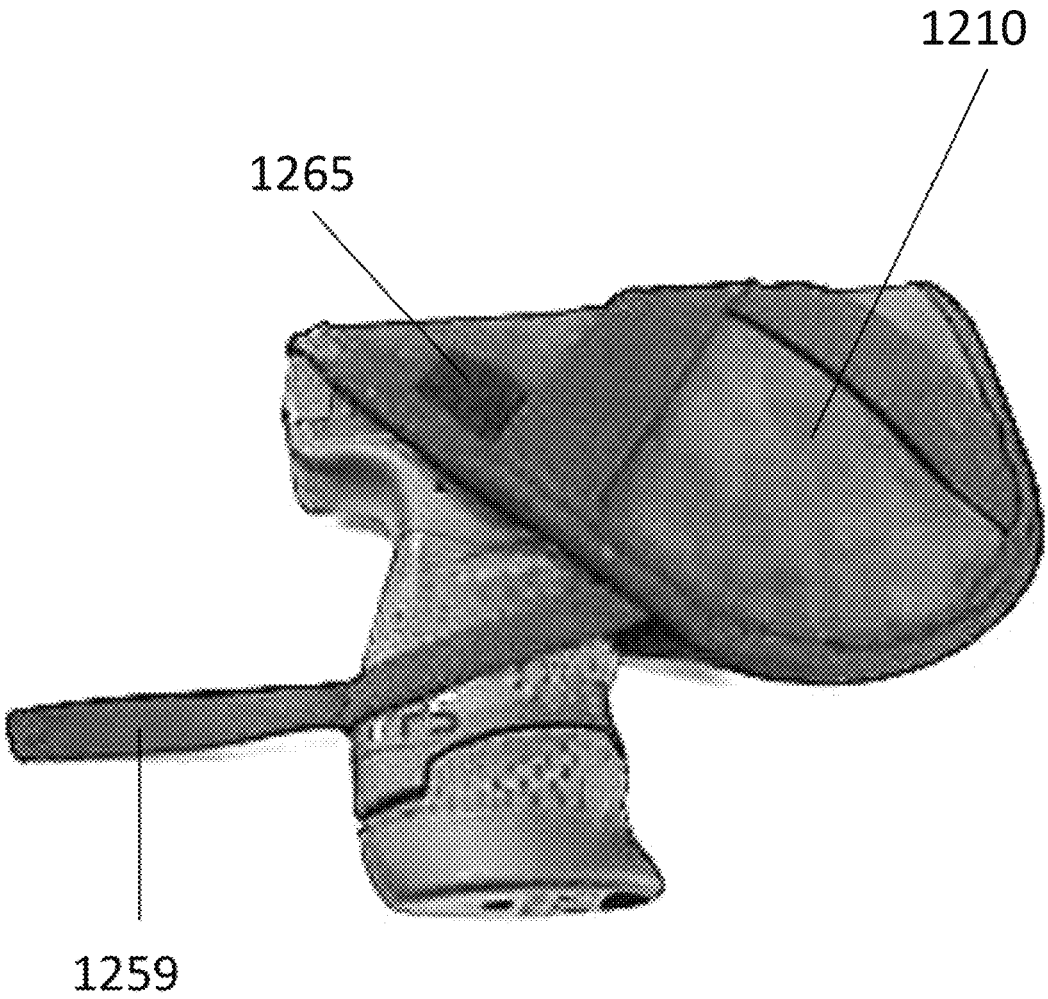
Figure 12I:
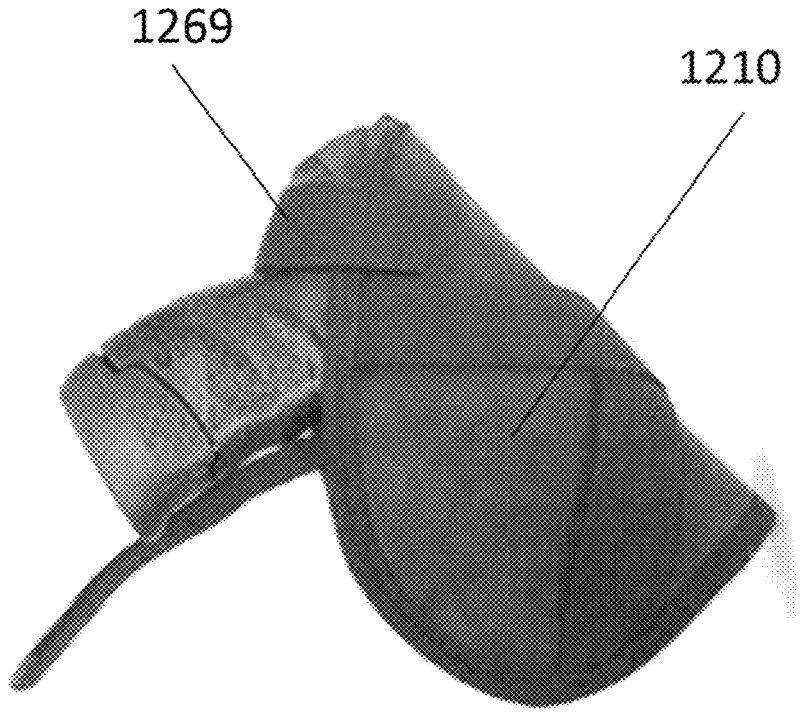
Figure 12K:
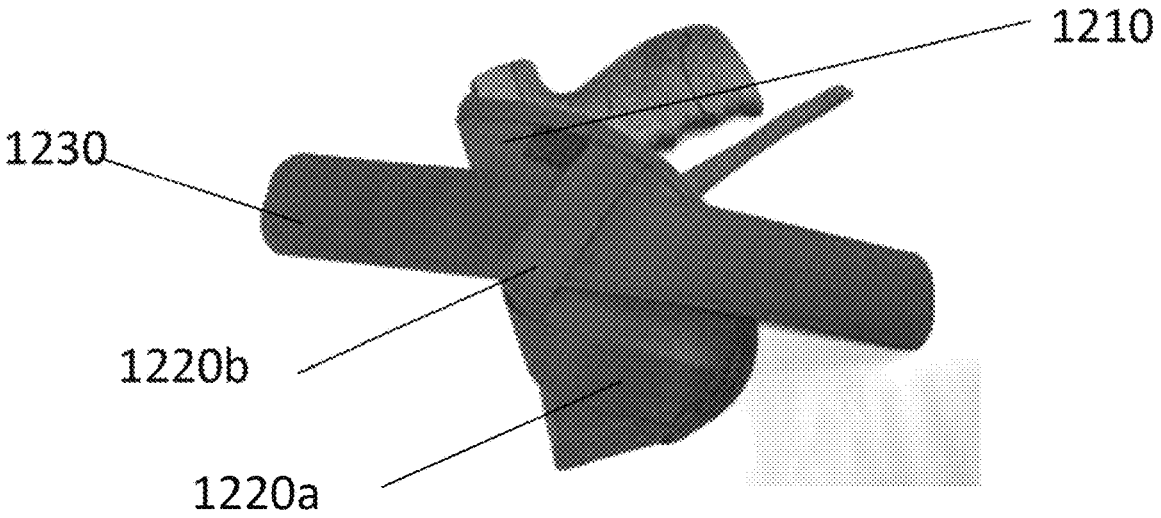
Figure 12J:
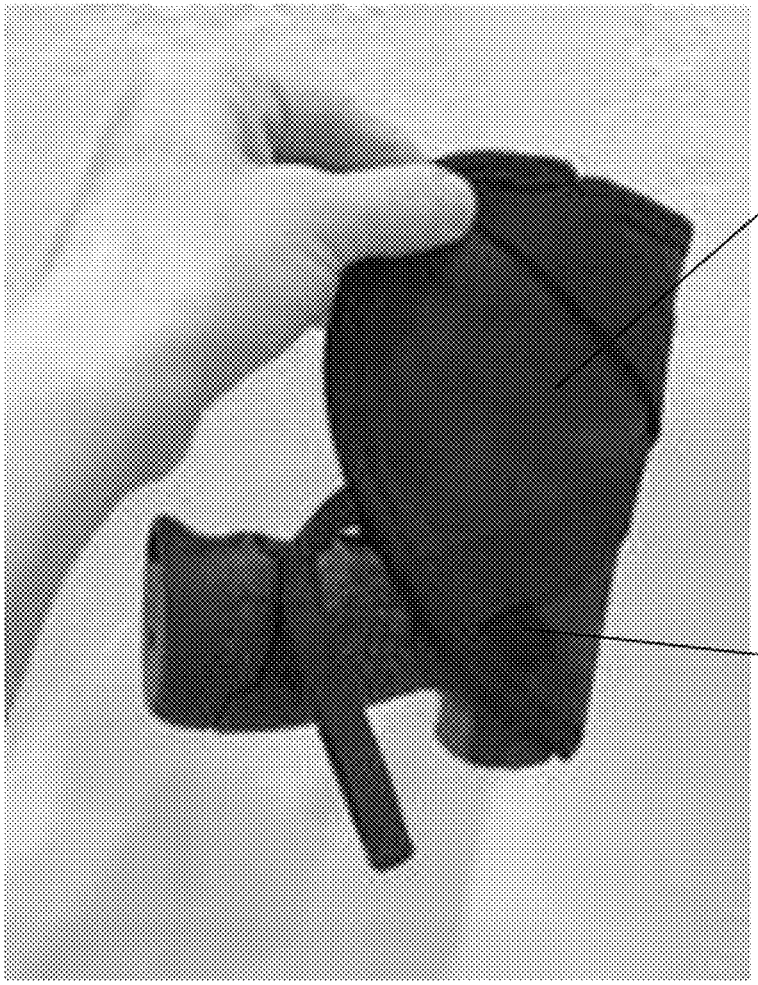

An example of a firearm holstered in a bag 1210 is shown in FIGS. 12G-12J. As shown in FIG. 12H, fitting element 1259 may be fitted over the grip of the firearm and used to secure the firearm in the bag 1210. An additional grip security tab 1269 may be present in some embodiments, as shown in FIG. 12I. A fastening element 1265 for such a tab 1269 is shown in FIG. 12H. As shown in FIG. 12J, the bag 1210 of the present disclosure securely holds a firearm, such that the firearm remains holstered even if inverted.

Figure 12L:
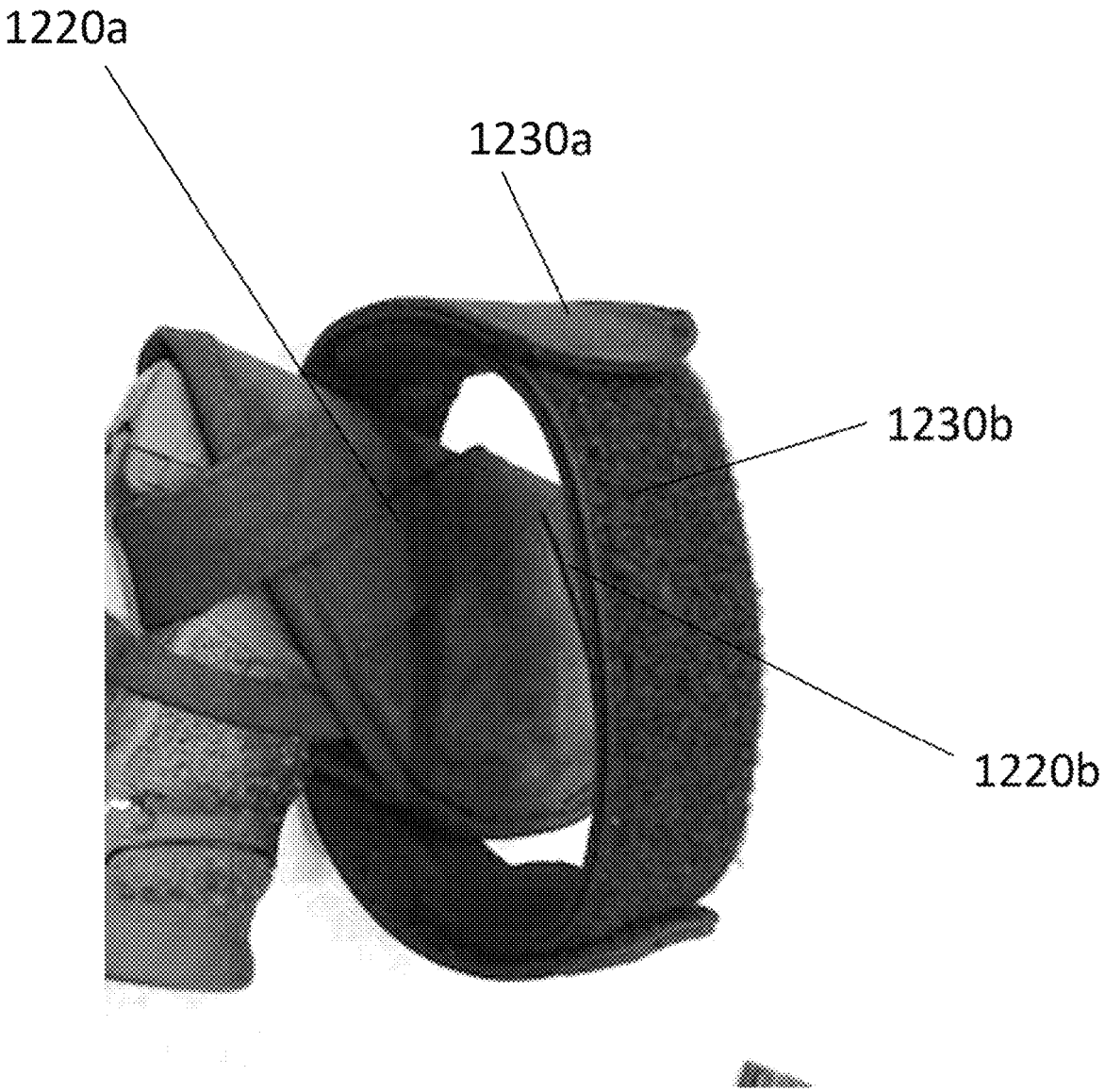

As shown in FIG. 12K, a first strap 1230 may be inserted under the first securing element 1220*a*, the second securing element 1220*b*, or both. A second strap 1230*b* may then be coupled to the first strap 1230*a*, as shown in FIG. 12L. The first strap 1230*a* may be coupled to the second strap 1230*b* using any suitable mechanism (e.g., hook and loop closures, and the like). In some embodiments, additional straps may be utilized.

The position of the first securing element 1220*a* and the second securing element 1220*b* allows a bag 1210 of the present disclosure to be used ambidextrously. Additionally, the position of the first securing element 1220*a* and the second securing element 1220*b* allows a bag 1210 of the present disclosure to be worn on the inside (i.e., the bag positioned between the first strap 1230 and the user) or on the outside (i.e., the first strap 1230 positioned between the bag and the user).

The first securing element 1220*a* and the second securing element 1220*b* are configured such that when a first strap 1230*a* is inserted under the first securing element 1220*a* and/or the second securing element 1220*b*, the bag 1210 is held in a substantially fixed position relative to the first positioning strap 1230. This allows for a user to remove the item (e.g., draw the firearm) without shifting the bag 1210 out of position, and prevents the bag 1210 from impeding the user's attempts to remove the item.

Figure 12M:
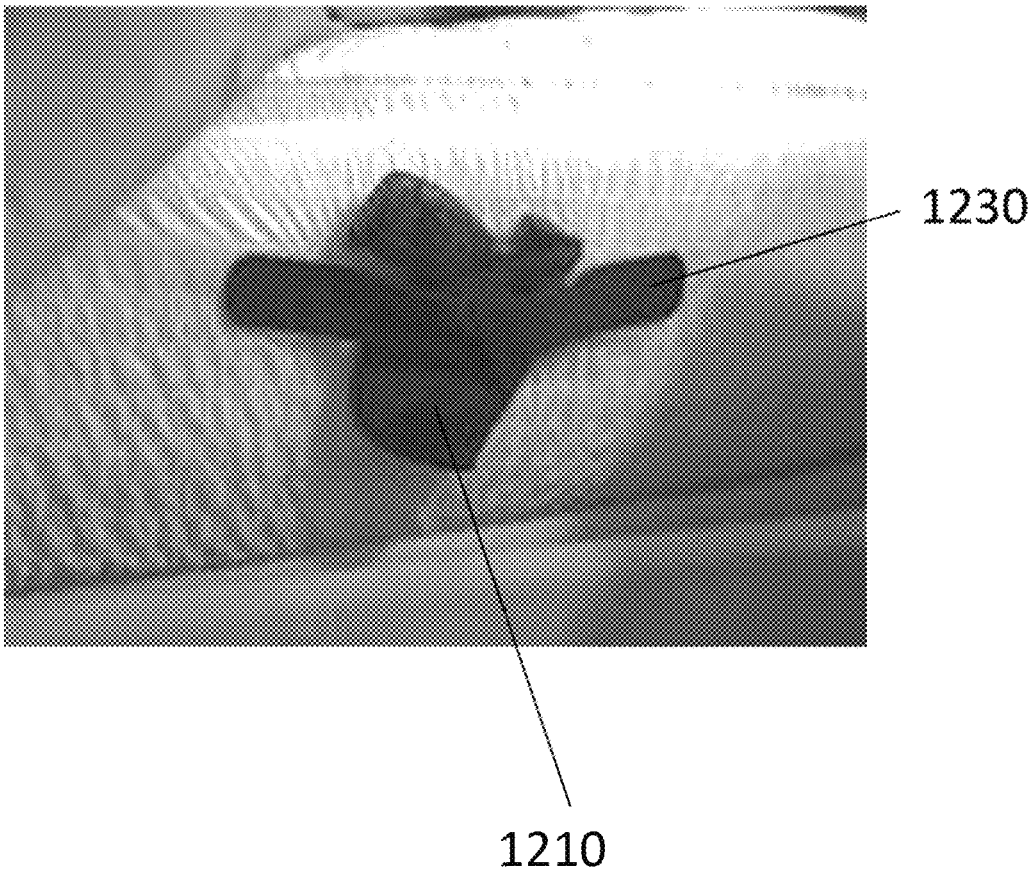

As shown in FIG. 12M, the strap 1230 may be used to position the bag 1210 in a position off of the user's body, for example, to the side of a mattress. In other embodiments, the strap 1230 is used to position bag 1210 under a desk, under a counter, in a center console of a vehicle, on the side of a nightstand, or the like.

Figure 12N:
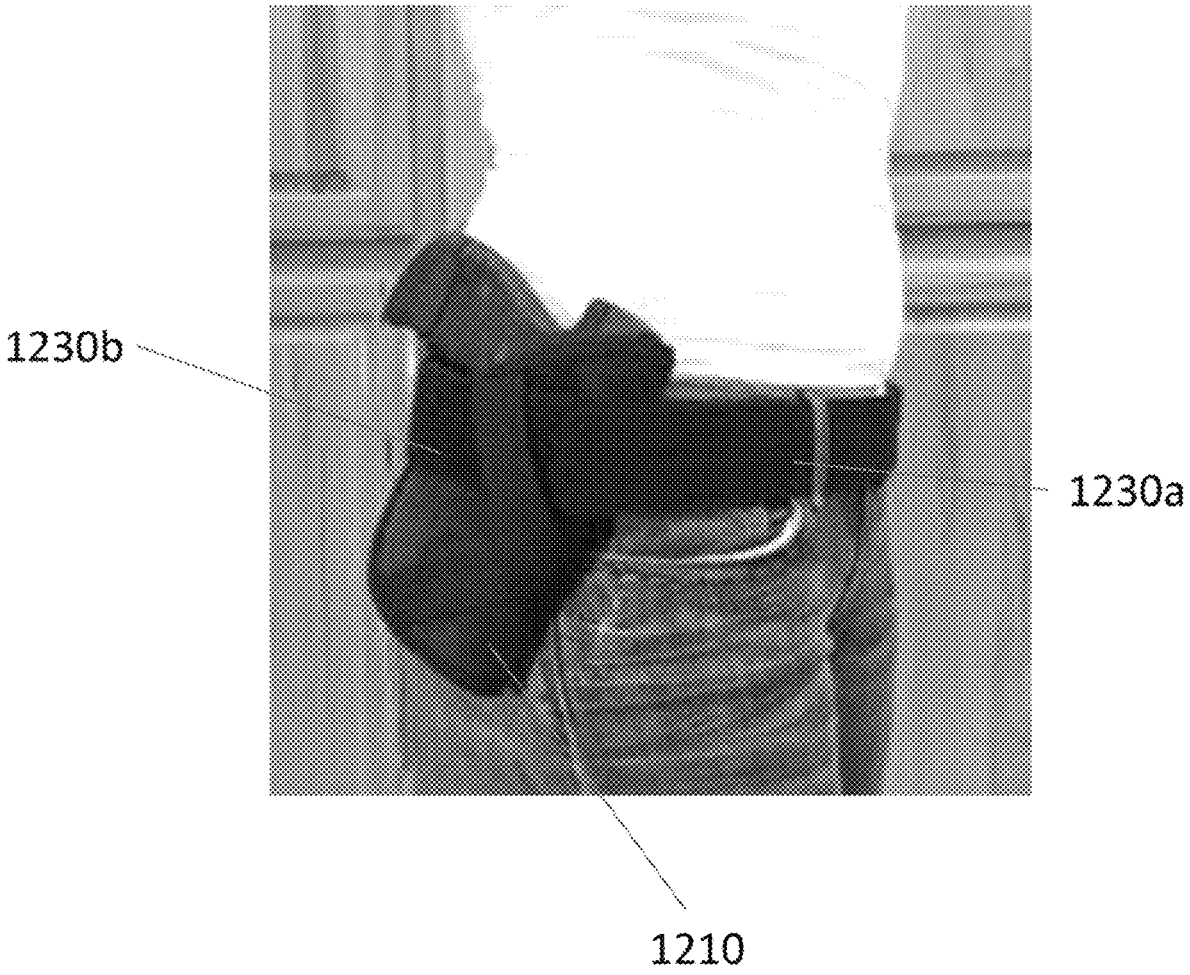
Figure 12O:
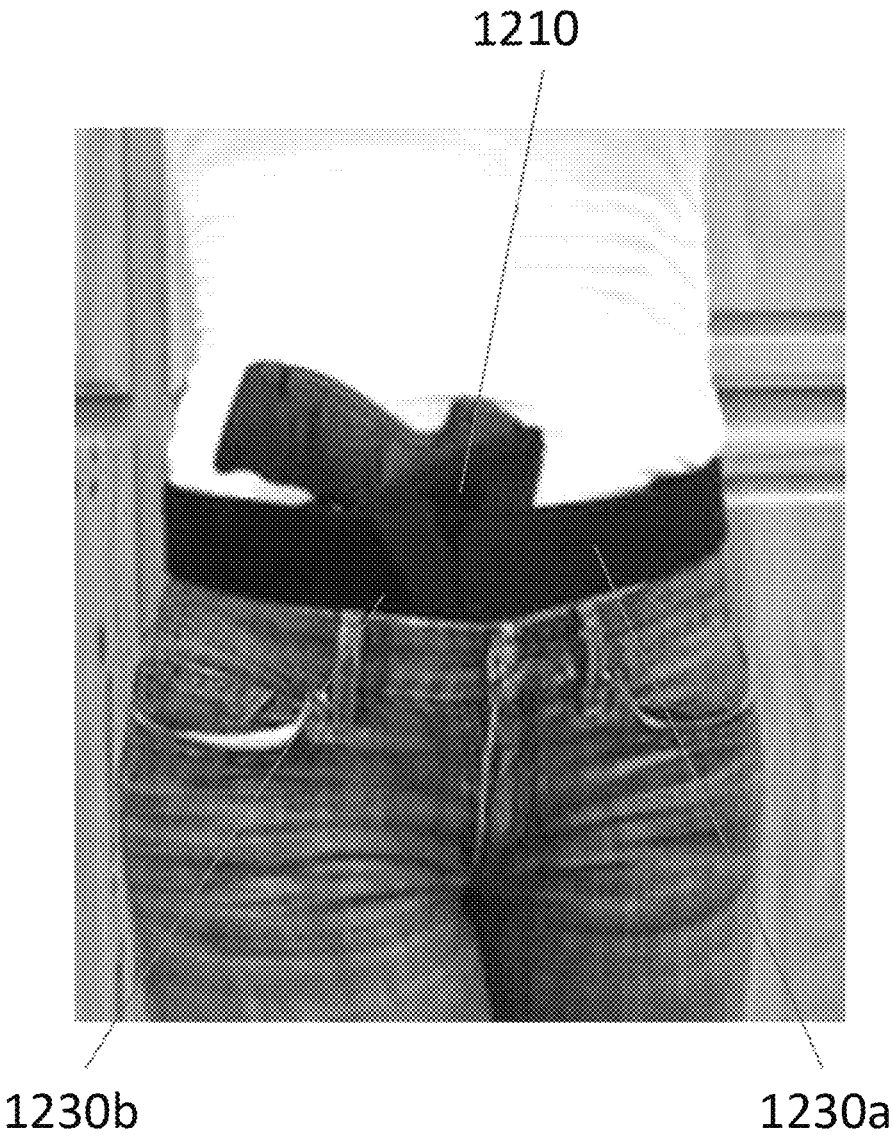
Figure 12P:
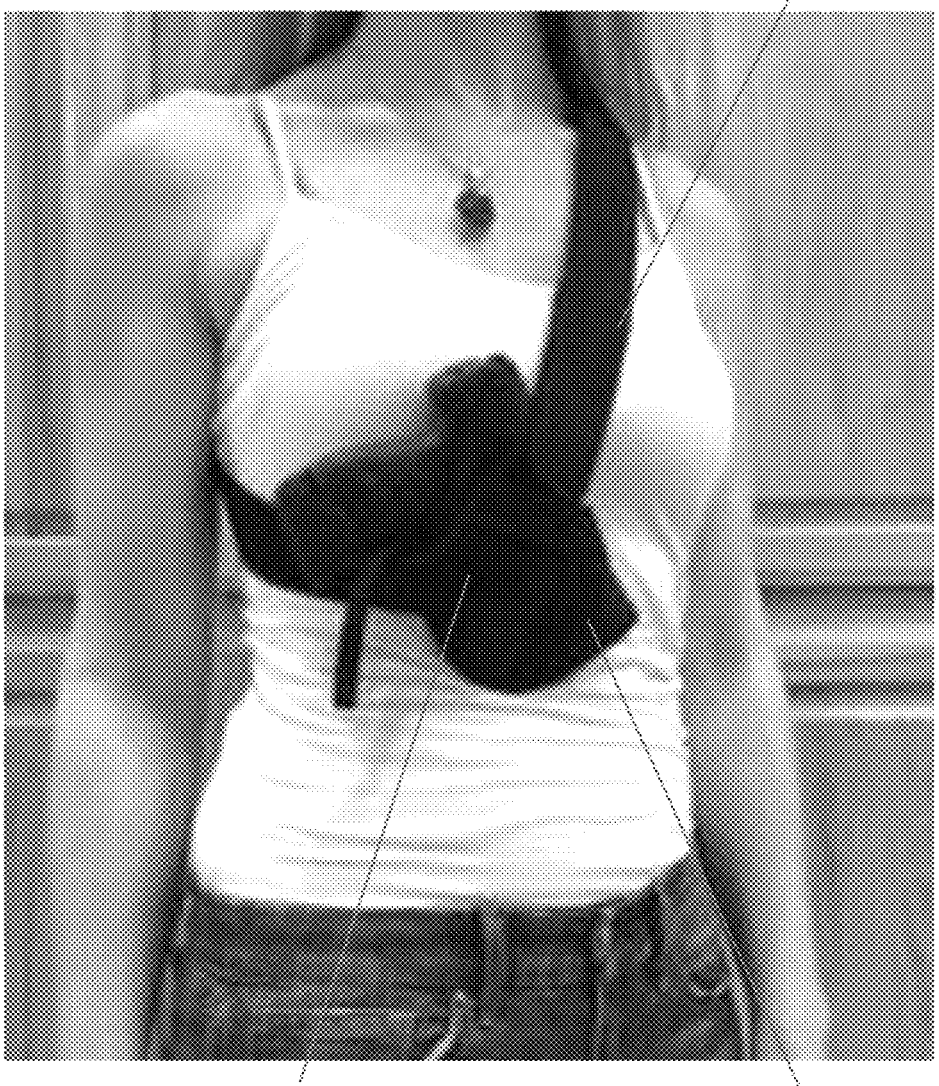
Figure 12Q:
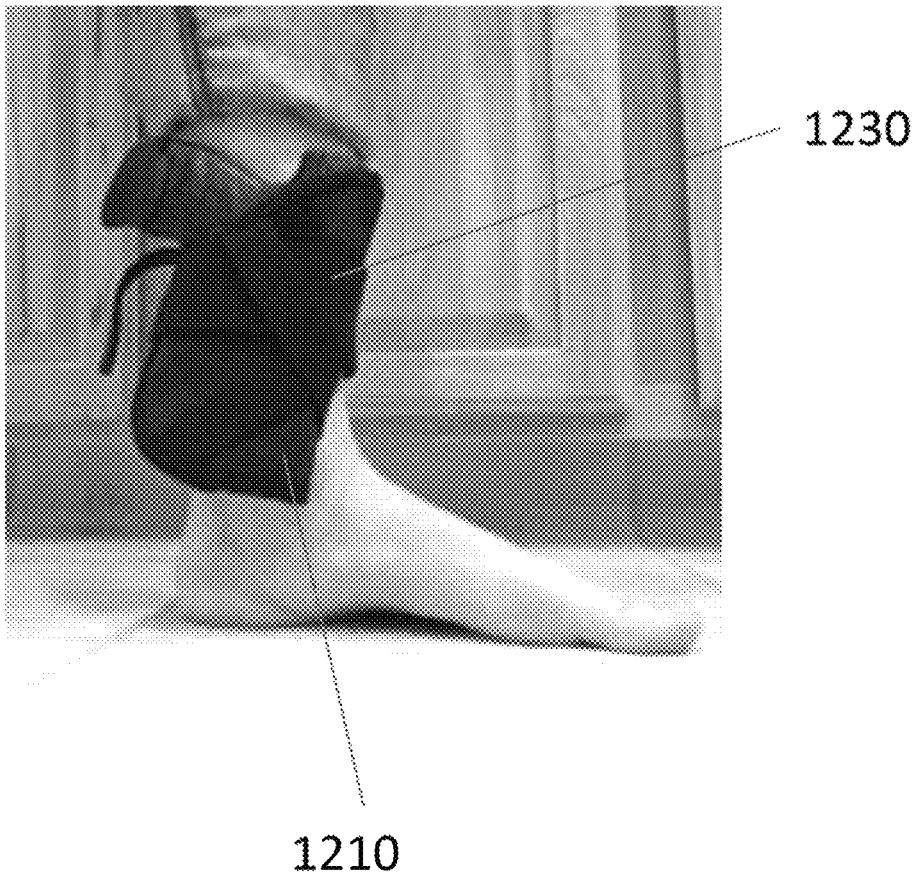
Figure 12R:
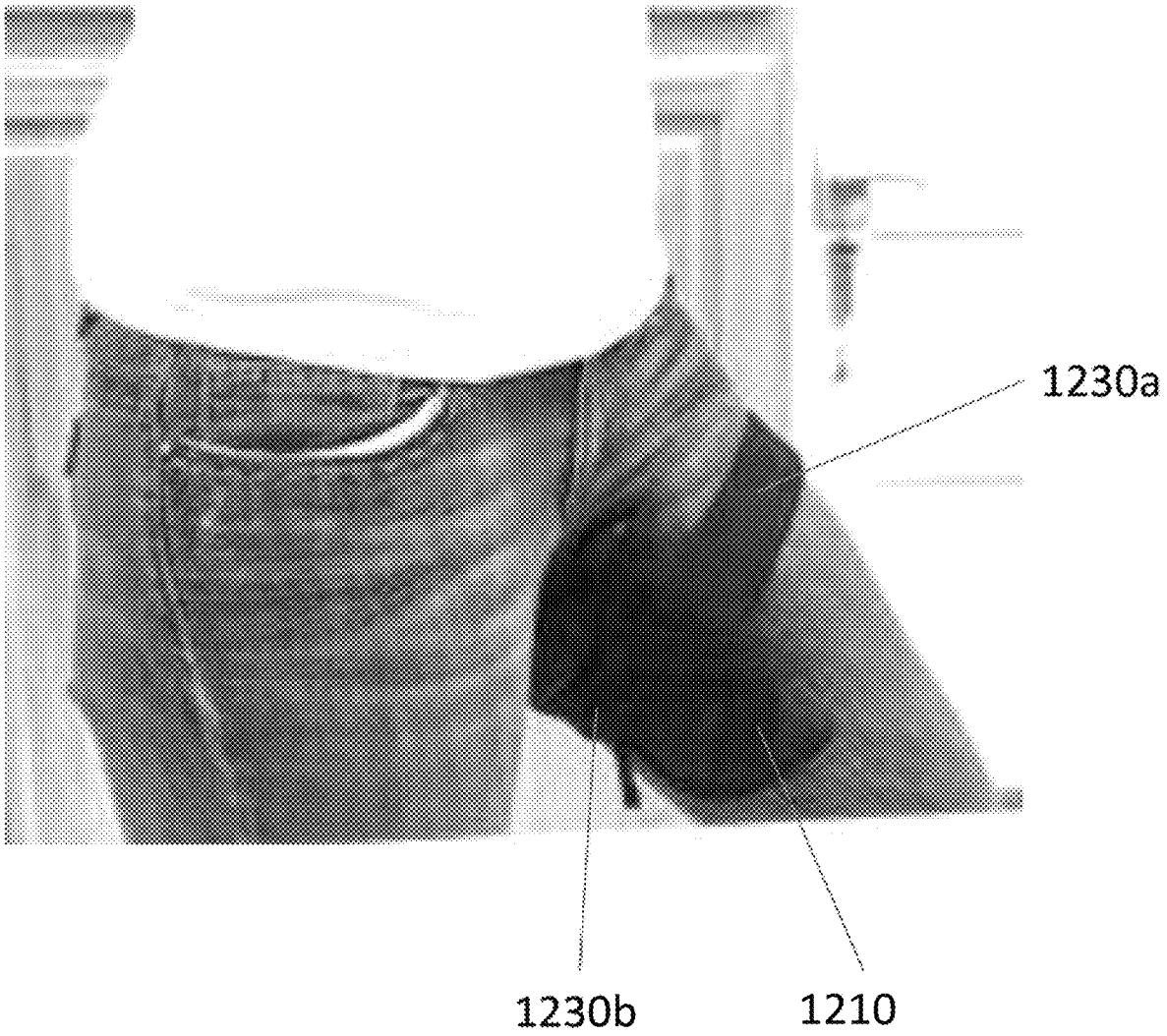
Figure 12S:
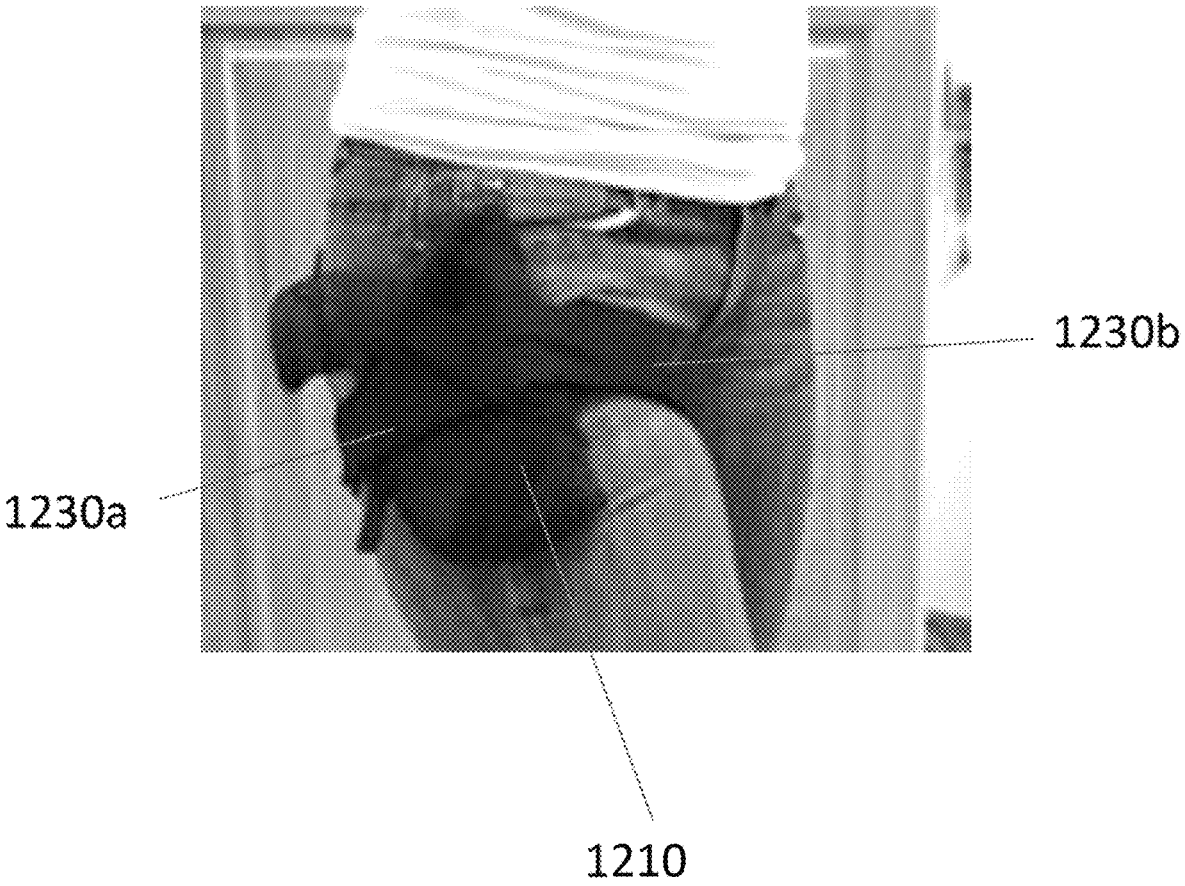

In various embodiments, a second strap 1230*b*, which may be of varying size, is combined with the first strap 1230*a* in order to position bag 1210 in various positions on the body. For example, bag 1210 may be positioned on a user's hip (FIG. 12N), in a user's waist band (FIG. 12O), over a user's shoulder (FIG. 12P), on a user's ankle (FIG. 12Q), or on a user's thigh (interior, FIG. 12R; exterior FIG. 12S). In various embodiments, the second strap 1230*b* is cut to size to ensure proper fit for a user. In some embodiments, the second strap 1230*b* is cut to ensure proper fit in a particular position on a user's body. Thus, a user may have a variety of second straps 1230*b* that may be interchanged to position the bag 1210 in different positions on the user's body.

Figure 12T:
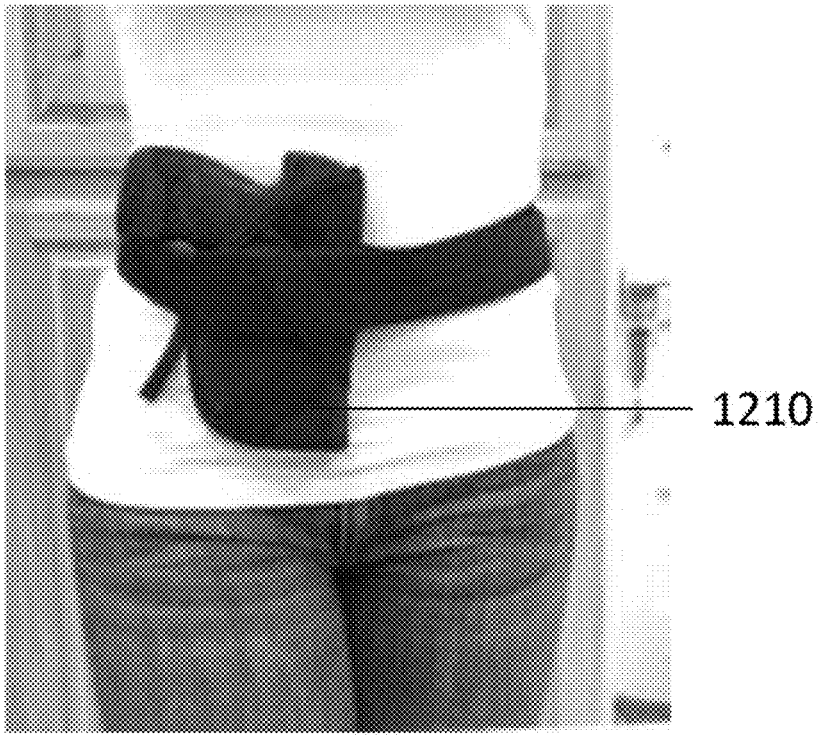
Figure 12U:
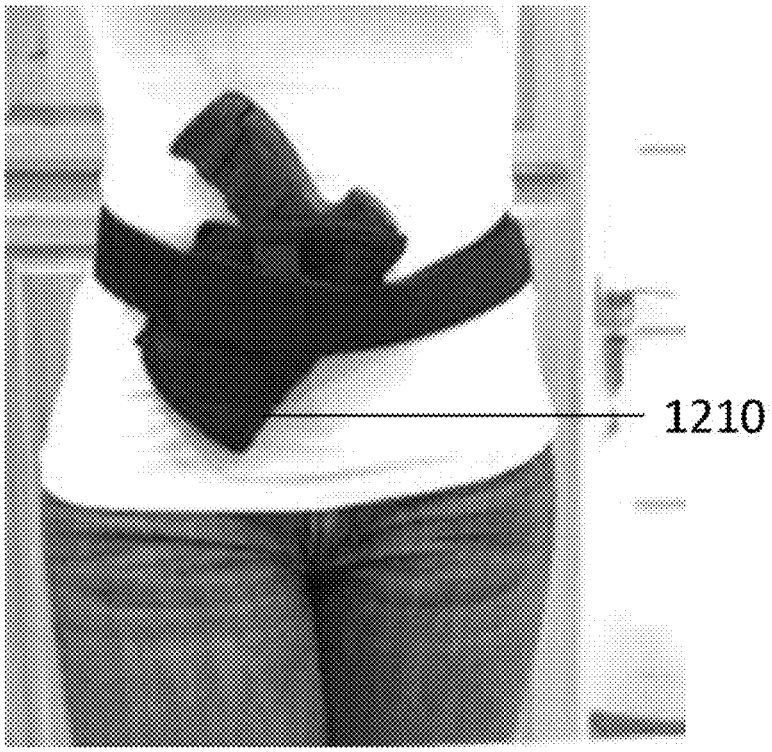

Bag 1210 may further be positioned at a variety of angles. This allows a user to position bag 1210 at a particular angle for comfort, to reduce visibility, and the like. For example, FIG. 12T and FIG. 12U show the same bag 1210 at the same position of the body, but canted at different angles. FIG. 12T shows bag 1210 at an angle substantially perpendicular to the first and second strap 1230*a*, 1230*b*, while FIG. 12U shows bag 1210 at about a 45 degree angle. When a bag of the present disclosure is positioned at either of these angles, or any number of angles in between, the same benefits described above are realized (e.g., the item is securely held in the bag, the bag does not shift when removing the item, etc.).

Various straps can be used with various bags shown and described herein. In embodiments, the strap can be sized to be worn as a shoulder bag, across the user's body, as a backpack, or around a user's ankle, thigh, waist, etc.

Figure 13A:
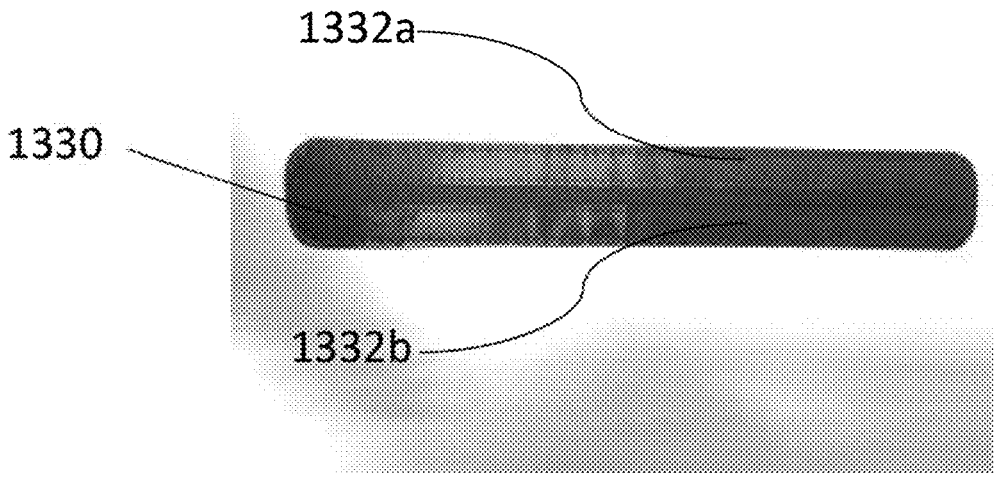
FIGS. 13A-13G show several embodiments of straps of the disclosure.

Embodiments of the present disclosure include strapping systems onto which items, including holsters (e.g., firearm holsters), may be arranged. In embodiments, the strapping system includes at least one strap. An embodiment of a strap 1330 according to the present disclosure is shown in FIG. 13A. Strap 1330 includes a fastener (e.g., hook and loop closures, and the like) arranged in horizontal strips 1332*a*, 1332*b*. In other embodiments, the fastener may be arranged in a different pattern, for example, vertical strips, a checkerboard pattern, etc.

Figure 13B:
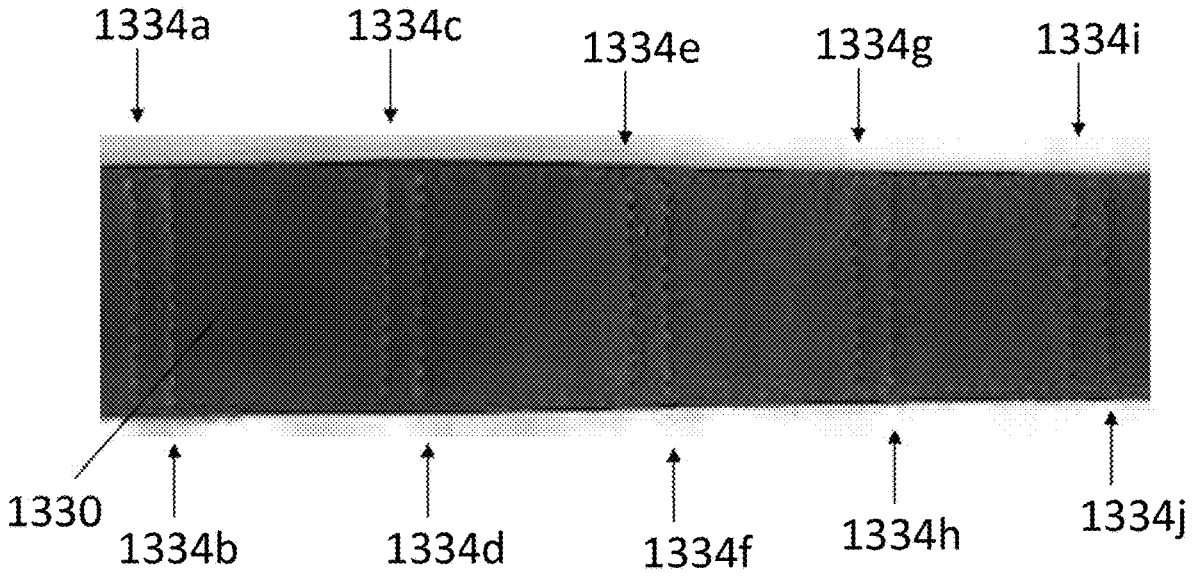
Figure 13C:
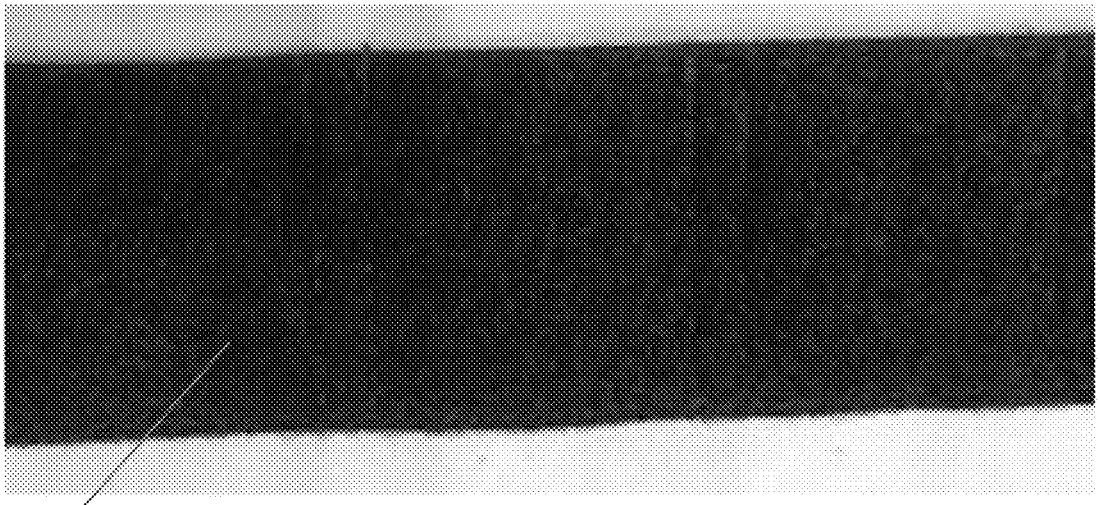

Another embodiment of a strap 1330 is shown in FIG. 13B and FIG. 13C. A first side of a positioning strap is seen in FIG. 13B. In embodiments, a strap 1330 has a width ranging from about 0.5 inches to about 6 inches wide. In particular embodiments, the strap 1330 has a thickness of about 1.75 inches. In some embodiments, a strap 1330 is made of a fabric or other material that does not fray when cut. For example, a strap 1330 may be made of a microfiber, a leather, etc. In such embodiments, a user may more easily cut the strap 1330 to the desired length without risking damage to the integrity of the material.

In various embodiments, a strap 1330 is made of at least two layers that are coupled together. In such embodiments, a first layer may be as shown in FIG. 13B, and as described above. The layers may be joined together using any suitable methods (e.g., stitching, gluing, etc.). In some embodiments, where the layers are stitched together, the stitching is reinforced at periodic intervals to allow a user to more easily cut the positioning strap to the desired length without risking damage to the integrity of the material. An example of such reinforced stitching is shown in FIG. 13B. As is shown in FIG. 13B, lines of stitching 1334*a*-1334*j* are made in a repeating pattern, e.g., at fixed distances.

In some embodiments, at least a portion of a second layer is one half of a hook and loop fastener system (i.e., the hook or the loop), as shown in FIG. 13C. In some embodiments, the entire surface of the second layer is one half of the hook and loop fastener system. In certain embodiments, the portion of the second layer is the loop side of the fastener system. In other embodiments, the portion of the second layer is the hook side of the fastener system.

Figure 13D:
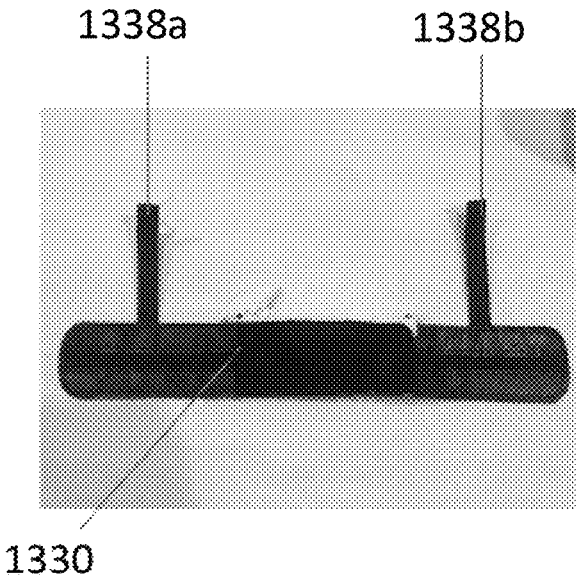
Figure 13E:
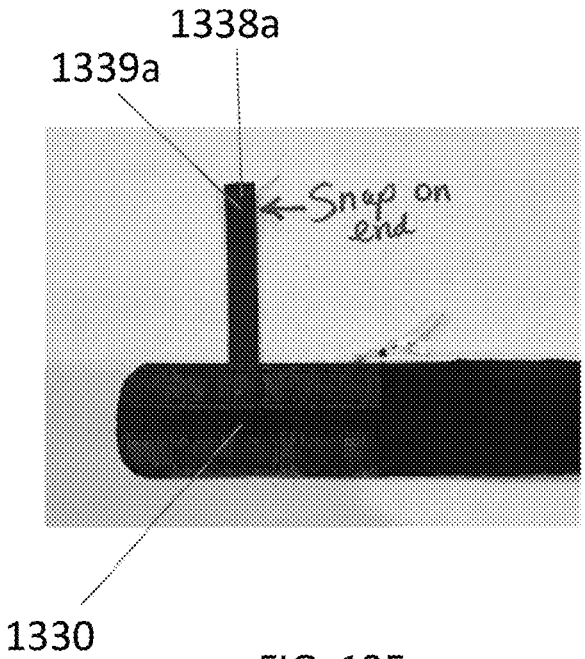
Figure 13F:
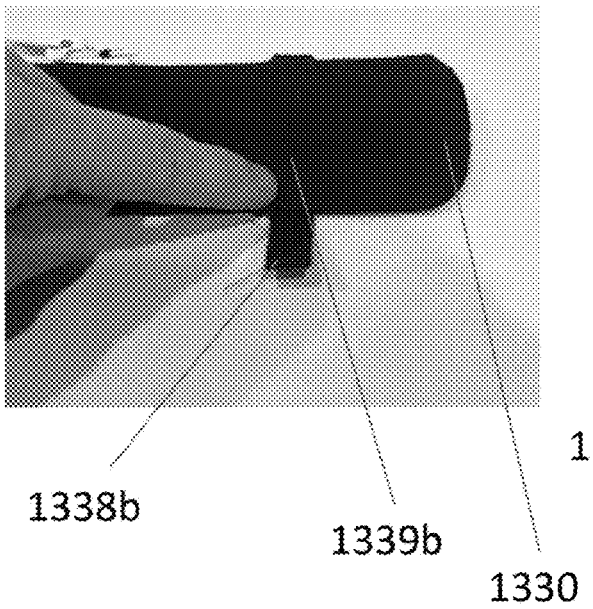
Figure 13G:
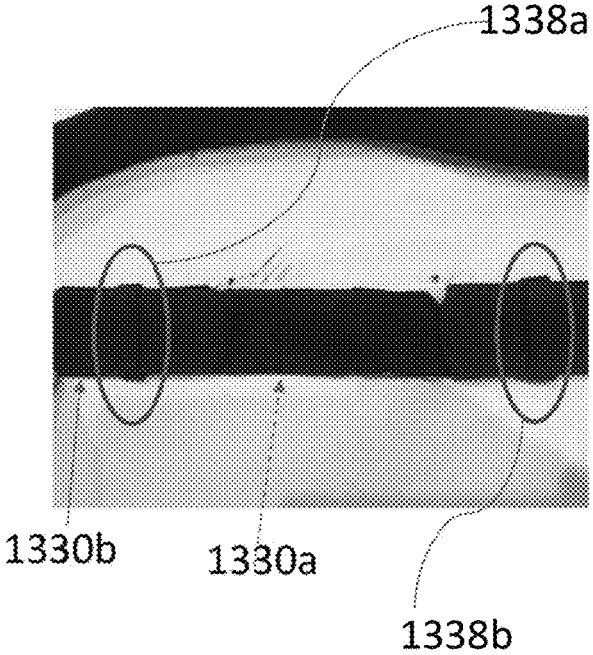

In some embodiments, a strap 1330 includes one or more tabs 1338*a*, 1338*b*, which are shown extending upward from the strap 1330 in FIG. 13D. As can be seen in FIG. 13D, one end of the tabs 1338*a*, 1338*b* are fixedly coupled to the strap 1330. The second ends of the tabs 1338*a*, 1338*b* are free. As shown in FIG. 13E, the second end of the tabs 1338*a*, 1338*b* include a portion of a fastener 1339*a*, 1339*b*, respectively, (e.g., a snap, hook and loop fastener, button, clip, etc.). As shown in FIG. 13F, the corresponding portion of the fastener is fixed to the strap 1330 or a second positioning strap, such that the portion of the fastener 1339*a*, 1339*b* fixed to the tabs 1338*a*, 1338*b*, respectively, can be coupled to the portion of the fastener fixed to the strap 1330 or a second strap. In some embodiments, the tabs 1338*a*, 1338*b* are arranged such that the two portions of the fastener can be coupled together. Namely, the portion of the fastener 1339*a*, 1339*b* fixed to the tabs 1338*a*, 1338*b*, respectively, on one strap 1330 can be coupled to the fastener on a second strap 1330*b*, such as is shown in FIG. 13G. In other words, the first strap 1330*a* is coupled to the second strap 1330*b* via, for example, hook and loop fasteners, and the tabs 1338*a*, 1338*b* act as a secondary coupling of the two straps 1330*a*, 1330*b* to provide additional security and to prevent the two straps 1330*a*, 1330*b* from being decoupled.

Figure 14A:
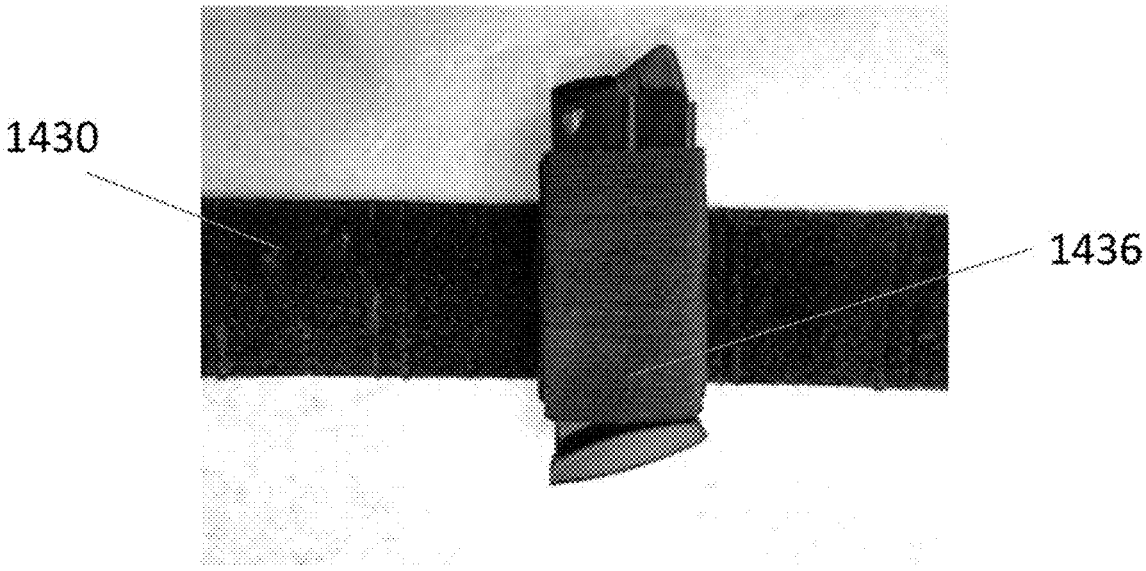
FIGS. 14A-14G show several embodiments of features of straps of the disclosure.
Figure 14B:
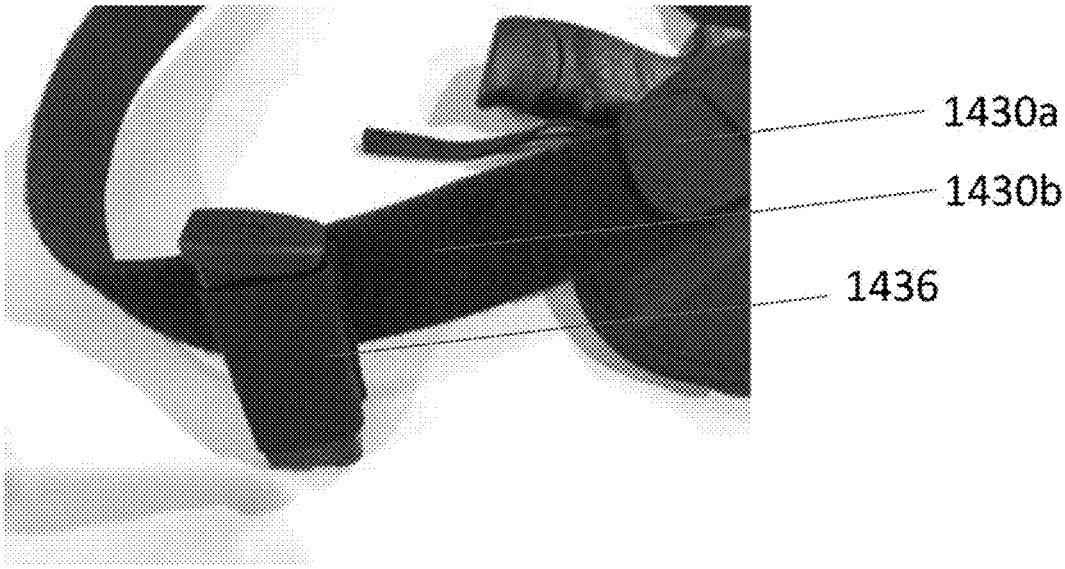
Figure 14C:
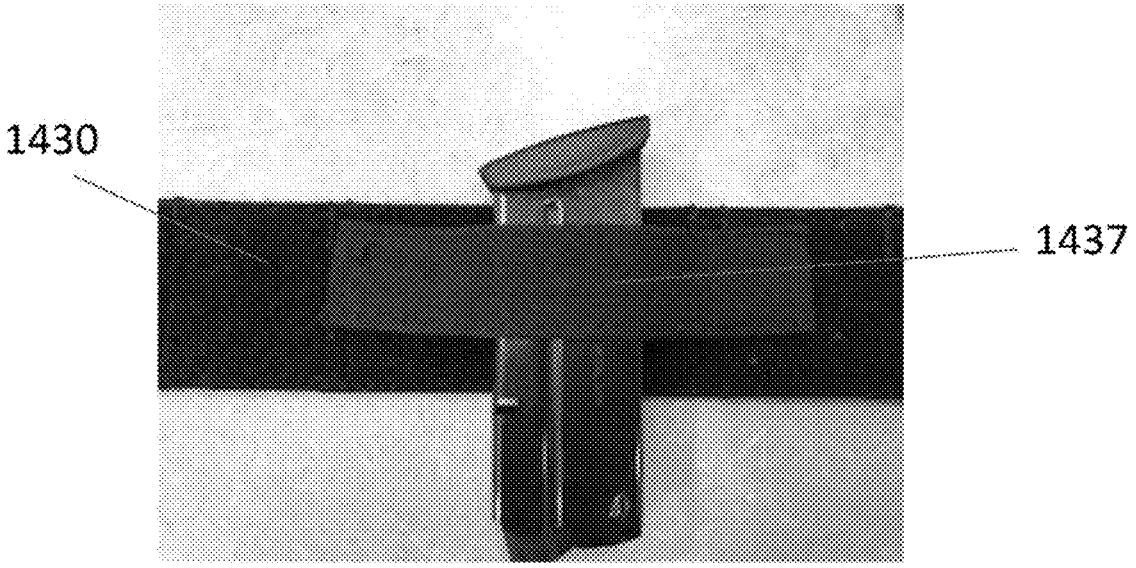
Figure 14D:
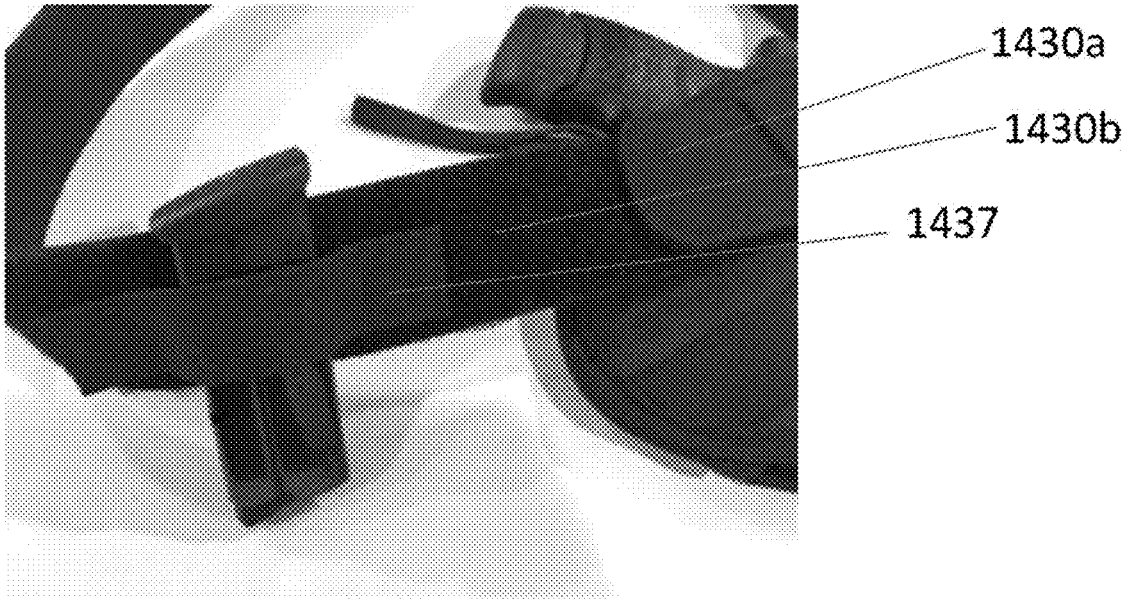

In various embodiments, a strap 1430 includes one or more storage components. For example, a positioning strap may include a pocket, elastic wrap, a pouch, or the like. Additional accessories (e.g., a mobile phone, a mp3 player, a magazine, a sight, etc.) may be removably coupled to the strap 1430 using elastic wraps 1436 (as shown in FIGS. 14A and 14B), or appropriately sized straps 1437 (as shown in FIGS. 14C and 14D).

Figure 14E:
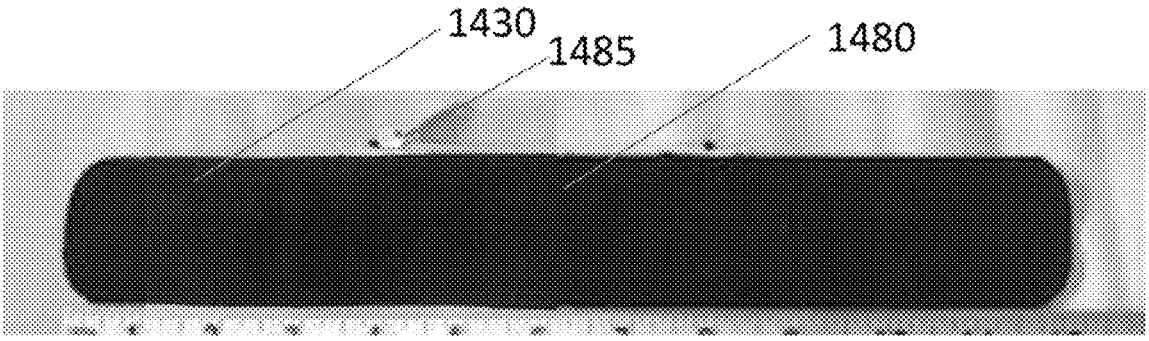
Figure 14F:
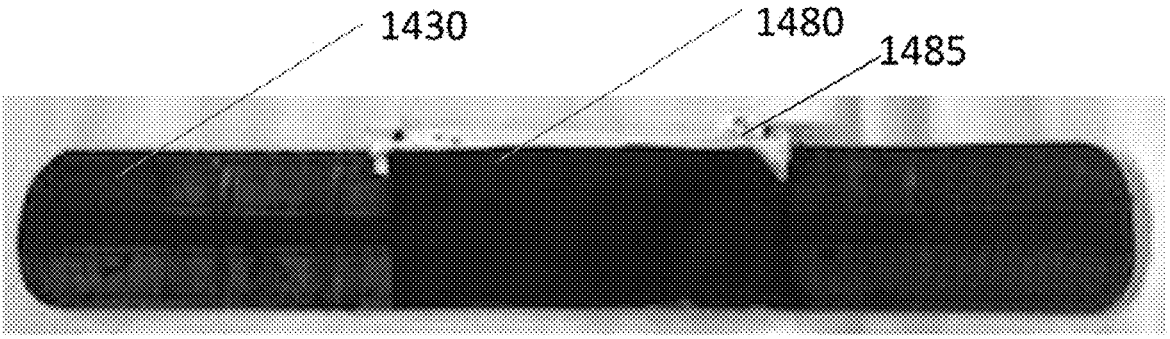
Figure 14G:
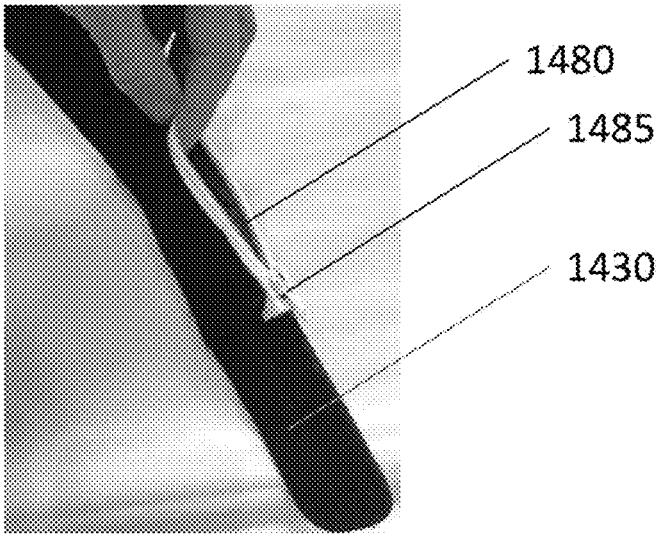

An embodiment of a strap that includes a pocket is shown in FIGS. 14E-14G. In some embodiments, the pocket 1480 is positioned between a first layer and a second layer of a strap 1430, as shown in FIG. 14E. In other embodiments, at least one end of the pocket 1480 is coupled to the remainder of the strap. The pocket 1480 may be made of any suitable material, and may be open or have a suitable closure. In particular embodiments, such as the embodiment shown in FIGS. 14E-14G, the pocket includes a zipper closure 1485. In some embodiments, the zipper 1485 is positioned on one edge of the strap, as shown in FIGS. 14E-14G. In other embodiments, the zipper is positioned on a face of the strap.

Figure 15A:
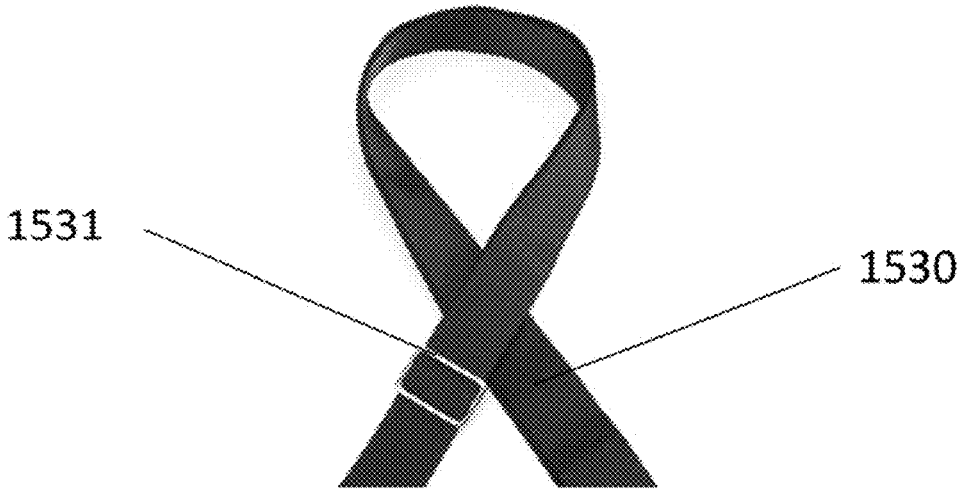
FIGS. 15A-15D show several embodiments of features of straps of the disclosure.
Figure 15B:
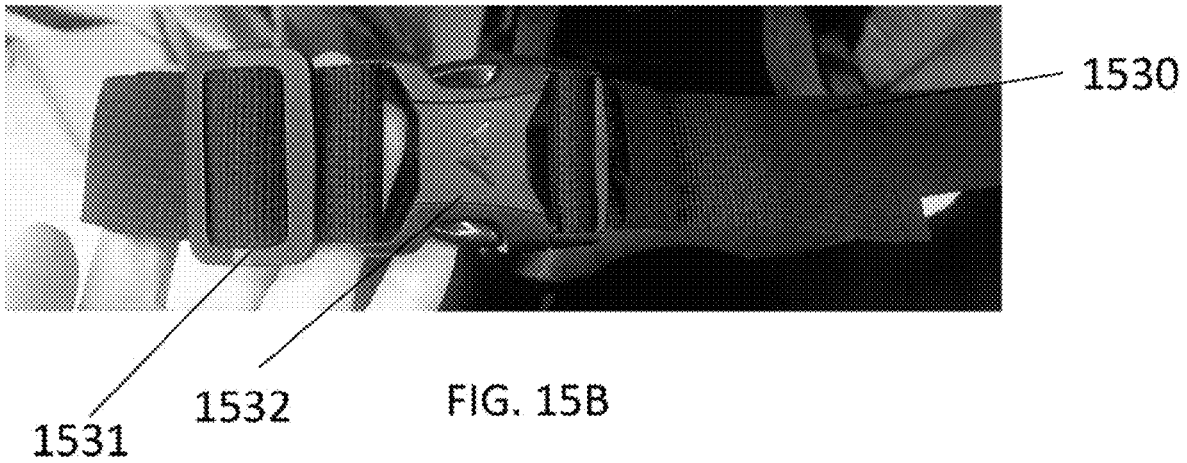
Figure 15C:
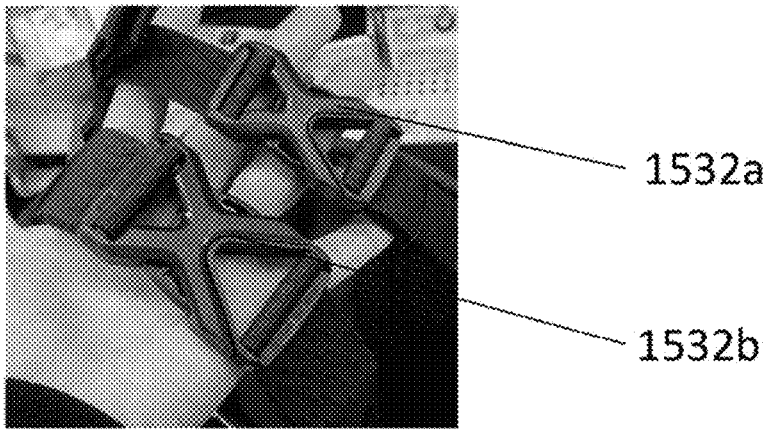
Figure 15D:
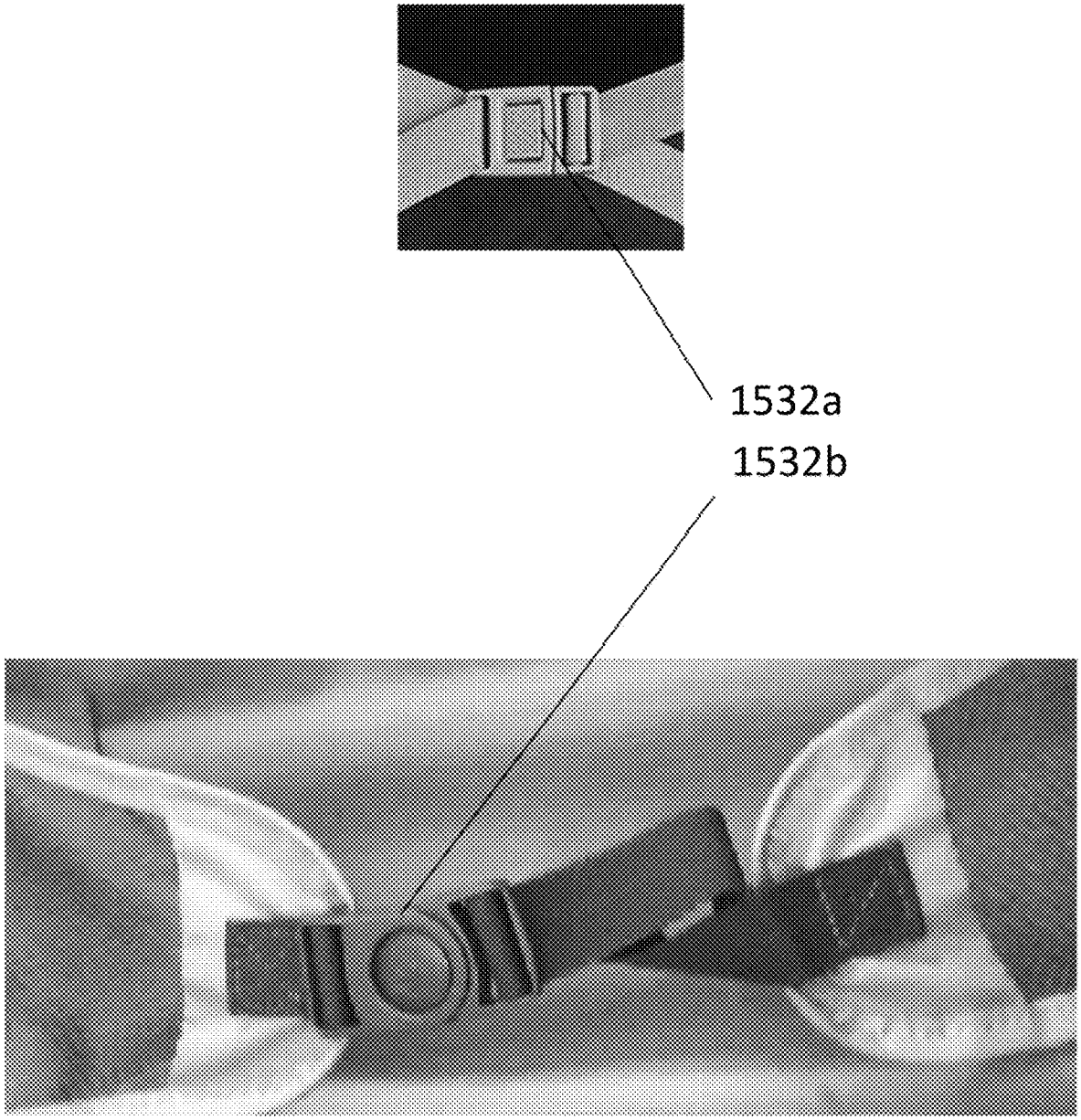

Alternate embodiments of a strap 1530 according to the present disclosure is shown in FIGS. 15A-15D. The strap 1530 shown in FIG. 15A is adjustable by means of the metal slide 1531. Similarly, the strap 1530 shown in FIG. 15B is adjustable by means of the plastic slide 1531. Additionally, strap 1530 includes a plastic clip 1532 that can be used to fasten a first end of strap 1530 to a second end of strap 1530. In other embodiments, plastic clip 1532 can be used to couple multiple straps to one another. Alternate embodiments of plastic clips 1532*a*, 1532*b* are shown in FIG. 15C and FIG. 15D.

In the preceding description, certain specific details are set forth in order to provide a thorough understanding of various aspects of the disclosed subject matter. However, the disclosed subject matter may be practiced without these specific details. In some instances, well-known structures and methods have not been described in detail to avoid obscuring the descriptions of other aspects of the present disclosure.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The terms "a," "an," "the," and similar articles or terms used in the context of describing the disclosure (especially in the context of the following claims) are to be construed to cover both the singular and the plural (i.e., "one or more"), unless otherwise indicated herein or clearly contradicted by context. Ranges of values recited herein are intended to serve as a shorthand method of referring individually to each separate value falling within the range. In the present description, any concentration range, percentage range, ratio range, or integer range is to be understood to include the value of any integer within the recited range and, when appropriate, fractions thereof (such as one tenth and one hundredth of an integer), unless otherwise indicated. Also, any number range recited herein relating to any physical feature, such as size or thickness, are to be understood to include any integer within the recited range, unless otherwise indicated. Unless otherwise indicated herein, each individual value is incorporated into the specification as if it were individually recited herein.

The use of the alternative (e.g., "or") should be understood to mean one, both, or any combination thereof of the alternatives. The various embodiments described above can be combined to provide further embodiments. Groupings of alternative elements or embodiments of the disclosure described herein should not be construed as limitations. Each member of a group may be referred to and claimed individually, or in any combination with other members of the group or other elements found herein.

The term "about" has the meaning reasonably ascribed to it by a person of ordinary skill in the art when used in conjunction with a stated numerical value or range, i.e. denoting somewhat more or somewhat less than the stated value or range, to within a range of ±20% of the stated value; ±19% of the stated value; ±18% of the stated value; ±17% of the stated value; ±16% of the stated value; ±15% of the stated value; ±14% of the stated value; ±13% of the stated value; ±12% of the stated value; ±11% of the stated value; ±10% of the stated value; ±9% of the stated value; ±8% of the stated value; ±7% of the stated value; ±6% of the stated value; ±5% of the stated value; ±4% of the stated value; ±3% of the stated value; ±2% of the stated value; or ±1% of the stated value.

The term "substantially" has the meaning reasonably ascribed to it by a person of ordinary skill in the art when used to describe a physical characteristic of an item, i.e., indicating that the item possesses the referenced characteristic to a significant extent, e.g., to within a range of ±20% of the referenced characteristic; ±19% of the referenced characteristic; ±18% of the referenced characteristic; ±17% of the referenced characteristic; ±16% of the referenced characteristic; ±15% of the referenced characteristic; ±14% of the referenced characteristic; ±13% of the referenced characteristic; ±12% of the referenced characteristic; ±11% of the referenced characteristic; ±10% of the referenced characteristic; ±9% of the referenced characteristic; ±8% of the referenced characteristic; ±7% of the referenced characteristic; ±6% of the referenced characteristic; ±5% of the referenced characteristic; ±4% of the referenced characteristic; ±3% of the referenced characteristic; ±2% of the referenced characteristic; or ±1% of the referenced characteristic. For example, an item may be considered substantially circular if any two measurements of a diameter of the item are within a range of ±20%, ±19%; ±18%; ±17%; ±16%; ±15%; ±14%; ±13%; ±12%; ±11%; ±10%; ±9%; ±8%; ±7%; ±6%; ±5%; ±4%; ±3%; ±2%; or ±1% of each other. When used in conjunction with a comparator (e.g., a first coating is substantially thicker than a second coating) substantially is used to mean that the difference is at least ±20% of the referenced characteristic; ±19% of the referenced characteristic; ±18% of the referenced characteristic; ±17% of the referenced characteristic; ±16% of the referenced characteristic; ±15% of the referenced characteristic; ±14% of the referenced characteristic; ±13% of the referenced characteristic; ±12% of the referenced characteristic; ±11% of the referenced characteristic; ±10% of the referenced characteristic; ±9% of the referenced characteristic; ±8% of the referenced characteristic; ±7% of the referenced characteristic; ±6% of the referenced characteristic; ±5% of the referenced characteristic; ±4% of the referenced characteristic; ±3% of the referenced characteristic; ±2% of the referenced characteristic; or ±1% of the referenced characteristic.

Reference throughout the specification to "one embodiment" or "an embodiment" means that a particular feature, structure, or characteristic described in connection with the embodiment is included in at least one embodiment. Thus, the appearance of the phrases "in one embodiment" or "in an embodiment" in various places throughout the specification are not necessarily all referring to the same aspect. Furthermore, the particular features, structures, or characteristics may be combined in any suitable manner in one or more aspects of the present disclosure. The particulars described herein are by way of example and are only for purposes of illustrative discussion of embodiments of the present disclosure. The use of any and all examples, or exemplary language (e.g., "such as") provided herein is merely intended to better illuminate the disclosure and does not pose a limitation on the scope of the disclosure as claimed. No language in the specification should be construed as indicating any non-claimed element is essential to the practice of the disclosure. Further, all methods described herein can be performed in any suitable order unless otherwise indicated herein or otherwise clearly contradicted by context.

Each embodiment disclosed herein can comprise, consist essentially of, or consist of a particular stated element, step, ingredient, or component. The term "comprise" or "comprises" means "includes, but is not limited to," and allows for the inclusion of unspecified elements, steps, ingredients, or components, even in major amounts. The phrase "consisting of" excludes any element, step, ingredient, or component that is not specified. The phrase "consisting essentially of" limits the scope of the embodiment to the specified elements, steps, ingredients, or components, and to those that do not materially affect the basic and novel characteristics of the claimed disclosure.

Definitions used in the present disclosure are meant and intended to be controlling in any future construction unless clearly and unambiguously modified in the examples or when application of the meaning renders any construction meaningless or essentially meaningless. In cases where the construction of the term would render it meaningless or essentially meaningless, the definition should be taken from Webster's Dictionary, 3rd Edition or a dictionary known to those of ordinary skill in the art.

Although the subject matter has been described in language specific to structural features or methodological acts, it is to be understood that the subject matter defined in the appended claims is not necessarily limited to the specific features or acts described. Rather, the specific features and acts are disclosed as illustrative forms of implementing the claims.

The invention claimed is:

1. A bag system comprising:

a bag having an exterior surface and including:

a first securing element coupled to the exterior surface of the bag, the first securing element extending in a first direction;

a second securing element coupled to the exterior surface of the bag, the second securing element extending in a second direction that is transverse to the first direction and intersecting the first securing element; and a third securing element coupled to the exterior surface of the bag; and a first positioning strap positioned under the first securing element, the second securing element, and the third securing element.

2. The bag system of claim 1, wherein the bag further includes a fourth securing element, the third securing element and the fourth securing element extending in a third direction that is transverse to the first direction and the second direction.

3. The bag system of claim 2, wherein the first positioning strap is arranged under the first, second, third, and fourth securing elements.

4. The bag system of claim 2, wherein the bag further includes a fifth securing element and a sixth securing element extending in a fourth direction that is transverse to the first direction, the second direction, and the third direction.

5. The bag system of claim 1, further including a second positioning strap that is secured to the first positioning strap such that the first positioning strap and the second positioning strap collectively form a loop.

6. A bag system comprising:

a bag having an exterior surface and including:

a first securing element having a first end and a second end coupled to the exterior surface of the bag;

a second securing element having a first end and a second end coupled to the exterior surface of the bag, the second securing element forming an X-shape with the first securing element; and a third securing element coupled to the first end of the first securing element and the first end of the second securing element; and a positioning strap positioned under the first securing element, the second securing element, or both.

7. The bag system of claim 6, wherein the bag further includes a fourth securing element coupled to the second end of the first securing element and the second end of the second securing element.

8. The bag system of claim 7, wherein the positioning strap is arranged under the first, second, third, and fourth securing elements.

9. The bag system of claim 7, wherein the bag further includes a fifth securing element coupled to the first end of the first securing element and the second end of the second securing element.

10. The bag system of claim 9, wherein the bag further includes a sixth securing element coupled to the first end of the second securing element and the second end of the first securing element.

11. The bag system of claim 10, wherein the positioning strap is arranged under the first, second, fifth, and sixth securing elements.

12. A system comprising:

a bag having an exterior side that has a perimeter including a first edge, a second edge, a third edge, and a fourth edge, the bag including a plurality of securing elements coupled to the exterior side, the plurality of securing elements including:

a first portion arranged in a lattice pattern, the first portion including at least a first securing element; and a second portion including a second securing element, a third securing element, a fourth securing element, and a fifth securing element extending along the first edge, the second edge, the third edge, and the fourth edge, respectively; and a positioning strap positioned between the exterior side of the bag and at least the first securing element.

13. The system of claim 12, wherein the positioning strap is arranged under the first, second, and fourth securing elements.

* * * * *